US012280289B2

(12) United States Patent
Lewis-Dove

(10) Patent No.: US 12,280,289 B2
(45) Date of Patent: Apr. 22, 2025

(54) VERSATILE UNIVERSAL GYM

(71) Applicant: Gym-in-a-Box LLC, Charleston, SC (US)

(72) Inventor: Stacey M. Lewis-Dove, Charleston, SC (US)

(73) Assignee: Gym-in-a-Box LLC, Moncks Corner, SC (US)

( * ) Notice: Subject to any disclaimer, the term of this patent is extended or adjusted under 35 U.S.C. 154(b) by 673 days.

(21) Appl. No.: 17/046,469

(22) PCT Filed: Oct. 24, 2018

(86) PCT No.: PCT/US2018/057195

§ 371 (c)(1),
(2) Date: Oct. 9, 2020

(87) PCT Pub. No.: WO2019/199352

PCT Pub. Date: Oct. 17, 2019

(65) Prior Publication Data

US 2021/0170218 A1 Jun. 10, 2021

Related U.S. Application Data

(60) Provisional application No. 62/679,828, filed on Jun. 3, 2018, provisional application No. 62/656,126, filed on Apr. 11, 2018.

(51) Int. Cl.
*A63B 21/16* (2006.01)
*A63B 1/00* (2006.01)
(Continued)

(52) U.S. Cl.
CPC ..... *A63B 21/16* (2013.01); *A63B 21/0557* (2013.01); *A63B 21/4029* (2015.10);
(Continued)

(58) Field of Classification Search
CPC . A63B 21/16; A63B 21/4029; A63B 21/0557; A63B 23/03525; A63B 71/0622;
(Continued)

(56) References Cited

U.S. PATENT DOCUMENTS 2,752,180 A * 6/1956 Vogt ..... F16C 11/0676 403/51
4,323,236 A * 4/1982 Szabo ..... A63B 21/4035 482/97
(Continued)

FOREIGN PATENT DOCUMENTS

CN 202506050 U 10/2012
CN 203886099 U 10/2014
(Continued)

OTHER PUBLICATIONS

Google translation of Russian Patent No. RU2557745 C1 (5 pages).
(Continued)

*Primary Examiner* — Sundhara M Ganesan
*Assistant Examiner* — Jacqueline N L Loberiza
(74) *Attorney, Agent, or Firm* — Thrive IP®; Jeremy M. Stipkala

(57) ABSTRACT

A universal gym exhibits improved versatility employing a frame supporting a weight stack connected via cable to an exercise attachment point, which further engages a floating pulley with an extension cable. Accessory receiving ports throughout the frame allow placement of the floating pulley virtually anywhere the athlete desires, affording a vast array of exercises employing the weight stack. Free weights, elastic bands, and the weight stack, alone or in combination, can provide a diverse resistance. Decorative panels, optionally mounted with hollow-headed bolts each having an axial recess for receiving and retaining a panel-mounting rivet, can disguise the universal gym when not in use.

17 Claims, 46 Drawing Sheets

(51) Int. Cl.

| | |
|---|---|
| ***A63B 21/00*** | (2006.01) |
| ***A63B 21/055*** | (2006.01) |
| ***A63B 21/062*** | (2006.01) |
| ***A63B 21/072*** | (2006.01) |
| ***A63B 21/078*** | (2006.01) |
| ***A63B 23/02*** | (2006.01) |
| ***A63B 23/035*** | (2006.01) |
| ***A63B 71/06*** | (2006.01) |

(52) U.S. Cl.
CPC .... *A63B 23/03525* (2013.01); *A63B 71/0622* (2013.01); *A63B 1/00* (2013.01); *A63B 21/0628* (2015.10); *A63B 21/0724* (2013.01); *A63B 21/078* (2013.01); *A63B 21/154* (2013.01); *A63B 23/0211* (2013.01); *A63B 2071/0625* (2013.01); *A63B 2071/0658* (2013.01); *A63B 2225/093* (2013.01); *A63B 2225/105* (2013.01)

(58) Field of Classification Search
CPC ... A63B 21/0628; A63B 1/00; A63B 21/0724; A63B 21/078; A63B 21/154; A63B 23/0211; A63B 2071/0625; A63B 2071/0658; A63B 2225/093; A63B 2225/105; A63B 21/06; A63B 71/06; F16C 11/06–0695
See application file for complete search history.

(56) References Cited

U.S. PATENT DOCUMENTS

| | | | | |
|---|---|---|---|---|
| 4,492,375 | A * | 1/1985 | Connelly | A63B 21/055 482/130 |
| 4,898,381 | A | 2/1990 | Gordon | |
| 6,443,877 | B1 | 9/2002 | Hoecht et al. | |
| 6,497,548 | B1 | 12/2002 | Roy | |
| 6,527,683 | B2 | 3/2003 | Tolles | |
| 6,994,661 | B1 | 2/2006 | Dawson | |
| 7,601,105 | B1 | 10/2009 | Gipson, III et al. | |
| 7,628,734 | B1 | 12/2009 | Proctor | |
| 7,766,803 | B2 | 8/2010 | Carter | |
| D635,206 | S | 3/2011 | Henninger | |
| D636,038 | S | 4/2011 | Henniger | |
| D636,039 | S | 4/2011 | Henniger | |
| D636,040 | S | 4/2011 | Henniger | |
| 8,057,368 | B1 | 11/2011 | Lyszczarz | |
| 8,172,736 | B2 | 5/2012 | Contreras | |
| 8,506,459 | B2 | 8/2013 | Cassidy et al. | |
| 8,663,075 | B2 * | 3/2014 | Reyes | A63B 23/0405 482/92 |
| 8,727,952 | B1 | 5/2014 | Carle | |
| 9,586,081 | B2 | 3/2017 | Lagree et al. | |
| 9,713,738 | B2 | 7/2017 | Shrag | |
| D852,907 | S | 7/2019 | Sergakis | |
| D883,406 | S | 5/2020 | Sergakis | |
| D888,851 | S | 6/2020 | Dunahay | |
| 10,709,921 | B2 | 7/2020 | Risacher | |
| D898,844 | S | 10/2020 | Sergakis | |
| 10,806,963 | B2 | 10/2020 | Staten | |
| 10,926,151 | B2 | 2/2021 | Dunahay | |
| D928,253 | S | 8/2021 | Dunahay | |
| D931,955 | S | 9/2021 | Dunahay | |
| D952,776 | S | 5/2022 | Adams | |
| D955,512 | S | 6/2022 | Sergakis | |
| D963,083 | S | 9/2022 | Dunahay | |
| 11,446,535 | B1 | 9/2022 | Iverson et al. | |
| D970,656 | S | 11/2022 | Gong | |
| D973,155 | S | 12/2022 | Gong | |
| D976,346 | S | 1/2023 | Pritchett et al. | |
| D981,509 | S | 3/2023 | Qi | |
| D992,063 | S | 7/2023 | Dunahay | |
| D997,267 | S | 8/2023 | Dunahay | |
| D1,001,216 | S | 10/2023 | Yang | |
| D1,005,419 | S | 11/2023 | Yang | |
| D1,008,381 | S | 12/2023 | Dunahay | |
| D1,008,382 | S | 12/2023 | Dunahay | |
| D1,010,033 | S | 1/2024 | Pritchett | |
| D1,017,735 | S | 3/2024 | Tong | |
| D1,023,182 | S | 4/2024 | Tang | |
| 12,036,436 | B2 | 7/2024 | Henninger | |
| 12,042,688 | B1 | 7/2024 | Lewis-Dove | |
| D1,042,672 | S | 9/2024 | Zhang | |
| 2002/0091043 | A1 * | 7/2002 | Rexach | A63B 21/0628 482/99 |
| 2004/0046488 | A1 | 3/2004 | Hogan | |
| 2007/0054785 | A1 | 3/2007 | Drechsler | |
| 2007/0155595 | A1 | 7/2007 | Rogers et al. | |
| 2007/0173384 | A1 | 7/2007 | Sechrest et al. | |
| 2009/0215594 | A1 * | 8/2009 | Panaiotov | A63B 21/16 482/130 |
| 2010/0022363 | A1 | 1/2010 | Fenster et al. | |
| 2010/0267527 | A1 | 10/2010 | Luquette | |
| 2011/0028281 | A1 | 2/2011 | Ish, III et al. | |
| 2011/0245049 | A1 | 10/2011 | Keiser | |
| 2012/0035026 | A1 | 2/2012 | Lyszczarz | |
| 2014/0135182 | A1 | 5/2014 | Inglut | |
| 2014/0243174 | A1 * | 8/2014 | Alenaddaf | A63B 21/15 482/142 |
| 2015/0141219 | A1 * | 5/2015 | Bellevue | A63B 21/0442 482/130 |
| 2017/0021215 | A1 | 1/2017 | Norris | |
| 2017/0056728 | A1 * | 3/2017 | Todd | A63B 21/0615 |
| 2018/0117382 | A1 | 5/2018 | Johanson et al. | |
| 2019/0151698 | A1 | 5/2019 | Olson et al. | |
| 2019/0240521 | A1 | 8/2019 | Staten | |
| 2019/0269992 | A1 | 9/2019 | Dunahay | |
| 2020/0114195 | A1 | 4/2020 | Henniger | |
| 2020/0171340 | A1 | 6/2020 | Hsu | |
| 2020/0384337 | A1 | 12/2020 | Brasch | |
| 2020/0391070 | A1 | 12/2020 | Henniger | |
| 2021/0170218 | A1 | 6/2021 | Lewis-Dove | |
| 2022/0016466 | A1 | 1/2022 | Henniger | |
| 2022/0161092 | A1 | 5/2022 | Fourney | |

FOREIGN PATENT DOCUMENTS

| | | | | |
|---|---|---|---|---|
| CN | 107297050 | A | 10/2017 | |
| CN | 206587342 | U | 10/2017 | |
| CN | 107694041 | A | 2/2018 | |
| EP | 3773939 | B1 | 8/2024 | |
| GB | 2560551 | A | 9/2018 | |
| GB | 6245516 | | 11/2022 | |
| JP | 58-190453 | A | 11/1983 | |
| JP | 62-179478 | A1 | 8/1987 | |
| JP | 2-243170 | A | 9/1990 | |
| JP | 2004-520897 | A | 7/2004 | |
| JP | 2012-110420 | A | 6/2012 | |
| JP | 2013-526979 | A | 6/2013 | |
| KR | 10-1776498 | B1 | 9/2019 | |
| RU | 2557745 | C1 | 7/2015 | |
| WO | 2009/003280 | A1 | 1/2009 | |
| WO | 2014/146710 | A1 | 9/2014 | |
| WO | WO-2016115254 | A1 * | 7/2016 | A63B 21/00065 |
| WO | WO-2017018169 | A1 * | 2/2017 | F16C 11/06 |
| WO | 2021/211825 | A1 | 10/2021 | |

OTHER PUBLICATIONS

Google translation of Chinese cited reference CN107297050A (13 pages).
Google translation of Korean cited reference KR 10-1776498 (8 pages).
International Search Report for PCT/US2021/027460 dated Jul. 13, 2021 (3 pages).
Written Opinion for PCT/US2021/027460 dated Jul. 13, 2021 (11 pages).
Extended European Search Report dated Dec. 22, 2021 in European application No. 18914148.4 (8 pages).
First Examination Report dated Sep. 10, 2021, Indian application No. 202017048568 (6 pages).

(56) References Cited

OTHER PUBLICATIONS

Google translation of Chinese cited reference CN203886099U (4 pages).
Office Action dated Dec. 21, 2021, Japanese application No. 2021-505179 (2 pages).
English-language translation of Office Action in Japanese application No. 2021-505179, dated Dec. 21, 2021 (3 pages).
Office Action dated Jan. 13, 2022 in Chinese application No. 201880092314.5 (2 pages).
English-language translation of Office Action dated Jan. 13, 2022 in Chinese application No. 201880092314.5 (5 pages).
Google translation of Japanese cited reference JP2012-110420 (13 pages).
Preliminary Rejection dated Apr. 26, 2022 in Korean application No. 10-2020-7032383 (5 pages).
Letter with English-language translation of Preliminary Rejection dated Apr. 26, 2022, in Korean application No. 10-2020-7032383 (5 pages).
espacenet.com description translation of Japanese cited reference 58-190453 (3 pages).
espacenet.com description translation of Japanese cited reference 62-179478 (3 pages).
Google translation of Japanese cited reference JP2004-520897 (18 pages).
Google translation of Japanese cited reference JP2243170 (7 pages).
Unpublished U.S. Appl. No. 17/670,607 in the name of Stacey M. Lewis-Dove (53 pages).
First Office Action with English translation for Chinese Patent Application No. 201880092314.5 dated Apr. 8, 2021 (4 pages).
Google translation of Chinese cited reference CN107694041A (8 pages).
Google translation of Chinese cited reference CN202506050U (7 pages).
Google translation of Chinese cited reference CN206587342U (5 pages).
International Search Report for PCT/US2018/057195 (Jan. 4, 2019) (2 Pages).
Written Opinion for PCT/US2018/057195 (Jan. 4, 2019) (3 pages).
First Examination Report dated Jul. 8, 2022, Australian Application No. 2018418953 (3 pages).
Office Action dated Oct. 31, 2022, Israeli Application No. 277873 (3 pages).
Letter with Translation of Israeli Office Action dated Oct. 31, 2022, Israeli Application No. 277873 (5 pages).
Office Action in U.S. Appl. No. 17/670,607 dated Jun. 20, 2023 (29 pages).
"Force USA MyRack In-Depth Review", Jul. 18, 2018, Youtube, site visited Dec. 6, 2023:https://www.youtube.com/watch?v=Pz0cDmZF2xs (Year: 2018).
"Force USA MyRack Power Rack Overview", Sep. 25, 2018, Youtube, site visited Jul. 18, 2023: https://www.youtube.com/watch?v= W0aFOzu6TV) (Year: 2018).
"Power Rack Cable Crossover Attachment Preview By Bells of Steel", Apr. 15, 2019, Youtube, site visited Dec. 6, 2023:https://www.youtube.com/watch?v=6EuUpLcBqwA (Year: 2019).
"VANSWE Power Rack" Aug. 6, 2019, Amazon, site visited Jul. 18, 2023: https://www.amazon.com/dp/B088ZL16SB (Year: 2019).
"The Beast Commercial Quality Power Rack with 1500 lbs. Capacity" Jan. 2, 2016, Modern Office Furniture, site visited Jul. 18, 2023: Https://www.modernofficefurniture.com/beast-commercial-power-rack-y13216.html (Year: 2016).
"The Monster Lite Cave" Aug. 2021, Rogue Fitness, site visited Jul. 18, 2023: https://www.roguefitness.com/the-monster-lite-cave (Year: 2021).
"Greatest Garage Gym Tour—2019" Feb. 5, 2019, Youtube, site visited Jul. 21, 2023: gttps://youtube.com/watch?v=a6BknMESy7E (Year: 2019).
"Garage Gym Reviews Gym Tour—Coop" May 28, 2020, Youtube, site visited Jul. 31, 2023: https://www.youtube.come/watch?v=8SMxlRsf4bs (Year: 2020).
Second Examination Report and Hearing Notice dated Aug. 2, 2023, Indian application No. 202017048568 (2 pages).
Office Action in Mexican Patent App. No. MX/a/2020/010746 dated May 22, 2024 (3 pages).
Google Machine Translation of Office Action in Mexican Patent App. No. MX/a/2020/010746 dated May 22, 2024 (2 pages).
"Rogue RML-490 Power Rack" Dec. 2013, Rogue Fitness, site visited Oct. 9, 2024:https://www.roguefitness.com/rogue-rml-490-power-rack (Year: 2013).
"Monster Lite Rig 2.0" Sep. 2016, Rogue Fitness, site visited Oct. 9, 2024:https://www.roguefitness.com/monster-lite-rig-2-0 (Year: 2016).

* cited by examiner

VERSATILE UNIVERSAL GYM

CROSS-REFERENCE TO RELATED APPLICATIONS

This application represents the National Phase under 35 U.S.C. § 371 of International Application No. PCT/US2018/057195, entitled, "VERSATILE UNIVERSAL GYM," and filed internationally on Oct. 24, 2018, which claims benefit of priority under PCT Chapter I, Article 8, and 35 U.S.C. § 119 (e) of U.S. Provisional Patent Application No. 62/656,126 entitled "VERSATILE UNIVERSAL GYM," filed on Apr. 11, 2018, and of U.S. Provisional Patent Application No. 62/679,828 entitled "VERSATILE UNIVERSAL GYM," filed on Jun. 3, 2018. The foregoing PCT/US2018/057195, 62/656,126, and 62/679,828 applications are incorporated herein by reference in their entireties.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to exercise equipment comprising at least one weight stack.

BACKGROUND OF THE INVENTION

Universal gyms, which contain stations for several exercises, are known. Also known are exercise machines designed to allow for a single or small number of exercises, such as a bicep curl machine or a rowing machine. A problem arises when an athlete or a weight gym proprietor wants to allow for a wide variety of exercises. That person must deploy numerous machines to occupy a relatively vast floor space in a home or gym to obtain those exercises.

Another problem arises with currently-known systems. Exercises must be performed within the design characteristics of the machine. A finite number of positions can accommodate only a certain range of adjustments. If an athlete is larger or smaller than the "average" person contemplated by the machine designer, or has special needs, that athlete may struggle to adjust existing equipment for optimal comfort and performance. A large athlete would need appropriately-sized equipment; but that equipment would be nearly useless for a petite athlete who might barely fit the equipment's smallest settings. An athlete confined to a wheel chair might not find that equipment useful at all.

Yet a further problem can arise with certain known exercise equipment. A single source of resistance such as a weight stack can provide the resistance against which an exercise is performed. However, if the plates of the weight stack have too large of a mass increment between them, an athlete might fail to optimize her repetitions to muscle fatigue because she must use either too light or too heavy a weight from the weight stack. Thus, it could be useful to apply a smaller mass increment than provided by the weight stack in some cases. Similarly, if the weight stack does not have enough mass, particularly strong athletes could not enjoy the maximum benefit from exercising on such a machine. Moreover, it can be desirable to alter the nature of the resistance by adding an elastic band to an exercise. As the exercise progresses through its range of motion, the resistance can change as an elastic band becomes stretched. Many known exercise machines do not accommodate a variety of sources for the resistance.

Finally, it is known that the human body can lift different weight with different exercises. A person usually can squat significantly more weight than that person can bench press; and the bench press weight usually dwarfs what that person can curl with their biceps. So far, exercise machine manufacturers have designed different machines for each of those exercises, or inadequately addressed all of those exercises in a single universal gym. As a result, the serious athlete would need multiple purpose-built machines to exercise optimally, requiring a gym with significant floor space.

SUMMARY OF THE INVENTION

Unexpectedly, and building upon decades of experience as a personal trainer, Applicant has invented a versatile universal gym. In some cases, Applicant's universal gym can occupy a remarkably-small footprint in a home or a gym, and yet provide for a vast, nearly infinite array of exercises. In further cases, Applicant's universal gym can further employ attractive and decorative panels that disguise the universal gym when not in use.

Accordingly, some embodiments of the present invention relate to an apparatus for exercising against a resistance, comprising:

- a frame, comprising a plurality of vertical members mutually supporting a plurality of horizontal members;
- the resistance comprising at least one weight stack contained by the frame;
- one or more cables routed about the frame via a plurality of pulleys selectively connecting the at least one weight stack to one or more exercise attachment points;
- at least one floating pulley removably and adjustably attached to the frame comprising at least one extension cable having a first end opposite a second end, the first end being attachable to the one or more exercise attachment points, and the second end providing at least one floating exercise attachment point;
- wherein at least some of the vertical members of the plurality of vertical members have first vertical accessory receiving ports having axes in a first direction, and second vertical accessory receiving ports having axes in a second direction.

In some cases, the accessory receiving ports can receive the floating pulley, thereby providing a wide variety of ways to engage the weight stack. Optionally, free weights, elastic bands, and the weight stack alone or in combination can provide the resistance for exercise.

Further embodiments relate to a floating pulley for an apparatus for exercising against a resistance, the floating pulley comprising:

- an extension cable having a first end opposite a second end, the first end being attachable to an exercise attachment point on the apparatus, and the second end providing a floating exercise attachment point; and
- an accessory engagement structure for removably and adjustably coupling to an accessory receiving port on the apparatus.

Still further embodiments relate to an exercise bench adapted for use with an apparatus for exercising against a resistance, the exercise bench comprising:

a bench frame comprising at least one horizontal bench member mutually supporting at least one vertical bench member;

a seat cushion supported by the bench frame; and one or more bench accessory receiving ports in the frame, the one or more bench accessory receiving ports being adapted to receive at least one floating pulley to provide at least one bench exercise attachment point.

Additional embodiments relate to methods of exercising against a resistance, one such method comprising:

obtaining an apparatus comprising:

a frame, comprising a plurality of vertical members mutually supporting a plurality of horizontal members;

the resistance comprising at least one weight stack contained by the frame;

one or more cables routed about the frame via a plurality of pulleys selectively connecting the at least one weight stack to one or more exercise attachment points;

at least one floating pulley removably and adjustably attached to the frame comprising at least one extension cable having a first end opposite a second end, the first end being attachable to the one or more exercise attachment points, and the second end providing at least one floating exercise attachment point;

wherein at least some of the vertical members of the plurality of vertical members have first vertical accessory receiving ports having axes in a first direction, and second vertical accessory receiving ports having axes in a second direction;

connecting at least one exercise engagement device to one or more exercise attachment points, the at least one floating exercise attachment point, or a combination thereof; and moving the at least one exercise engagement device against the resistance, thereby exercising against the resistance.

Still further embodiments of the present invention relate to methods of making the apparatuses described herein, one such method comprising: routing the one or more cables about the frame via the plurality of pulleys to selectively connect the at least one weight stack to the one or more exercise attachment points.

Yet additional embodiments relate to methods of making the floating pulleys as described herein, one such method comprising routing the extension cable through the floating pulley.

Other embodiments relate to a gliding extension device for an apparatus for exercising against a resistance, the gliding extension device comprising:

a roller carriage comprising a plurality of rollers adapted to glidingly engage a guide rod;

an extension frame extending from the roller carriage, the extension frame comprising a proximal end adjacent the roller carriage and a distal end;

an exercise engagement device at or near the distal end; and an exercise attachment point receiver attached to the roller carriage, the proximal end of the extension frame, or both.

Even further embodiments relate to an extension arm for an apparatus for exercising against a resistance, the extension arm comprising:

an angular selection bracket for attaching the extension arm to a frame of the apparatus, the angular selection bracket comprising a plurality of angle selection ports for establishing a plurality of extension angles;

an extension member extending from the angular selection bracket and comprising a plurality of extension receiving ports for providing one or more extension exercise attachment points;

wherein an extension angle in the plurality of extension angles is determined by a portion of a member of the frame and a portion of the extension member.

Still further embodiments provide a sit-up board for an apparatus for exercising against a resistance, the sit-up board comprising:

a padded board for supporting an athlete;

at least one longitudinal member supporting the padded board; and at least one lateral member supporting the padded board;

wherein the at least one longitudinal member, the at least one lateral member, or both, comprise a plurality of sit-up board accessory receiving ports.

Yet additional embodiments relate to a multivector extension device for an apparatus for exercising against a resistance, the multivector extension device comprising:

a brace for removably and adjustably attaching to a frame of the apparatus;

a multivector extension arm comprising a plurality of accessory receiving ports;

a ball joint joining the multivector extension arm to the brace while allowing the multivector extension arm significant freedom of movement relative to the brace;

at least one exercise engagement device removably attached to the multivector extension arm via a first accessory receiving port in the plurality of accessory receiving ports; and at least one exercise attachment point receiver removably attached to the multivector extension arm via a second accessory receiving port in the plurality of accessory receiving ports.

Certain embodiments provide multivector extension supports for an apparatus for exercising against a resistance, one such multivector extension support comprising a brace for removably and adjustably attaching to a frame of the apparatus; and a resilient support attached to the brace for receiving and protecting the frame from contact by a multivector extension device.

Still further embodiments relate to additional methods of exercising, one such method being a method of exercising against a plurality of resistances having multiple vectors, comprising:

obtaining a multivector extension device comprising:

a brace for removably and adjustably attaching to a frame of an apparatus;

a multivector extension arm comprising a first accessory receiving port, a second accessory receiving port, and a third accessory receiving port;

a ball joint joining the multivector extension arm to the brace while allowing the multivector extension arm significant freedom of movement relative to the brace;

a first exercise attachment point receiver removably attached to the multivector extension arm via the first accessory receiving port;

a second exercise attachment point receiver removably attached to the multivector extension arm via the second accessory receiving port; and an exercise engagement device removably attached to the multivector extension arm via the third accessory receiving port; and attaching a first resistance to the first exercise attachment point receiver;

attaching a second resistance to the second exercise attachment point receiver, wherein the first resistance has a first vector and the second resistance has a second vector, wherein the first vector differs from the second vector, and wherein the first vector and the second vector thereby form the plurality of resistances having multiple vectors; and moving the exercise engagement device against the plurality of resistances having multiple vectors, thereby exercising against a plurality of resistances having multiple vectors.

Still further embodiments provide mobile members for an apparatus for exercising against a resistance, one such mobile member comprising:

an elongate section having a first end opposite a second end;

a first frame engagement device, at the first end of the elongate section, for securing the mobile member to a first member of a frame of the apparatus; and a second frame engagement device, at the second end of the elongate section, for securing the mobile member to a second member of the frame.

Further embodiments relate to a foot stretching device for an apparatus for exercising against a resistance, the foot stretching device comprising:

a brace for removably and adjustably attaching to a frame of the apparatus;

an elongate sole portion attached to the brace by a brace hinge; and a heel portion attached to the sole portion by a heel hinge.

Further additional embodiments provide foot exercise attachments for an apparatus for exercising against a resistance, one such attachment comprising:

a scaffold for receiving a foot of an athlete;

one or more straps for securing the scaffold to the foot; and one or more exercise attachment point receivers for engaging a resistance to the scaffold.

Yet other embodiments relate to leg press accessories for an apparatus for exercising against a resistance, one such leg press accessory comprising:

an angular guide having an angular guide brace for removably and adjustably attaching to a horizontal member of a frame of the apparatus;

an extension member receiver anchored to the angular guide so that the extension member receiver can move in an arcuate manner within the angular guide;

the extension member receiver being adapted to receive an extension member having a foot pad held in place on the extension member with a foot pad brace comprising a spring-loaded pin for engaging the extension member.

Still other embodiments provide adjustable arcuate bases for an apparatus for exercising against a resistance, one such adjustable arcuate base comprising:

a stage comprising one or more retractable pins for engaging one or more accessory receiving ports on one or more vertical members of a frame of the apparatus;

an angular guide affixed to the stage;

an extension member receiver anchored to the angular guide so that the extension member receiver can move in an arcuate manner within the angular guide; the extension member receiver further comprising a spring-loaded pin; the extension member receiver being adapted to receive an extension member and secure the extension member with the spring-loaded pin.

Still further embodiments relate to angular telescopic extension devices for an apparatus for exercising against a resistance, one such angular telescopic extension device comprising:

an angular selection brace for selectively attaching the angular telescopic extension device to a frame of the apparatus, the angular selection brace comprising a retractable pin for engaging an accessory receiving port in the frame of the apparatus;

an angle selector comprising a plurality of angle selection ports attached to the angular selection brace;

an angular selection bracket connected to the angular selection brace by a hinge, the hinge defining an axis of rotation, and comprising an angle selecting retractable pin for engaging an angle selection port in the plurality of angle selection ports on the angle selector for establishing a telescopic extension angle;

a telescopic extension arm extending from the angular selection bracket and comprising two or more nested extension members each adapted to be secured at a chosen length with a spring-loaded pin, the two or more nested extension members comprising a plurality of extension receiving ports for providing one or more extension exercise attachment points;

wherein the telescopic angle is determined by a first imaginary line between the axis of rotation and a first angle selection port in the plurality of angle selection ports, on one hand, and a second imaginary line between the axis of rotation and a chosen angle selection port in the plurality of angle selection ports.

Further additional embodiments relate to portable weight stack assemblies for an apparatus for exercising against a resistance, one such portable weight stack assembly comprising:

a portable frame comprising one or more portable vertical members mutually supporting one or more portable horizontal members;

a portable weight stack contained by the portable frame;

one or more portable cables routed about the portable frame via a plurality of portable pulleys selectively connecting the portable weight stack to a slidably adjustable portable exercise attachment point; and at least one footer for stabilizing the frame.

Yet further additional embodiments provide frames for an apparatus for exercising against a resistance, comprising:

a plurality of vertical members mutually supporting a plurality of horizontal members, wherein the plurality of vertical members and the plurality of horizontal members define a rectangular footprint having an aspect ratio of about 1:4, about 2:9, about 1:5, about 3:10, about 1:3, or about 3:10.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
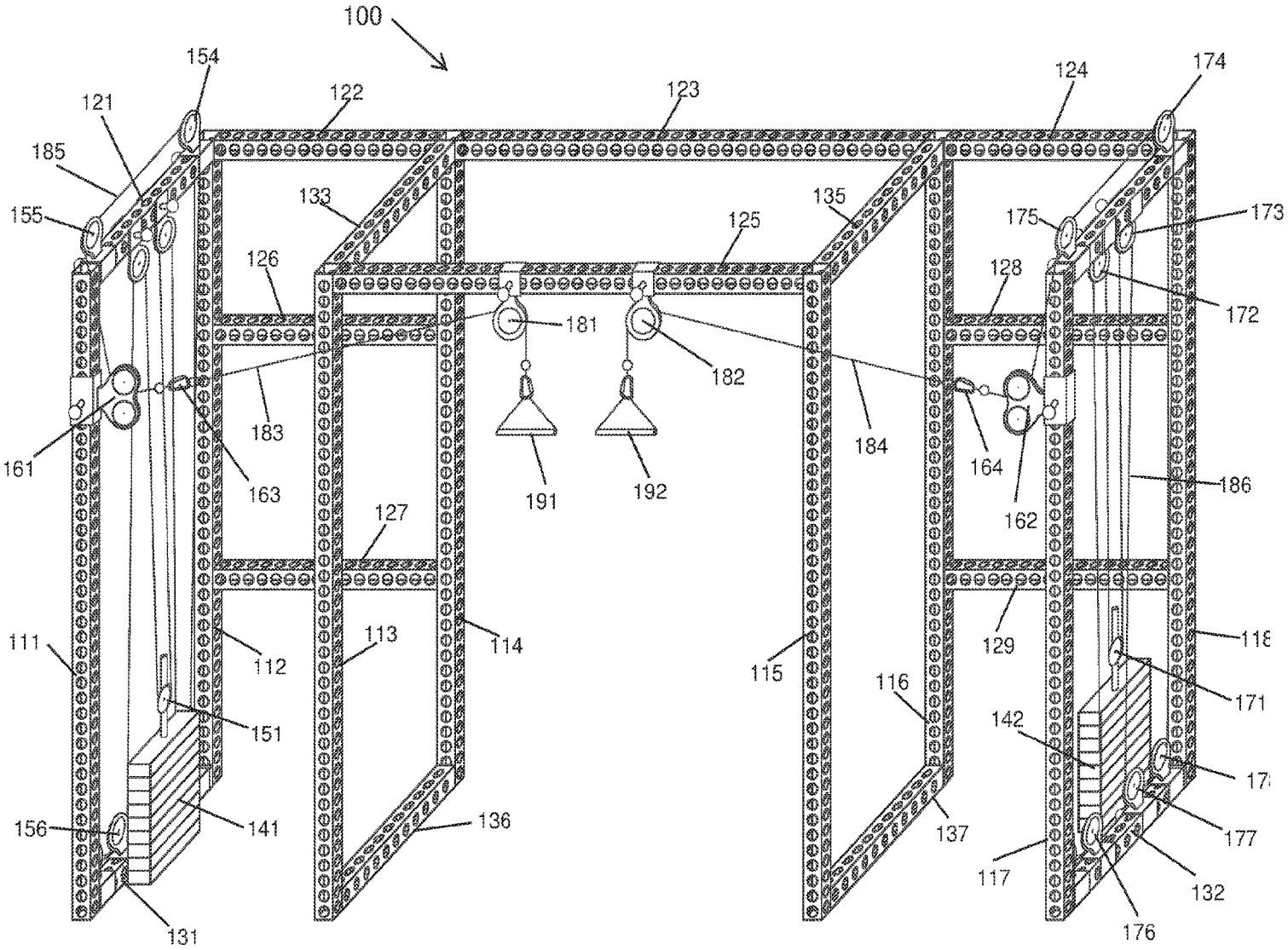
FIG. 1 depicts one embodiment of the invention, apparatus 100, in a perspective view.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

As stated above, some embodiments of the present invention relate to an apparatus for exercising against a resistance. As used herein, "exercising against a resistance" indicates movement of the human body or a part thereof against a force such as provided by gravity acting on a mass, friction, elastic deformation, or the like. The mass can be provided by the body of the athlete or a part thereof; or it can be provided by a selected portion of a weight stack or a free weight device such as a barbell, dumbbell, weight plate, kettle ball, or the like. Elastic bands provide resistance as the material of the band responds to, and opposes, an athlete's effort to elastically deform the band. Friction can provide resistance such as, for example, by applying a brake against a reciprocating or rotating device such as a flywheel.

At least one weight stack contained by the frame appears in several embodiments. In some cases, the resistance comprises two independent weight stacks contained by the frame. A weight stack has a number of plates, each of similar or different masses, and a device such as a rod with appropriately-placed holes so that a desired number of plates in the weight stack can be selected for a particular exercise. A pin or key, optionally tipped with a spring-loaded ball bearing, can connect the desired number of plates in the weight stack to the rod. At one end of the rod, a pulley can connect the rod and thereby the desired number of plates in the weight stack to a cable that when pulled, lifts the desired number of plates from the weight stack.

A cable routed about the frame selectively connects the weight stack to an exercise attachment point via one or more pulleys. Generally, the plates of the weight stack will move up and down when an exercise is performed; perfect verticality, however, is not required. The cable with the one or more pulleys translates the up and down motion of the plates from the weight stack into a suitable direction at the exercise attachment point. An exercise attachment point is a place where the cable terminates and allows for the attachment of an exercise engagement device. Any suitable exercise engagement device can be used, such as, for example, a hand grip, an ankle strap, a torso strap, a head strap, a barbell, a dumbbell, or the like, or a multivector extension device as described herein. As used herein, a barbell means a device generally intended for a two-handed grip; a dumbbell is a device generally intended for a one-handed grip. Optionally, a barbell or a dumbbell can receive additional mass in the form of weight plates, and optionally may have one or more elastic band attachment points. Thus, in some cases, a barbell or a dumbbell can engage the weight stack through an exercise attachment point, a floating exercise attachment point (see below), optionally receive one or more weight plates, and optionally engage one or more elastic bands, thereby providing a highly-selective and variable resistance to the athlete. As can be appreciated, weights such as provided by the weight stack or free weight plates, impart a steady resistance, while an elastic band generally provides less resistance when the band is slightly stretched, yet increases resistance as the stretching increases.

At least one floating pulley is removably and adjustably attached to the frame. In some cases, a floating pulley can be removably and adjustably attached to the frame by coupling to one or more of the first vertical accessory receiving ports, one or more of the second vertical accessory receiving ports, or a combination thereof. In other cases, a floating pulley can be removably and adjustably attached to the frame by coupling to one or more of the first horizontal accessory receiving ports, one or more of the second horizontal accessory receiving ports, or a combination thereof. The floating pulley is removable, as it can be completely detached from the apparatus, usually without the need for any special tool. The floating pulley is adjustable, in that it can be securely attached to the frame via any of the several accessory receiving ports. The floating pulley has an extension cable having a first end opposite a second end. One of the two ends can be attached to an exercise attachment point, and the other end provides a floating exercise attachment point, to which any suitable exercise engagement device can attach. Accordingly, the floating pulley can be placed in any suitable accessory receiving port in the frame, and then one end of the extension cable is attached to the cable of the frame connected to the weight stack. Then the exercise attachment point on the frame can be moved so that there is no slack in the several cables. A floating pulley can have any suitable number of pulley wheels. For example, a floating pulley can have a single pulley wheel. For another example, the floating pulley can have two pulley wheels, and the extension cable passes between the two pulley wheels.

The cable connecting the weight stack can be routed about the frame in any suitable manner. The cable can run along the outside of the frame, in some cases. In other cases, the cable can be routed inside the frame for at least a portion of its course. The cables, including extension cables, useful according to the present invention can be any suitable cable. In some cases, a multi-wire woven or twisted steel cable coated with a suitable flexible polymer can be used. Often, the ends of such cables terminate in a loop optionally reinforced with a metal eyelet. In further instances, just before the end of the terminus of a cable can appear a pulley stop such as a small spherical rubber stopper. The pulley stop is designed to prevent the terminus of the cable from unintentionally exiting the exercise attachment point or the floating pulley, as the case may be.

The apparatus comprises a frame having vertical members and horizontal members. Any suitable numbers of vertical members and horizontal members can be used. The vertical members and horizontal members can be made out of any suitable material, such as, for example, steel, aluminum, structural polymers, and combinations thereof. In some instances, the frame comprises tubes. The tubes can have any suitable cross section, such as, for example, round, oval, polygonal, rectangular, or square. At least some of the vertical members of the frame have first vertical accessory receiving ports having axes in a first direction, and second vertical accessory receiving ports having axes in a second direction. Having an axis in a certain direction means that an accessory receiving port can receive and secure a rod-like structure. This is useful for securing an exercise attachment point, for example. For another example, a bar can enter an accessory receiving port and thereby support an exercise against the bar: an athlete can execute a pull-up or a dip using the bar, or an elastic band can be secured by the bar. The accessory receiving port can have any suitable shape, such as, for example, circular, oval, square, or polygonal. In some cases, an accessory receiving port comprises two openings in a tube that makes up the frame. The rod-like structure enters a first opening in a facing surface of the tube, and proceeds through the tube to exit the second opening in the opposite surface of the tube. In this way, the two openings provide ample support to the rod like structure.

It can be noticed by one of ordinary skill in the art that vertical members need not be strictly vertical, and that horizontal members need not be strictly horizontal. Any suitable member can be included, such as, for example, a member that curves, a member that adheres to an angle other than strictly vertical or strictly horizontal, and combinations thereof. A vertical member is a member that has a vertical aspect; a horizontal member is a member that has a horizontal aspect. Discerning between vertical members and horizontal members can be accomplished by any suitable method. For example, members having a greater angle with respect to the horizontal can be considered vertical members, when there are members having a lesser angle with respect to the horizontal. A frame constructed of members all positioned at 45 degrees relative to the horizontal can be said to comprise vertical members.

In certain embodiments, at least some of the horizontal members of the plurality of horizontal members have first horizontal accessory receiving ports having axes in the first direction, and second horizontal accessory receiving ports having axes in a third direction. In some cases, the first direction is "front-to-back," and the second direction is "left-to-right." Both of those directions can be parallel to the horizontal. In further cases, the third direction can be "up-and-down." Thus, the first direction, second direction, and third direction can all be perpendicular to each other; this need not be the case in every situation. The several directions can orient in any suitable manner relative to each other, and relative to the horizontal and the vertical.

The apparatus of several embodiments of the present invention comprises one or more exercise attachment points. In some cases, an exercise attachment point comprises one or two pulleys and the terminus of a cable. Pulling on the terminus of the cable moves the desired number of plates on the weight stack. The exercise attachment point can be slidably adjustable along one of the vertical members or one of the horizontal members of the frame. Slidably adjustable means that exercise attachment point can be moved along the member, and then secured at a specific point on the member. Securing the exercise attachment point can be achieved through any suitable means. For example, a spring-loaded pin or rod-like structure on the exercise attachment point can engage an accessory receiving port, thereby securing the exercise attachment point at that accessory receiving port. Optionally, the exercise attachment point can be removed from the frame and re-attached to a different member; in other cases, the exercise attachment point can only slide along a single member without the use of tools to reconfigure the apparatus. In some cases, a vertical member has a vertical length, and comprises first vertical accessory receiving ports and second vertical accessory receiving ports for substantially the entire vertical length. In further cases, a horizontal member has a horizontal length, and comprises first horizontal accessory receiving ports and second horizontal accessory receiving ports for substantially the entire horizontal length. Having accessory receiving ports substantially the entire length means at least more than 50%, more than 60%, more than 70%, more than 80%, or more than 90% of the length.

In some instances of the present invention, one or more doors can be attached to the frame. Optionally, at least one door pivotally mounted on at least one vertical member in the plurality of vertical members of the frame. Certain instances provide two doors, each attached to the outside vertical members and closing at the middle of the apparatus. A door can have any suitable structure. For example, a door may comprise at least one door vertical member mutually supporting at least one door horizontal member; and the at least one door vertical member may comprise first door vertical accessory receiving ports having axes in a fourth direction, and second door vertical accessory receiving ports in a fifth direction. Similarly, for example, a door may comprise at least one door horizontal member having first door horizontal accessory receiving ports having axes in the fourth direction, and second door horizontal accessory receiving ports having axes in a sixth direction. The fourth, fifth, and sixth directions can be any suitable directions. For example, any of them can align with any one or more of the first, second, and third directions. In some cases, the fourth direction is substantially perpendicular to the fifth direction. In other cases, the fourth direction and the fifth direction are substantially parallel to the horizontal. In still further cases, the sixth direction is substantially normal to the horizontal. The door members can have any suitable cross section. In some examples, the at least one door vertical member comprises square tubing. In further examples, the at least one door horizontal member comprises square tubing.

Certain additional embodiments of the present invention provide one or more decorative panels to disguise the apparatus when it is not in use or for other purposes. Some of those embodiments relate to at least one decorative panel mounted to the frame. Further of those embodiments provide at least one decorative panel mounted to a door. Any suitable means can be used to mount the panel to the apparatus. For example, a decorative panel can be mounted using at least one hollow-headed bolt, the hollow-headed bolt comprising a head and a threaded shaft, the head comprising an axial recess for receiving and retaining a panel-mounting rivet. The bolt attaches to the frame, for example, and the axial recess secures the rivet which holds the panel in place.

Further embodiments of the present invention relate to a door having an exercise attachment point, a floating exercise attachment point, or a combination thereof. This can be achieved by any suitable method. An exercise attachment point or a floating exercise attachment point comprising a pulley can be relocated to one or more of the door members, for example, by engaging any of the door accessory receiving ports. Accordingly, in some instances, a floating pulley can be removably and adjustably attached to the frame by coupling to one or more of the first door vertical accessory receiving ports, one or more of the second door vertical accessory receiving ports, or a combination thereof. In other instances, the floating pulley can be removably and adjustably attached to the frame by coupling to one or more of the first door horizontal accessory receiving ports, one or more of the second door horizontal accessory receiving ports, or a combination thereof.

Any suitable exercise equipment or accommodations therefor can be used in accordance with the present invention. To assist in the use of free weights and in particular barbells, additional embodiments include at least one power rack for receiving at least one barbell and allowing the performance of at least one exercise with the at least one barbell. Certain instances provide a Smith machine for receiving the barbell and allowing the performance of at least one exercise with the barbell using the Smith machine. Further instances allow for a dip bar, optionally installed to a door of the frame. Additional instances allow for a sit-up board, optionally installed to a door of the frame. Still further instances allow for a multi-use support pad that can be positioned at various angles and heights. Such a multi-use support pad can be used for back extensions and supported bicep curls at a relatively high height and high angle relative to the horizontal, and for sit-ups and crunches at a relatively low height and angle relative to the horizontal. As used herein, a multi-use support pad is mounted on a multi-use exerciser, which comprises a longitudinal member that has ankle braces that can be adjusted as to position along the longitudinal member. The multi-use exerciser can attach to an angle selector at the frame, which angle selector positions the longitudinal member at various angles, and places the multi-use pad at various heights for different exercises. The multi-use pad itself can adopt various tilt angles relative to the longitudinal member. Appropriately-positioned exercise attachment points and floating pulleys can, in some cases, allow access to the weight stack for such exercises, or free weights can be used. Optionally, any attachment can be constructed for convenient stowage within the apparatus when either the attachment or the apparatus are not in use.

Still further embodiments allow for the installation of a flat panel television, sound system, media player, and the like. Such components can be used for instructional videos or audio programs, exercise-motivating programs such as music playlists, or purely entertaining programing such as sports broadcasts and movies to be enjoyed during a workout. A media player can be any suitable device, such as, for example, a personal computer, a smart phone, a DVD video player, a BlueRay® video player, an MP3 player, an MP4 player, or a combination thereof.

As stated above, the resistance can be provided by any suitable means. Accordingly, some instances of the present invention provide an apparatus having at least one elastic band attachment point to provide or augment the resistance. The elastic band can loop around any suitable appendage of the frame, for example, and then loop around any suitable object moved by the athlete during exercise. Suitable objects includes barbells, dumbbells, and parts of the athlete's body such as wrists, waist, and ankles. Similarly, the resistance can be provided by free weights, for example. A barbell or a dumbbell having a suitable connectors such as, for example, a hook or carabiner, can attach to an exercise attachment point or a floating exercise attachment point. Thus, in further instances of the present invention, the resistance can be selectively provided by the at least one weight stack, at least one free weight device, at least one elastic band, the weight of the person exercising with the apparatus, or a combination thereof.

Yet additional embodiments relate to methods of exercising against a resistance. The athlete obtains any of the apparatuses disclosed herein, in some such methods, and connects at least one exercise engagement device to one or more exercise attachment points, the at least one floating exercise attachment point, or a combination thereof; and moves the at least one exercise engagement device against the resistance, thereby exercising against the resistance.

Still other embodiments relate to methods of making any of the apparatuses disclosed herein. Some of those embodiments include routing the one or more cables about the frame via the plurality of pulleys to selectively connect the at least one weight stack to the one or more exercise attachment points. Similarly, further embodiments relate to any of the floating pulleys disclosed herein, comprising routing the extension cable through the floating pulley. Optionally, once the cable or extension cable is properly routed, a pulley stop can be added to an end of the cable, which is then secured in a loop formation optionally with a metal eyelet.

Still further embodiments relate to an exercise bench that can be used with any of the apparatuses disclosed herein. An advantage arises in some cases from attaching a floating pulley to the bench, thereby allowing an athlete to exercise using the weight stack(s) of the apparatus. The floating pulley can attach to one or more bench accessory receiving ports in the frame. Certain examples of the exercise bench include a back cushion supported by the frame and capable of adopting an incline angle. Any suitable incline angle, including a negative incline angle relative to the horizontal, can be made available by the back cushion. In some cases, the incline angle ranges from −80 degrees to 120 degrees, relative to the horizontal. Such a broad range of possible incline angles allows for a wide variety of body positions for the athlete. In other cases, the incline angle ranges from zero degrees to 60 degrees relative to the horizontal.

It can be a problem in certain exercise benches that the device supporting the back cushion can pop out, causing the back cushion to come crashing down and potentially injuring the athlete. Accordingly, further embodiments of the present invention provide an exercise bench comprising an incline angle selection device comprising:

- a back cushion brace engaging the back cushion;
- a plurality of incline angle selection slots for receiving the back cushion brace and establishing the incline angle with the back cushion brace; and
- a brace guard for preventing the back cushion brace from departing from the incline angle selection device.

The apparatuses, frames, devices, and components thereof of the present invention can be made from any suitable material. For example, steel, aluminum, structural polymers such as high-density polyalkanes, polyurethanes, nylons, perfluorinated polyalkanes such as Teflon®, and combinations thereof can be mentioned.

Further instances of the present invention relate to a gliding extension device for an apparatus for exercising against a resistance, the gliding extension device comprising: a roller carriage comprising a plurality of rollers adapted to glidingly engage a guide rod; an extension frame extending from the roller carriage, the extension frame comprising a proximal end adjacent the roller carriage and a distal end; an exercise engagement device at or near the distal end; and an exercise attachment point receiver attached to the roller carriage, the proximal end of the extension frame, or both. As used herein, a gliding extension device is intended to provide smooth and guided movement along a guide rod; that guided movement is against a resistance in the manner of a Smith machine. A gliding extension device of the present invention can be operated with one hand, for example with a single hand grip. Or, a two-handed bar can be used. Optionally, the two-handed bar can connect two gliding extension devices, allowing for example, two separate weight stacks to be engaged.

Optionally, a gliding extension device can comprise a brake mechanism for the safety and convenience of the athlete. A brake mechanism allows the gliding extension device to maintain its position relative to the guide rod in spite of any resistance on the gliding extension device. Any suitable brake mechanism can be used. In some instances, the brake mechanism comprises a brake lever at the exercise engagement device, and a braking clamp at the roller carriage for arresting at least one roller among the plurality of rollers, the guide rod, or both, the brake lever adapted to disengage the braking clamp when the brake lever is manipulated.

Any suitable resistance can be used with a gliding extension device. The device can have one or more exercise attachment point receivers, which can receive a carabiner or other mechanism for connecting resistance to the gliding extension device. An exercise attachment point receiver can be an eye bolt for selectively connecting a weight stack via a cable, or it can be a J-hook for receiving an elastic band. In some cases, an extension frame further comprises a plurality of extension receiving ports for providing one or more extension exercise attachment points.

A guide rod can have any suitable orientation. For example, a guide rod can be vertical, and the gliding extension device can provide a Smith machine-like experience for squat exercises. For another example, a guide rod can be horizontal, and the gliding extension device can function as a rowing exercise device. In addition, a guide rod can be straight, curved, or a combination thereof.

Further instances of the present invention relate to an extension arm for an apparatus for exercising against a resistance, the extension arm comprising: an angular selection bracket for attaching the extension arm to a frame of the apparatus, the angular selection bracket comprising a plurality of angle selection ports for establishing a plurality of extension angles; an extension member extending from the angular selection bracket and comprising a plurality of extension receiving ports for providing one or more extension exercise attachment points; wherein an extension angle in the plurality of extension angles is determined by a portion of a member of the frame and a portion of the extension member. So, for example, a vertical member indicates one side of the angle, and the extension member establishes another side of the angle. The extension arm can be adapted to receive one or more floating pulleys capable of selectively connecting at least one weight stack to establish one or more extension exercise attachment points.

Certain instances provide an innovative sit up board that can receive a floating pulley for a great variety of exercise options. In one instance, a sit-up board comprises a padded board for supporting an athlete; at least one longitudinal member supporting the padded board; and at least one lateral member supporting the padded board; wherein the at least one longitudinal member, the at least one lateral member, or both, comprise a plurality of sit-up board accessory receiving ports. The sit-up board accessory receiving ports can receive a floating pulley as described herein. Optionally, the sit-up board also comprises two foot braces that the athlete can use to stabilize while using the sit-up board. One or more handgrips also can appear.

A sit-up board can attach to the frame of an apparatus by any suitable means. For example, one or more pins on the sit-up board can engage accessory receiving ports of a frame of the apparatus. Optionally, one or more footers can stabilize the sit-up board.

Unexpectedly, applicant has invented devices and methods for exercising against a plurality of resistances that have different vectors or directions. For example, gravity can pull a free weight in a downward direction, and an athlete can lift that weight upward against gravity. Now suppose an elastic band under tension is applied to the motion of the athlete, and the elastic band is oriented in a direction other than downward, that is, parallel to or in concert with gravity. An elastic band pulling horizontally, or in any direction other than vertically, would force the athlete lifting the weight vertically to use a larger variety of muscles that might not be engaged if the athlete were only lifting the weight. This multivector resistance exercise can be extraordinarily beneficial. For example, joints such as the shoulders, knees, ankles, elbows, and wrists can be strengthened by having the athlete exercise against two or more resistances having different vectors. Significantly, the apparatuses of the present invention provide the opportunity for a wide variety of vectoral combinations for resistance exercise.

Accordingly, in some cases, a multivector extension device for an apparatus for exercising against a resistance comprises a brace for removably and adjustably attaching to a frame of the apparatus; a multivector extension arm comprising a plurality of accessory receiving ports; a ball joint joining the multivector extension arm to the brace while allowing the multivector extension arm significant freedom of movement relative to the brace; at least one exercise engagement device removably attached to the multivector extension arm via a first accessory receiving port in the plurality of accessory receiving ports; and at least one exercise attachment point receiver removably attached to the multivector extension arm via a second accessory receiving port in the plurality of accessory receiving ports.

Any suitable brace can be used. For example, the brace may comprise a spring-loaded pin manipulated by a knob for engaging the frame of the apparatus. Further, the materials of the multivector extension device are not limited. For example, the multivector extension arm can comprise square tubing made from any suitable material such as, for example, steel, aluminum, polymer, and combinations thereof. Any suitable exercise engagement device can be used with a multivector extension device, such as, for example a single hand grip, a two-handed bar, an ankle strap, a torso strap, a head strap, or the like.

Similarly, any suitable exercise attachment point receivers can be used, such as, for example, a J-hook for receiving elastic band, an eye bolt for receiving a carabiner for selectively connecting to a weight stack, and combinations thereof. Exercise attachment point receivers and exercise engagement devices can attach to the multivector extension device in any suitable manner. In some cases, an exercise attachment point receiver or an exercise engagement device can include a spring-loaded pin that selectively secures the receiver or the device to the multivector extension device.

Sometimes, the multivector extension arm comprises at least two telescoping members, and the plurality of accessory receiving ports comprises a plurality of telescoping member accessory receiving ports. The telescoping members can be nested, that is, wherein one member fits inside the other. In such a case, it is possible that one of the at least two telescoping members is selectively secured to the multivector extension arm with at least one spring-loaded pin. When telescoping members are present, an exercise engagement device such as a single hand grip can be removably attached to the multivector extension arm via a third accessory receiving port in the plurality of telescoping member accessory receiving ports. Similarly, an exercise attachment point receiver such as a J-hook or an eye bolt can be removably attached to the multivector extension arm via a fourth accessory receiving port in the plurality of telescoping member accessory receiving ports.

Further instances of the present invention provide structure so that the multivector extension device or some part of it does not bang against the frame of the apparatus. For example, in some cases, the brace of the multivector extension device comprises a support cone positioned about the ball joint to protect the frame from contact by the multivector extension arm. The support cone can be made of any suitable material, such as, for example, natural rubber, synthetic rubber, polyurethane, silicone, or a combination thereof.

In a similar manner, a multivector extension support can also prevent a multi-vector extension device or another piece of equipment from contacting the frame of the apparatus. A multivector extension support can include a brace for removably and adjustably attaching to a frame of the apparatus; and a resilient support attached to the brace for receiving and protecting the frame from contact by a multivector extension device. In some cases, the brace comprises a spring-loaded pin for engaging the frame of the apparatus. In further cases, the resilient support defines a recess for receiving the multivector extension device. Such a recess can receive a multi-vector extension device or similar piece of equipment when it is not in motion. Any suitable material can be used for the resilient support. Certain instances provide a resilient support comprising natural rubber, synthetic rubber, polyurethane, silicone, or a combination thereof.

Methods of exercising against a plurality of resistances having multiple vectors also appear in some embodiments of the present invention. Employing the multivector extension devices as described herein, one such method includes attaching a first resistance to the first exercise attachment point receiver; attaching a second resistance to the second exercise attachment point receiver, wherein the first resistance has a first vector and the second resistance has a second vector, wherein the first vector differs from the second vector, and wherein the first vector and the second vector thereby form the plurality of resistances having multiple vectors; and moving the exercise engagement device against the plurality of resistances having multiple vectors, thereby exercising against a plurality of resistances having multiple vectors.

Resistances can be arranged so that the directions of the several vectors orient in any suitable combination. In some cases, vectors or components thereof align or oppose each other. Also, it should be noted that the relative orientations of vectors may change as an exercise motion is performed. Two vectors initially at right angles to each other will not necessarily form a right angle throughout the entire motion of the exercise. This change in relative orientation can be advantageous, increasing or decreasing the overall resistance at different places in the exercise motion. The direction of an exercise motion, moreover, can align with or against one or more vectors of the plurality of resistances applied; or the direction of an exercise motion need not align with any vector of resistance. Of course, care should be taken so that the multiple resistances do not unduly stress or injure the athlete. Initially, small resistances are recommended.

Greater versatility is afforded by the use of various mobile members to add structure to the frame in a facile manner. Some instances of the present invention provide a mobile member for an apparatus for exercising against a resistance, the mobile member comprising: an elongate section having a first end opposite a second end; a first frame engagement device, at the first end of the elongate section, for securing the mobile member to a first member of a frame of the apparatus; and a second frame engagement device, at the second end of the elongate section, for securing the mobile member to a second member of the frame. If it is desired that the mobile member provides exercise attachment points, then in certain instances the elongate section comprises square tubing. In certain of those cases, the mobile member comprises between the first end and the second end, first mobile accessory receiving ports having axes in a first mobile direction, and second mobile accessory receiving ports having axes in a second mobile direction.

Alternatively, a mobile member can be designed to support contact with part of the human body. For example, the elongate section may comprise a foamed polymer, a cushion, or a combination thereof. Any suitable foamed polymer can be used. In certain instances, the foamed polymer is chosen from latex foam rubber, polyurethane foam, styrene-butadiene foam, or a combination thereof.

A mobile member can be secured to the frame of an apparatus by any suitable structure. In one example, the first frame engagement device comprises a first rod having a first port for receiving a first retention key, the first rod being adapted to enter a first accessory receiving port of the first member of the frame. In another example, the second frame engagement device comprises a second rod optionally having a second port for receiving a second retention key, the second rod being adapted to enter a second accessory receiving port of the second member of the frame. The idea behind such structure is to allow the first rod to be inserted into a first accessory receiving port on one member, and then aligning the second rod with a second accessory receiving port on another member. When the second rod is inserted into the second accessory receiving port, the first retention key is inserted into the first port to secure the mobile member in the installed position. This is aided in some cases in which the first rod is longer than the second rod. In other cases, the second rod is longer than the first rod.

Still further embodiments relate to a foot stretching device comprising: a brace for removably and adjustably attaching to a frame of the apparatus; an elongate sole portion attached to the brace by a brace hinge; and a heel portion attached to the sole portion by a heel hinge. The foot stretching device can be secured to the frame of the apparatus by any suitable structure. For example, the brace may comprise a spring-loaded pin for engaging the frame of the apparatus.

A foot stretching device can include any suitable materials. For example, in some cases the heel portion comprises a non-stick surface. Broadly, in certain cases the foot stretching device comprises steel or aluminum or a combination thereof.

Further embodiments provide for a foot exercise attachment comprising: a scaffold for receiving a foot of an athlete; one or more straps for securing the scaffold to the foot; and one or more exercise attachment point receivers for engaging a resistance to the scaffold. Any suitable materials can be used. For example, in some cases, the scaffold comprises steel, aluminum, or a combination thereof. Similarly, the straps may comprise hook-and-loop fabric (Velcro®), snaps, buttons, buckles, or a combination thereof. The scaffold may comprise a toe portion for engaging the top of the toes of the foot, optionally when the foot is wearing a shoe.

Still further embodiments relate to a leg press accessory for an apparatus for exercising against a resistance, the leg press accessory comprising: an angular guide having an angular guide brace for removably and adjustably attaching to a horizontal member of a frame of the apparatus; an extension member receiver anchored to the angular guide so that the extension member receiver can move in an arcuate manner within the angular guide; the extension member receiver being adapted to receive an extension member having a foot pad held in place on the extension member with a foot pad brace comprising a spring-loaded pin for engaging the extension member. To accommodate the foot pad brace, in some cases, the extension member comprises a plurality of extension receiving ports for providing one or more extension exercise attachment points. To accommodate the athlete, further cases allow the horizontal member of the frame to receive a bench having one or more bench braces for engaging the horizontal member, the one or more bench braces comprising one or more spring-loaded pins for engaging the horizontal member.

Shoulder presses and calf raises can be accommodated in certain embodiments of the present invention by an adjustable arcuate base comprising: a stage comprising one or more retractable pins for engaging one or more accessory receiving ports on one or more vertical members of a frame of the apparatus; an angular guide affixed to the stage; an extension member receiver anchored to the angular guide so that the extension member receiver can move in an arcuate manner within the angular guide; the extension member receiver further comprising a spring-loaded pin; the extension member receiver being adapted to receive an extension member and secure the extension member with the spring-loaded pin. In some cases, the one or more retractable pins comprises two spring-loaded pins. In further cases, the extension member comprises a plurality of extension receiving ports for providing one or more exercise engagement devices and/or one or more exercise attachment point receivers.

Even more versatility can be obtained from an apparatus according to the present invention with the use of an angular telescopic extension device. In some cases, the angular telescopic extension device comprises: an angular selection brace for selectively attaching the angular telescopic extension device to a frame of the apparatus, the angular selection brace comprising a retractable pin for engaging an accessory receiving port in the frame of the apparatus; an angle selector comprising a plurality of angle selection ports attached to the angular selection brace; an angular selection bracket connected to the angular selection brace by a hinge, the hinge defining an axis of rotation, and comprising an angle selecting retractable pin for engaging an angle selection port in the plurality of angle selection ports on the angle selector for establishing a telescopic extension angle; a telescopic extension arm extending from the angular selection bracket and comprising two or more nested extension members each adapted to be secured at a chosen length with a spring-loaded pin, the two or more nested extension members comprising a plurality of extension receiving ports for providing one or more extension exercise attachment points; wherein the telescopic angle is determined by a first imaginary line between the axis of rotation and a first angle selection port in the plurality of angle selection ports, on one hand, and a second imaginary line between the axis of rotation and a chosen angle selection port in the plurality of angle selection ports.

Certain instances provide that the angular telescopic extension device fits onto a vertical member of the frame of the apparatus. In further instances, the angle selecting retractable pin comprises a spring-loaded pin. Any suitable number of nested extension members can be used, such as, for example, two nested extension members, three nested extension members, or four nested extension members.

It can be helpful in many cases to have a relatively light weight portable weight stack assembly to use with the apparatuses of the present invention. A portable weight stack assembly can add additional weight and optionally an additional vector to an exercise. In certain instances, a portable weight stack assembly comprises: a portable frame comprising one or more portable vertical members mutually supporting one or more portable horizontal members; a portable weight stack contained by the portable frame; one or more portable cables routed about the portable frame via a plurality of portable pulleys selectively connecting the portable weight stack to a slidably adjustable portable exercise attachment point; and at least one footer for stabilizing the frame.

If an athlete or two are to maneuver a portable weight stack assembly, the total weight cannot be excessive in some cases. Accordingly, in some instances, the portable weight stack assembly weighs no more than about 200 lbs, no more than about 150 lbs., no more than about 100 lbs., no more than about 75 lbs., or no more than about 50 lbs. In further instances, the portable weight stack assembly weighs at least about 50 lbs., at least about 75 lbs., at least about 100 lbs., at least about 150 lbs., or at least about 200 lbs.

To accommodate different configurations for a variety of exercises, additional instances provide that at least one of the one or more portable vertical members comprises first portable vertical accessory receiving ports having an axis in a first portable direction, and second portable vertical accessory receiving ports having an axis in a second portable direction. Similarly, further instances provide that at least one of the one or more portable horizontal members comprises first portable horizontal accessory receiving ports having an axis in the first portable direction, and second portable horizontal accessory receiving ports having an axis in a third portable direction.

Unexpectedly, certain apparatuses of the present invention provide for an exceptionally high density of exercises. This high density potentially obviates the need for numerous space-consuming pieces of equipment in a gym. In several cases, the high density is provided by certain unique properties of some of the frames of the present invention. Accordingly, some embodiments provide a frame comprising: a plurality of vertical members mutually supporting a plurality of horizontal members, wherein the plurality of vertical members and the plurality of horizontal members define a rectangular footprint having an aspect ratio of about 1:4, about 2:9, about 1:5, about 3:10, about 1:3, or about 3:10. As used herein, "aspect ratio" refers to the depth of the apparatus versus the width. Other embodiments provide that the aspect ratio is at least about 1:4, at least about 2:9, at least about 1:5, at least about 3:10, at least about 1:3, or at least about 3:10. Still further embodiments provide that the aspect ratio is no more than about 1:4, no more than about 2:9, no more than about 1:5, no more than about 3:10, no more than about 1:3, or no more than about 3:10.

A frame can have any suitable dimensions. For example, in some cases, the frame has a depth of at least about 1 foot, at least about 2 feet, at least about 3 feet, at least about 4 feet, at least about 5 feet, or at least about 6 feet. In further cases, the frame has a depth of no more than about 1 foot, no more than about 2 feet, no more than about 3 feet, no more than about 4 feet, no more than about 5 feet, or no more than about 6 feet. Similarly, further instances provide the frame with a width at least about 3 feet, at least about 4 feet, at least about 5 feet, at least about 6 feet, at least about 7 feet, at least about 8 feet, at least about 9 feet, at least about 10 feet, at least about 11 feet, at least about 12 feet, at least about 13 feet, at least about 14 feet, or at least about 15 feet. In additional instances, the frame has a width of no more than about 3 feet, no more than about 4 feet, no more than about 5 feet, at least about 6 feet, no more than about 7 feet, no more than about 8 feet, no more than about 9 feet, no more than about 10 feet, no more than about 11 feet, no more than about 12 feet, no more than about 13 feet, no more than about 14 feet, or no more than about 15 feet.

Yet additional instances provide the frame having a height of at least about 4 feet, at least about 5 feet, at least about 6 feet, at least about 7 feet, at least about 8 feet, at least about 9 feet, at least about 10 feet, at least about 11 feet, or at least about 12 feet. Still further instances relate to the frame having a height of at least about 4 feet, at least about 5 feet, at least about 6 feet, at least about 7 feet, at least about 8 feet, at least about 9 feet, at least about 10 feet, at least about 11 feet, or at least about 12 feet.

To accommodate additional configurations, in some cases, at least some of the vertical members of the plurality of vertical members of the frame have first vertical accessory receiving ports having axes in a first direction, and second vertical accessory receiving ports having axes in a second direction. In further cases, at least some of the horizontal members of the plurality of horizontal members have first horizontal accessory receiving ports having axes in the first direction, and second horizontal accessory receiving ports having axes in a third direction.

Any suitable tubes or rods can be used to construct the frame of an apparatus. In some cases, the frame comprises square tubing, circular tubing, hexagonal tubing, or a combination thereof.

DETAILED DESCRIPTION OF THE DRAWINGS

Further embodiments of the present invention can be described by reference to the accompanying drawings.

FIG. 1 depicts one embodiment of the invention, apparatus 100. Apparatus 100 has a frame comprising a plurality of vertical members 111, 112, 113, 114, 115, 116, 117, and 118 mutually supporting a plurality of horizontal members 121, 122, 123, 124, 125, 126, 127, 128, 129, 131, 132, 136, and 137. Additional vertical members and/or horizontal members can be added as desired. The frame of apparatus 100 contains weight stack 141, and weight stack 142. Cable 185 is routed about the frame via a plurality of pulleys 151, 154, 155, 156 (and others not labeled) to selectively connect weight stack 141 to exercise attachment point 161. Cable 186 is routed about the frame via a plurality of pulleys 171, 172, 173, 174, 175, 176, 177, 178, (and another not labeled) to selectively connect weight stack 142 to exercise attachment point 162. Exercise attachment point 161 is slidably adjustable along vertical member 111. Exercise attachment point 162 is slidably adjustable along vertical member 117. Floating pulley 181 is removably and adjustably attached to the frame at horizontal member 125. Extension cable 183 attaches at a first end to exercise point 161 via carabiner 163, and at a second end to hand grip 191 to provide a floating exercise attachment point. Floating pulley 182 is removably and adjustably attached to the frame at horizontal member 125. Extension cable 184 attaches at a first end to exercise point 162 via carabiner 164, and at a second end to hand grip 192 to provide a floating exercise attachment point. Apparatus 100 has numerous accessory receiving ports (unlabeled) further explained in the following figures. Decorative panels (not shown) can be mounted in any suitable configuration, including but not limited to: between vertical members 111 and 112; between vertical members 117 and 118, and between vertical members 112 and 118.

Figure 2:
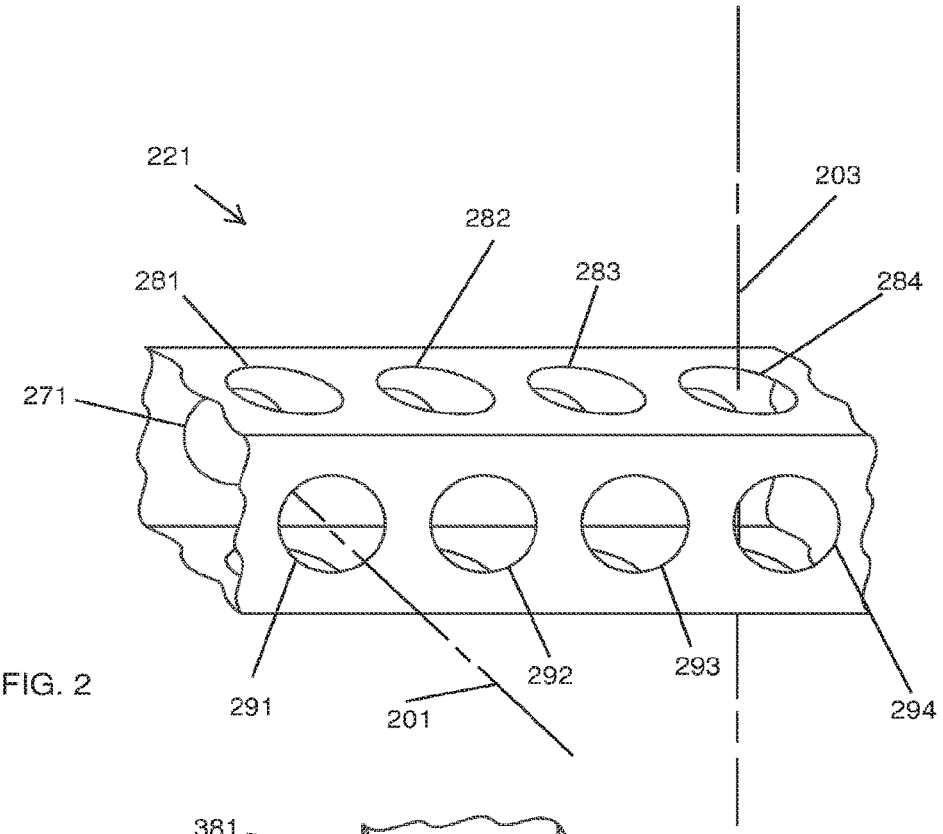
FIGS. 2 and 3 depict further embodiments comprising horizontal member 221 and vertical member 311.
Figure 3:
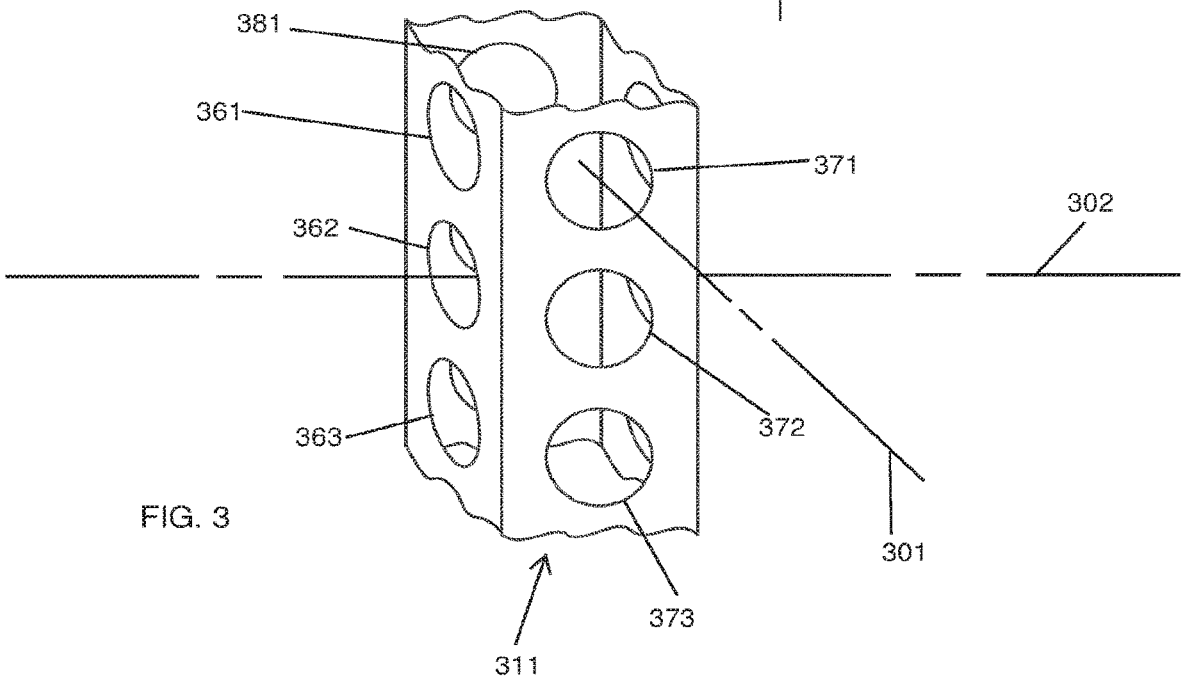

FIGS. 2 and 3 depict further embodiments comprising horizontal member 221 and vertical member 311. Horizontal member 221, which is a piece of square tubing made from a suitable steel alloy, comprises first horizontal accessory receiving ports 291, 292, 293, and 294. Horizontal accessory receiving port 291 can be considered to include hole 271, as a suitably-shaped accessory can enter port 291 and hole 271 (or vice versa), and receive stabilization thereby. Vertical member 311, which is a piece of square tubing made from a suitable steel alloy, comprises first vertical accessory receiving ports 371, 372, and 373. First vertical accessory receiving port 371 can be considered to include hole 381. Vertical member 311 also has second vertical accessory receiving ports 361, 362, and 363. Vertical accessory receiving port 371 has an axis 301 in a first direction. Vertical accessory receiving port 362 has access 302 in a second direction. As shown, horizontal accessory receiving port 291 has an axis 201 in the first direction. Horizontal member 221 also has second horizontal accessory receiving ports 281, 282, 283 and 284. Second horizontal accessory receiving port 284 has an axis 203 in a third direction.

Figure 4:
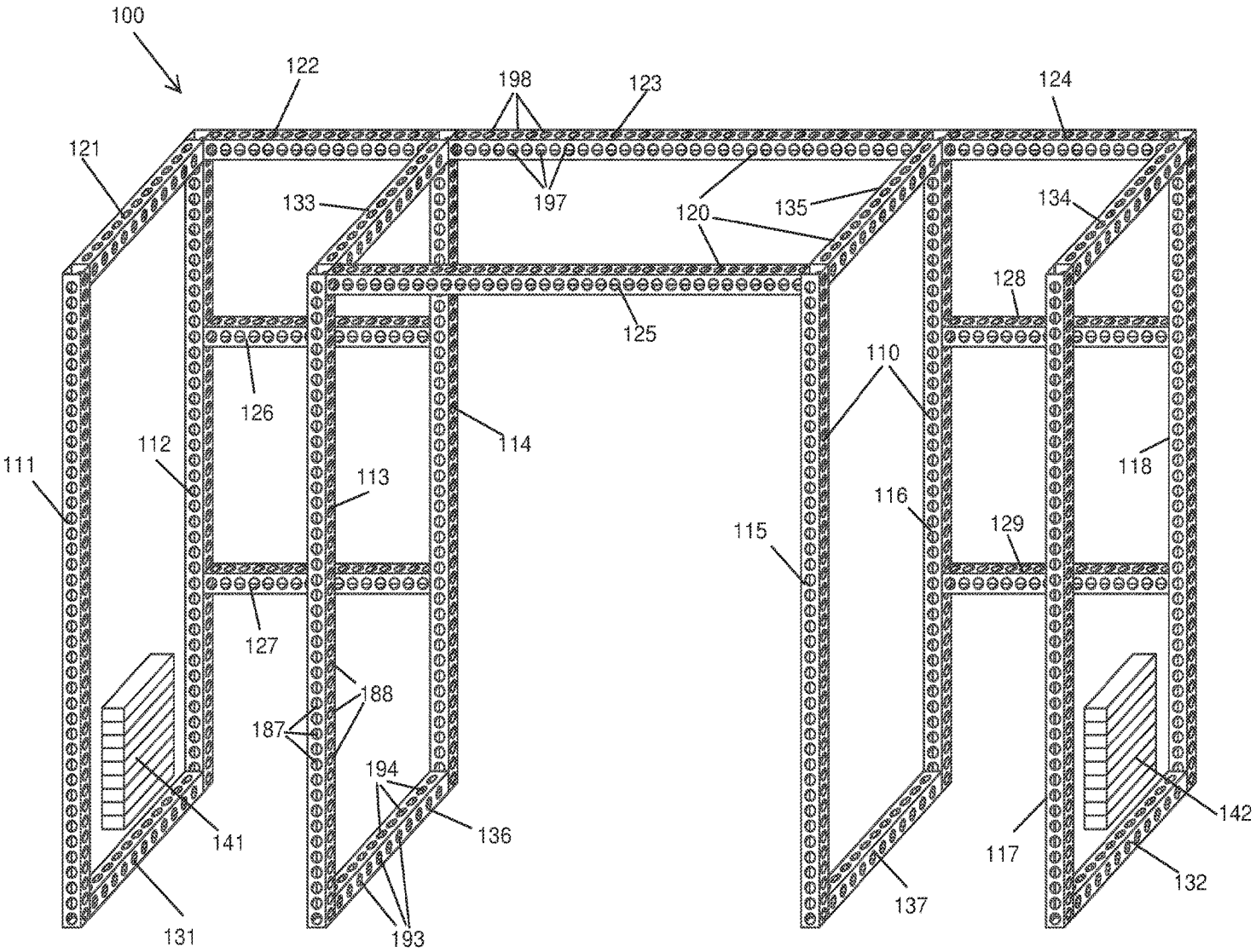
FIG. 4 further depicts apparatus 100.

FIG. 4 further depicts apparatus 100, with some features already shown in FIG. 1 omitted for clarity. Vertical member 113 has first vertical accessory receiving ports 187, which have axes in a first direction that can be described as "front-to-back." Vertical member 113 also has second vertical accessory receiving ports 188, which have axes in a second direction that can be described as "left-to-right." Horizontal member 123 has first horizontal accessory receiving ports 197, which have axes in the first direction. Horizontal member 123 also has second horizontal accessory receiving ports 198, which have axes in a third direction, which can be described as "up-and-down." Horizontal member 136 has horizontal accessory receiving ports 193 and 194 in the second direction and the third direction, respectively. The first direction and the second direction are substantially parallel to the horizontal; and the third direction is substantially normal to the horizontal. Each vertical member and each horizontal member shown in FIG. 4 has accessory receiving ports substantially along the entire length of each member. Any matter of exercise accessories can engage any of the accessory receiving ports found anywhere on apparatus 100, to allow for exercise against a resistance provided by either or both weight stacks 141, 142, free weights, elastic bands, the weight of the athlete's own body, or a combination thereof. The versatility of apparatus 100 can be further expanded by placing similar apparatuses together, with or without mechanical connection between them, and allowing floating exercise attachment points to connect to any suitable exercise attachment points on the several apparatuses. Multiple weight stacks can be brought together in a wide variety of possible exercises.

In certain instances of the present invention, apparatus 100 can have remarkably-small dimensions, such as, for example, 9 feet wide (from the vertical member 111 to vertical member 117) and 3 feet deep (from vertical member 117 to vertical member 118). It is believed that containing such a wide variety of exercises in such a small footprint is unprecedented. This small footprint may offer a dramatic improvement to the home-gym market and to the commercial-gym market alike.

Figure 5:
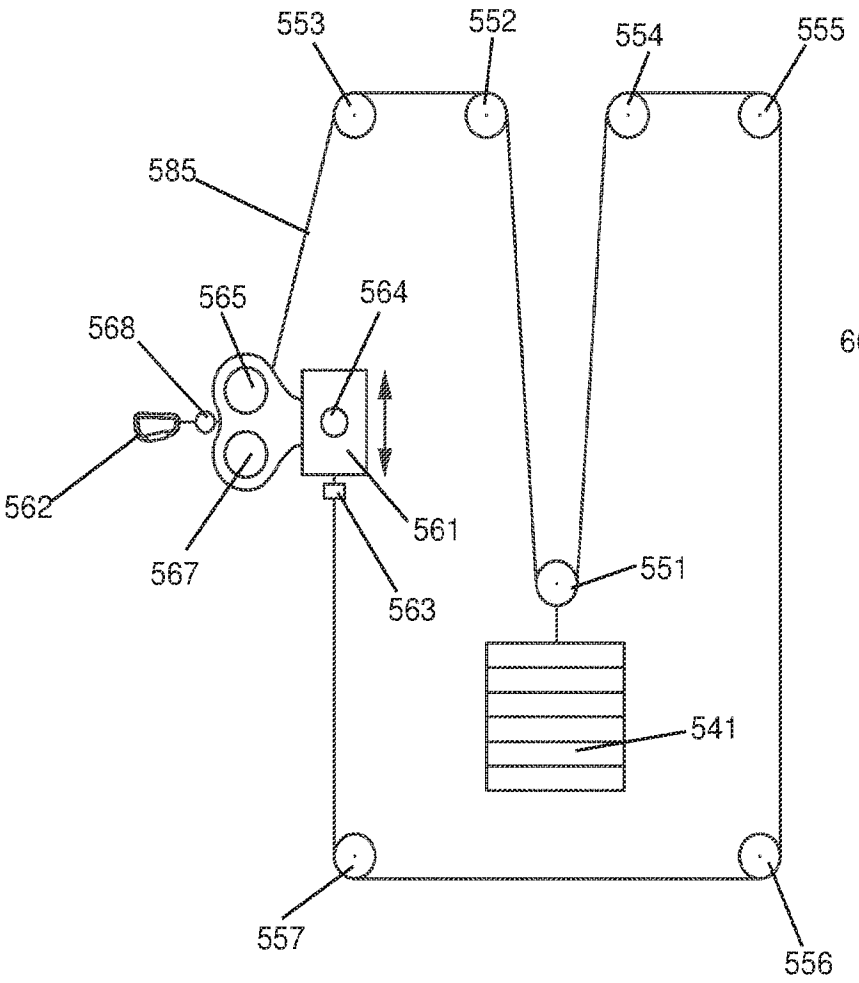
FIG. 5 depicts cable 585 selectively connecting weight stack 541 to exercise attachment point 561.

FIG. 5 depicts cable 585 selectively connecting weight stack 541 to exercise attachment point 561. Exercise attachment point 561 is slidably adjustable along a vertical member of the frame of an apparatus (not shown) by manipulating knob 564, which operates a spring-loaded pin suitable for engaging an accessory receiving port (not shown). Exercise attachment point 561 also comprises two pulleys 565, 567 to allow cable 585 significant versatile freedom of movement when carabiner 562 is moved during an exercise. Pulley stop 568, which is a rubber sphere, prevents cable 585 from exiting exercise attachment point 561. The other end of cable 585 attaches at connector 563 to exercise attachment point 561. Pulleys 557, 556, 555, 554, 551, 552, and 553 route cable 585 between its two ends through a frame (not shown). When exercise attachment point 561 is slidably adjusted between pulley 553 and pulley 557, the length of cable 585 between connector 563 and pulleys 565, 567 does not change. However, when carabiner 562 is pulled, the length of cable 585 between connector 563 and pulleys 565, 567 shortens, causing pulley 551 to raise a selected portion of weight stack 541 to provide resistance to the exercise.

Figure 6:
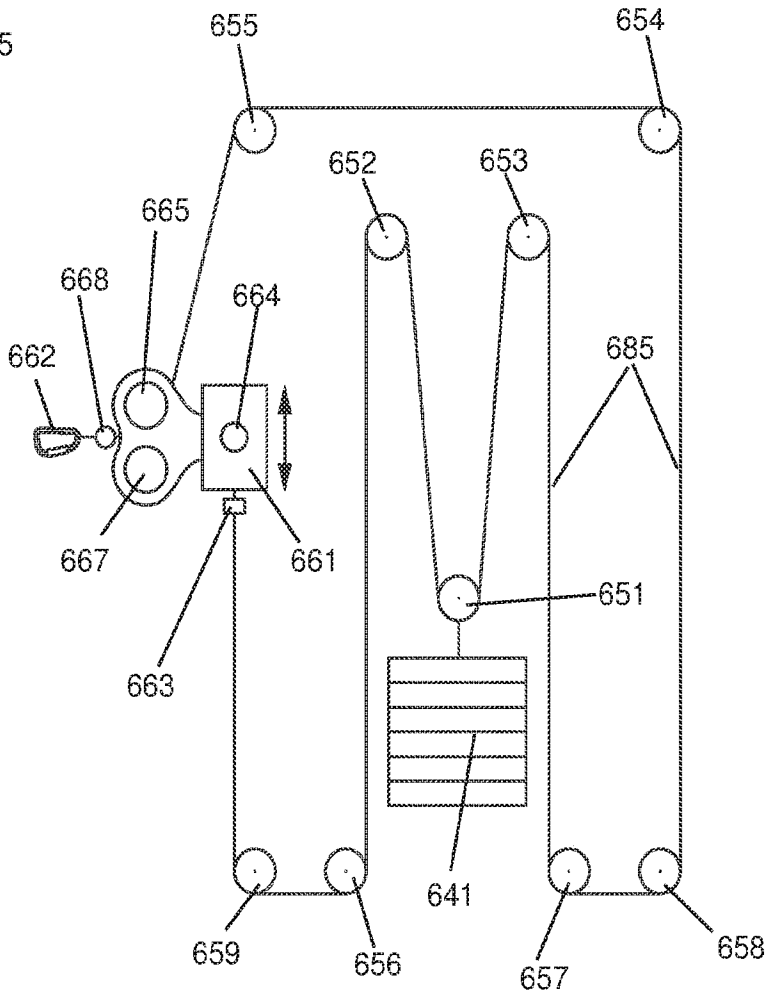
FIG. 6 depicts cable 685 selectively connecting weight stack 641 to exercise attachment point 661.

FIG. 6 depicts cable 685 selectively connecting weight stack 641 to exercise attachment point 661. The routing of cable 685 in FIG. 6 is analogous to the routings of cables 185, 186 in FIG. 1. Exercise attachment point 661 is slidably adjustable along a vertical member of the frame of an apparatus (not shown) by manipulating knob 664, which operates a spring-loaded pin suitable for engaging an accessory receiving port (not shown). Exercise attachment point 661 also comprises two pulleys 665, 667 to allow cable 685 significant versatile freedom of movement when carabiner 662 is moved during an exercise. Pulley stop 668, which is a rubber sphere, prevents cable 685 from exiting exercise attachment point 661. The other end of cable 685 attaches at connector 663 to exercise attachment point 661. Pulleys 659, 656, 652, 651, 653, 657, 658, 654, and 655 route cable 685 between its two ends. When exercise attachment point 661 is slidably adjusted between pulley 655 and pulley 659, the length of cable 685 between connector 663 and pulleys 665, 667 does not change. However, when carabiner 662 is pulled, the length of cable 685 between connector 663 and pulleys 665, 667 shortens, causing pulley 651 to raise a selected portion of weight stack 641 to provide resistance to the exercise.

Figure 7:
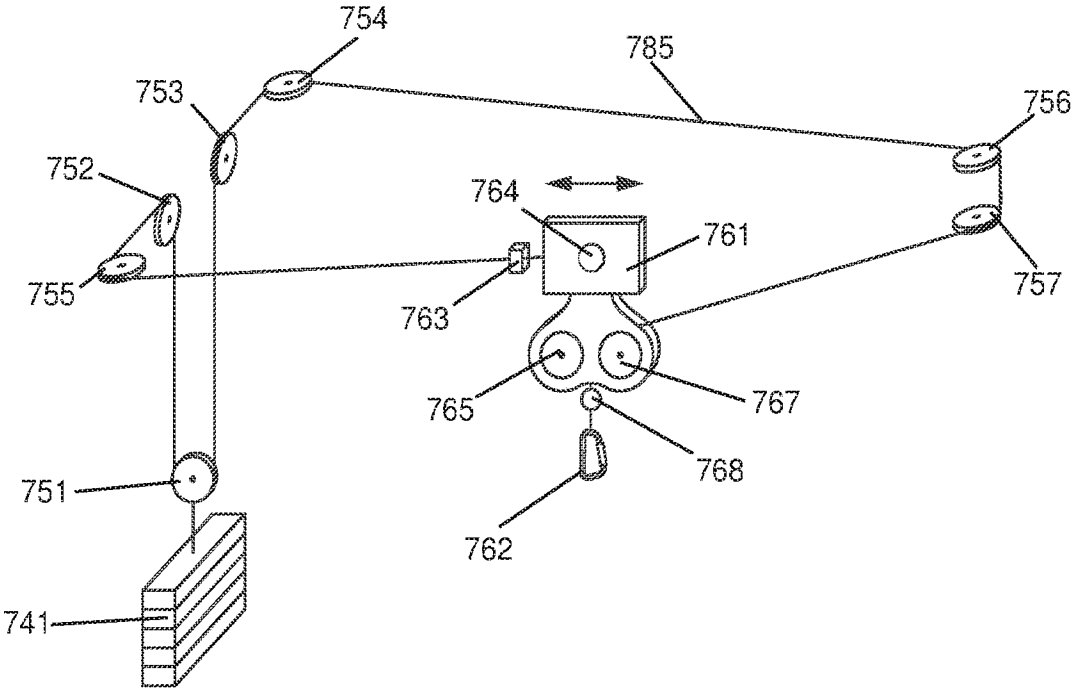
FIG. 7 depicts cable 785 selectively connecting weight stack 741 to exercise attachment point 761.

FIG. 7 depicts cable 785 selectively connecting weight stack 741 to exercise attachment point 761. Exercise attachment point 761 is slidably adjustable along a horizontal member of the frame of an apparatus (not shown) by manipulating knob 764, which operates a spring-loaded pin suitable for engaging an accessory receiving port (not shown). Exercise attachment point 761 also comprises two pulleys 765, 767 to allow cable 785 significant versatile freedom of movement when carabiner 762 is moved during an exercise. Pulley stop 768, which is a rubber sphere, prevents cable 785 from exiting exercise attachment point 761. The other end of cable 785 attaches at connector 763 to exercise attachment point 761. Pulleys 755, 752, 751, 753, 754, 756, and 757 route cable 785 between its two ends. When exercise attachment point 761 is slidably adjusted between pulley 755 and pulley 757, the length of cable 785 between connector 763 and pulleys 765, 767 does not change. However, when carabiner 762 is pulled, the length of cable 785 between connector 763 and pulleys 765, 767 shortens, causing pulley 751 to raise a selected portion of weight stack 741 to provide resistance to the exercise.

Figure 8:
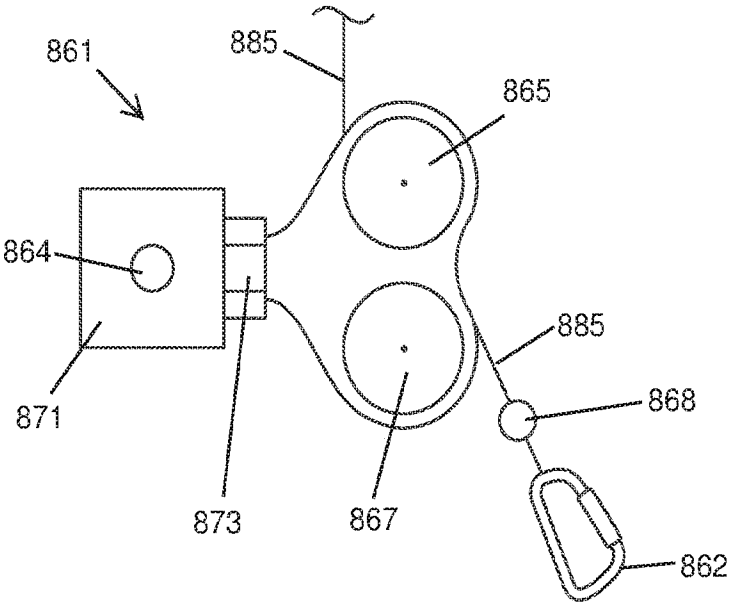
FIG. 8 depicts exercise attachment point 861.

FIG. 8 depicts exercise attachment point 861. Exercise attachment point 861 comprises a brace 871 having knob 864 which operates a spring-loaded pin suitable for engaging an accessory receiving port along a vertical or horizontal member of the frame of an apparatus (not shown). Pulleys 865, 867 route cable 885 to carabiner 862. Pulley stop 868 prevents cable 885 from exiting exercise attachment point 861. The other end of cable 885 (not shown) is routed through the frame of the apparatus and is selectively connected to a weight stack therein, in some embodiments of the present invention. Hinge 873 allows pulleys 865, 867 to swing back and forth (in this case, into and out of the plane of the page), to accommodate a wide variety of exercises performed by pulling carabiner 862 away from pulleys 865, 867. Any suitable exercise equipment, such as, for example, a hand grip, ankle strap, torso strap, head strap, barbell, dumbbell, or the like, or a multivector extension device as described herein, can be attached to carabiner 862. Sometimes, if desirable, an extension cable and a floating pulley can be attached to carabiner 862 for maximum flexibility in designing further exercises.

Figure 9:
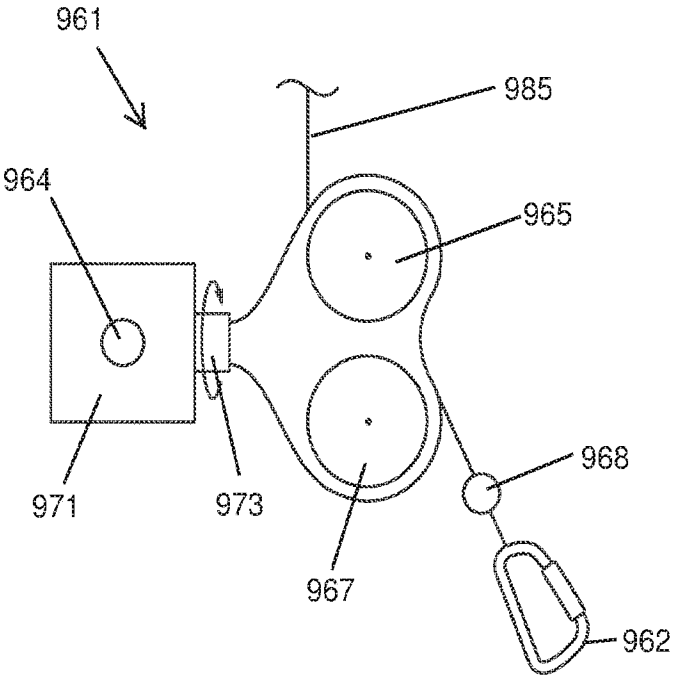
FIG. 9 depicts exercise attachment point 961.

FIG. 9 depicts exercise attachment point 961. Exercise attachment point 961 comprises a brace 971 having knob 964 which operates a spring-loaded pin suitable for engaging an accessory receiving port along a vertical or horizontal member of the frame of an apparatus (not shown). Pulleys 965, 967 route cable 985 to carabiner 962. Pulley stop 968 prevents cable 985 from exiting exercise attachment point 961. The other end of cable 985 (not shown) is routed through the frame of the apparatus and is selectively connected to a weight stack therein, in some embodiments of the present invention. Pivot 973 allows pulleys 965, 967 to rotate up to 360 degrees (in this case, into and out of the plane of the page), to accommodate a wide variety of exercises performed by pulling carabiner 962 away from pulleys 965, 967. Rotation at pivot 973 is limited of course by cable 985. Any suitable exercise equipment, such as, for example, a hand grip, ankle strap, torso strap, head strap, barbell, dumbbell, or the like, or a multivector extension device as described herein, can be attached to carabiner 962. Sometimes, if desirable, an extension cable and a floating pulley can be attached to carabiner 962 for maximum flexibility in designing further exercises.

Figure 10:
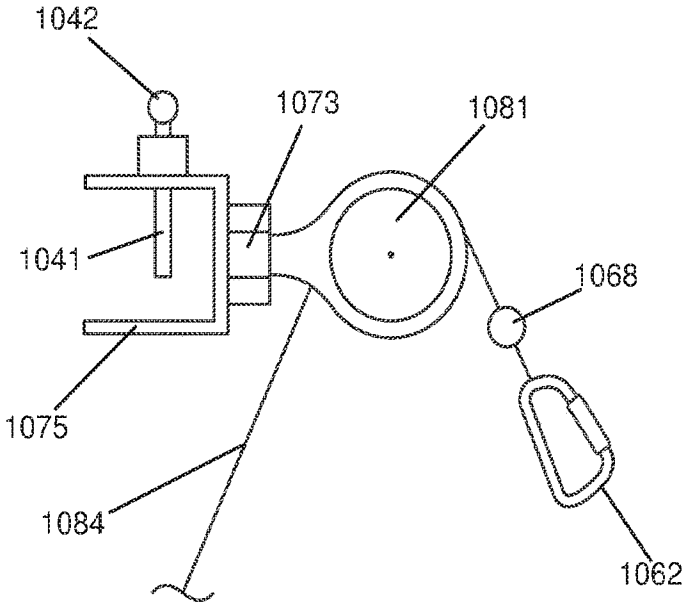
FIG. 10 depicts floating pulley 1081.

FIG. 10 depicts floating pulley 1081. Floating pulley 1081 comprises brace 1075, which houses knob 1042, which in turn operates spring-loaded pin 1041. Spring-loaded pin 1041 can engage an accessory receiving port. It can be said that floating pulley 1081 has an accessory engagement structure comprising brace 1075, knob 1042, and spring-loaded pin 1041 for removably and adjustably coupling to an accessory receiving port on an apparatus. It also can be said that floating pulley 1081 has only a single pulley wheel. Floating pulley 1081 further comprises extension cable 1084 terminating at a second end with carabiner 1062. Pulley stop 1068 prevents extension cable 1084 from exiting floating pulley 1081. Hinge 1073 allows floating pulley 1081 to swing back and forth (in this case, into and out of the plane of the page). Any suitable exercise equipment, such as, for example, a hand grip, ankle strap, torso strap, head strap, barbell, dumbbell, or the like, or a multivector extension device as described herein, can be attached to carabiner 1062. Sometimes, if desirable, a further extension cable and a further floating pulley can be attached to carabiner 1062 for maximum flexibility in designing further exercises.

Figure 11:
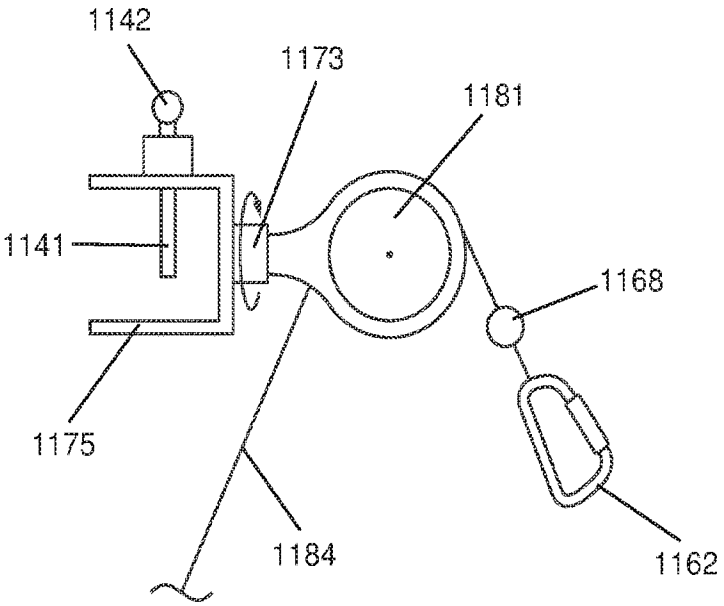
FIG. 11 depicts floating pulley 1181.

FIG. 11 depicts floating pulley 1181. Floating pulley 1181 comprises brace 1175, which houses knob 1142, which in turn operates spring-loaded pin 1141. Spring-loaded pin 1141 can engage an accessory receiving port. It can be said that floating pulley 1181 has an accessory engagement structure comprising brace 1175, knob 1142, and spring-loaded pin 1141 for removably and adjustably coupling to an accessory receiving port on an apparatus. It also can be said that floating pulley 1181 has only a single pulley wheel. Floating pulley 1181 further comprises extension cable 1184 terminating at a second end with carabiner 1162. Pulley stop 1168 prevents extension cable 1184 from exiting floating pulley 1181. Pivot 1173 allows floating pulley 1181 to rotate up to 360 degrees (in this case, into and out of the plane of the page). Any suitable exercise equipment, such as, for example, a hand grip, ankle strap, torso strap, head strap, barbell, dumbbell, or the like, or a multivector extension device as described herein, can be attached to carabiner 1162. Sometimes, if desirable, a further extension cable and a further floating pulley can be attached to carabiner 1162 for maximum flexibility in designing further exercises.

Figure 12:
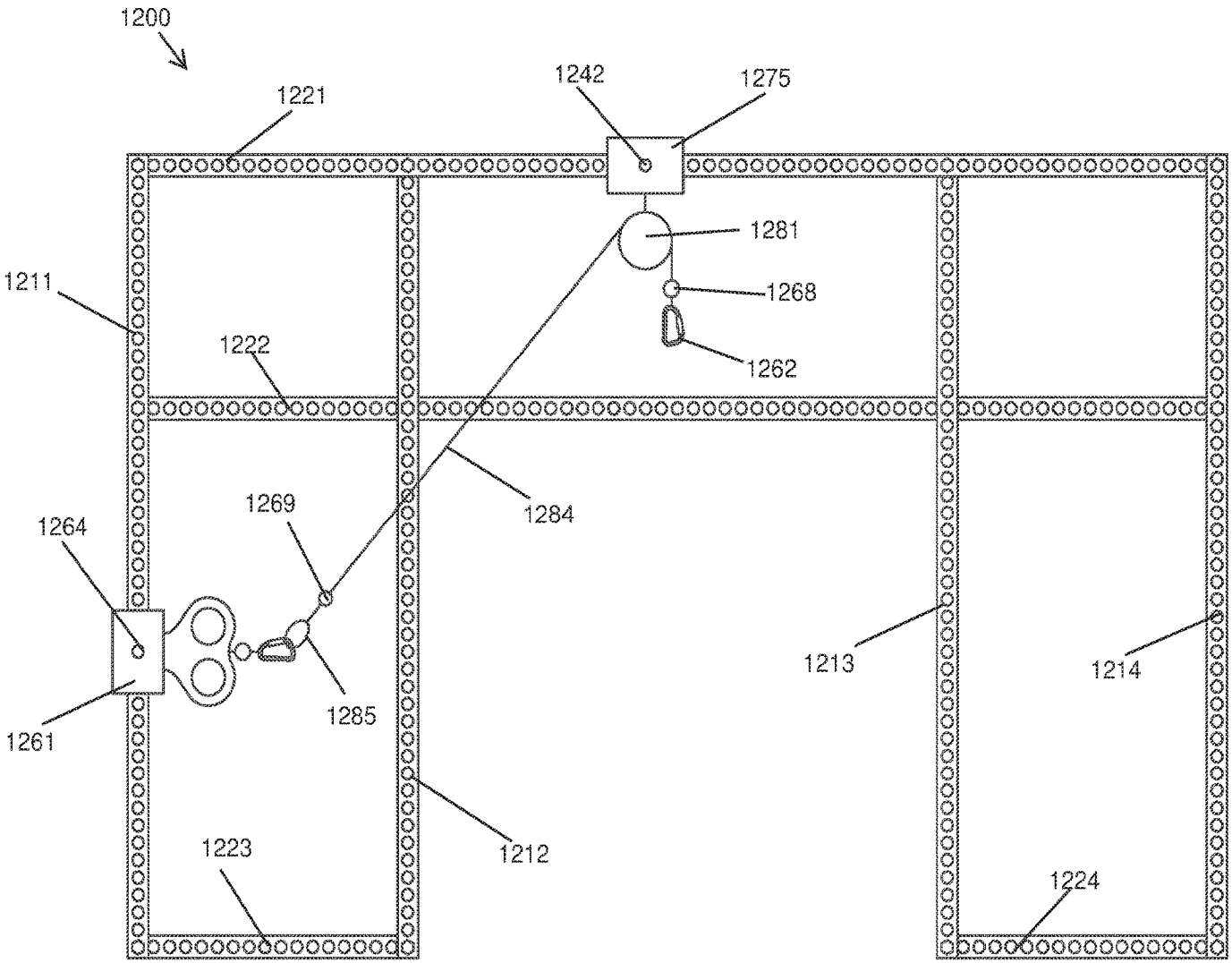
FIG. 12 provides a front elevation view of apparatus 1200.

FIG. 12 provides a front elevation view of apparatus 1200. A plurality of vertical members 1211, 1212, 1213, and 1214 mutually support a plurality of horizontal members 1221, 1222, 1223, at 1224. Each of those vertical members and horizontal members have accessory receiving ports; only accessory receiving ports in the first direction are shown in FIG. 12. Exercise attachment point 1261 is slidably adjustable along vertical member 1221 by manipulating knob 1264. Floating pulley 1281 comprises brace 1275 and is removably and adjustably attached to the frame at horizontal member 1221. Knob 1242 can be manipulated to allow floating pulley 1281 to move along the horizontal member 1221, or to be removed therefrom entirely. Floating pulley 1281 further comprises an extension cable 1284 having a first end 1285 attached at exercise attachment point 1261, and a second end at carabiner 1262 providing a floating exercise attachment point. Extension cable 1284 further comprises pulley stops 1268, 1269. FIG. 12 illustrates the versatility of certain embodiments of the present invention: virtually any accessory receiving port anywhere on the frame can anchor an exercise attachment point or a floating exercise attachment point. Any slack in extension cable 1284, such as for example when floating pulley 1281 is brought closer to vertical member 1211, can be taken up by moving exercise attachment point 1261 lower on vertical member 1211. Similarly, the further from vertical member 1211 floating pulley 1281 moves, exercise attachment point 1261 can be moved higher on vertical member 1211 to provide more of extension cable 1284 to span the distance between exercise attachment point 1261 and floating pulley 1281. Apparatus 1200 can further comprise weight stacks and cables, among other things, as described herein.

Figure 13:
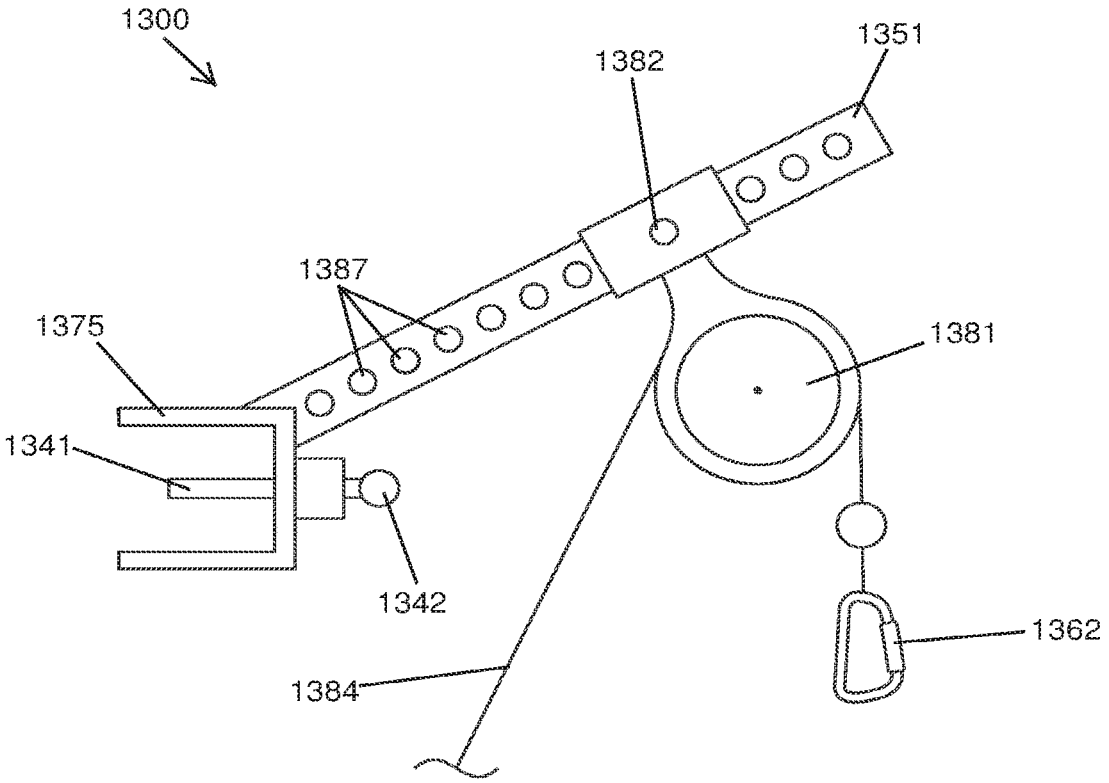
FIG. 13 depicts a right side elevation view of extension arm 1300.

FIG. 13 depicts a right-side elevation view of extension arm 1300. Extension arm 1300 comprises brace 1375, which houses spring-loaded pin 1341, which is manipulated by knob 1342. Together, brace 1375, pin 1341, and knob 1342 allow extension arm 1300 to be removably and adjustably attached to a frame of an apparatus (not shown). Extension arm 1300 further comprises extension member 1351 extending from brace 1375 and comprising a plurality of extension receiving ports 1387. Floating pulley 1381, comprising extension cable 1384 ending at carabiner 1362, is removably attached to extension arm 1351 by manipulating knob 1382, which operates another spring-loaded pin (not shown). It can be said that carabiner 1362 represents both a floating exercise attachment point and an extension exercise attachment point in this embodiment.

Figure 14:
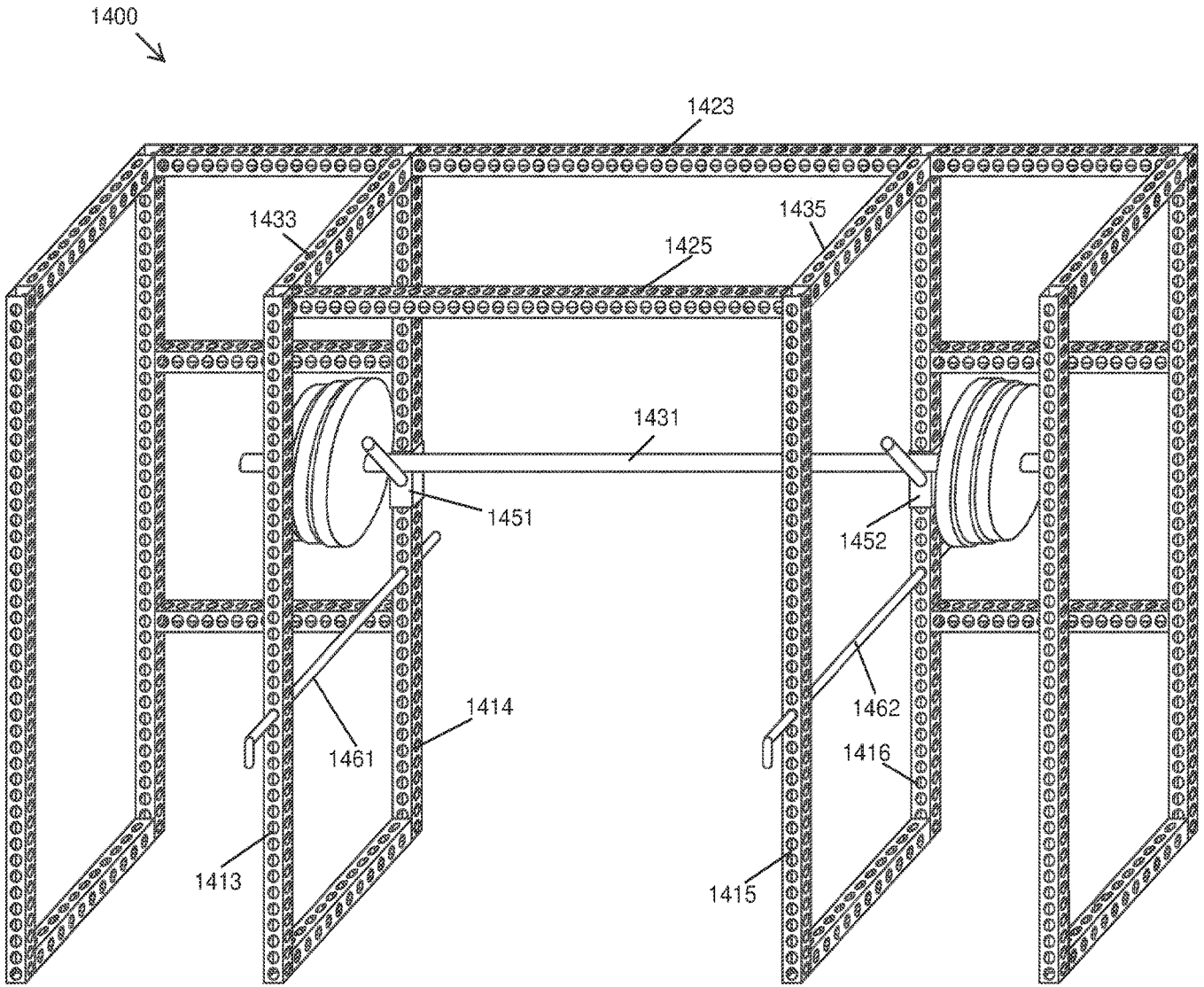
FIG. 14 provides a perspective view of apparatus 1400.

FIG. 14 provides a perspective view of apparatus 1400. Apparatus 1400 illustrates a power rack for receiving at least one barbell 1431 for the performance of at least one exercise with the barbell 1431. Vertical members 1413, 1414, 1415, and 1416 (and others) mutually support horizontal members 1423, 1425, 1433, and 1435 (and others) to form a frame for apparatus 1400. Each vertical member and each horizontal member of apparatus 1400 is depicted with accessory receiving ports (unlabeled) substantially along the entire length of each member. Rack accessories 1451, 1452 are removably attached to vertical members 1414 and 1416, respectively, and hold barbell 1431. Rod 1461 is positioned between vertical members 1413 and 1414 to protect an athlete exercising with barbell 1431; similarly, rod 1462 is positioned between vertical members 1415 and 1416 for the same purpose. Apparatus 1400 can further comprise weight stacks, cables, exercise attachment points, and floating pulleys, among other things, as described herein.

Figure 15:
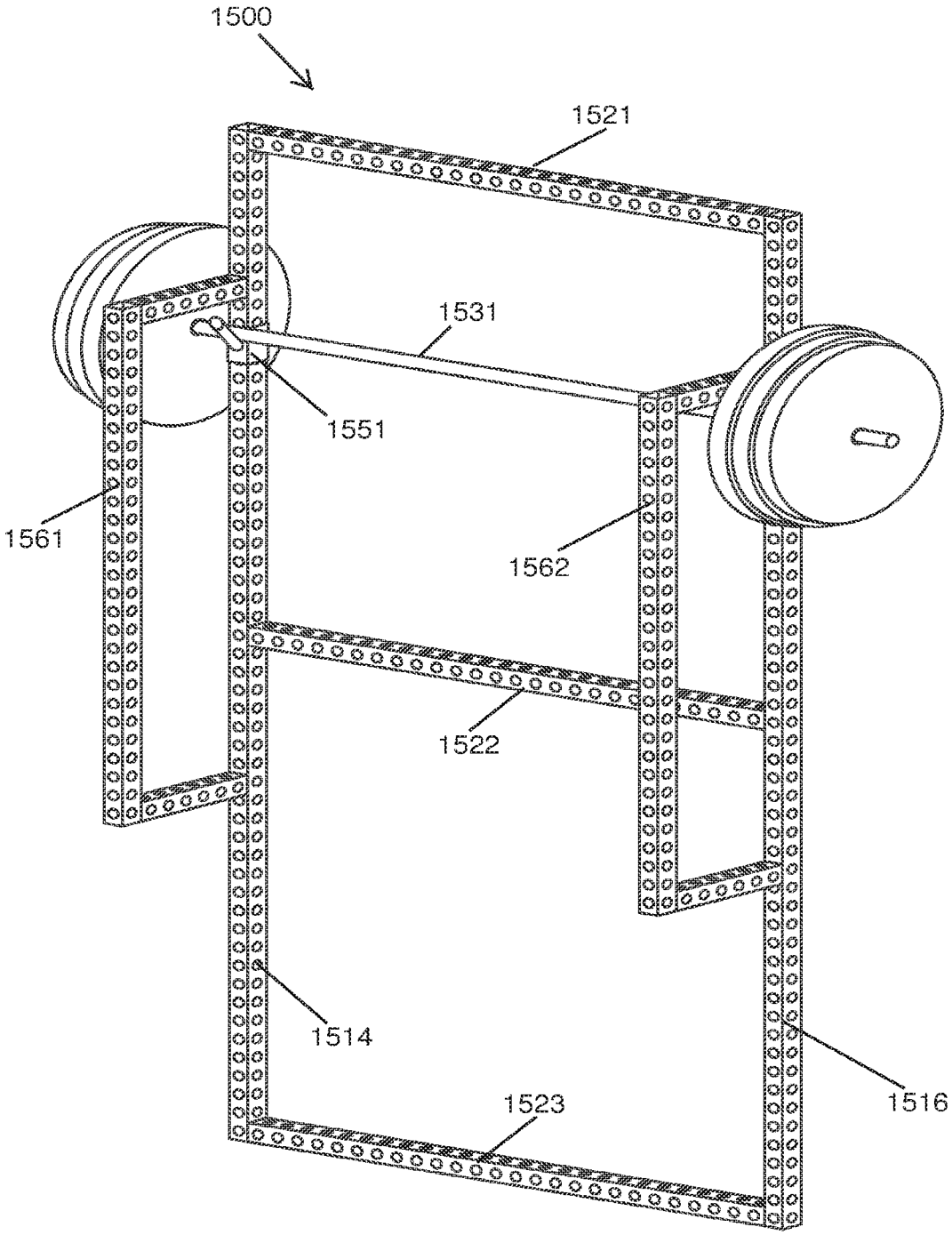
FIG. 15 provides a perspective view of a Smith machine 1500 comprising frame members 1561, 1562.

FIG. 15 provides a perspective view of a Smith machine 1500 comprising frame members 1561, 1562. Vertical members 1514 and 1516 mutually support horizontal members 1521, 1522, and 1523. Any of members 1514, 1516, 1521, 5022, and 1523 can represent members of a frame of an apparatus as described herein; or they can represent a distinct device that can be attached to the frame of such an apparatus. Here, Smith machine 1500 is depicted with numerous accessory receiving ports to maximize the versatility and interoperability with apparatuses as described herein. For example, any of horizontal members 1521, 1522, and 1523 can receive one or more floating pulleys, augmenting the resistance provided by barbell 1531. Smith machine 1500 can be part of an apparatus that further comprises weight stacks, cables, exercise attachment points, and floating pulleys, among other things, as described herein.

Figure 16:
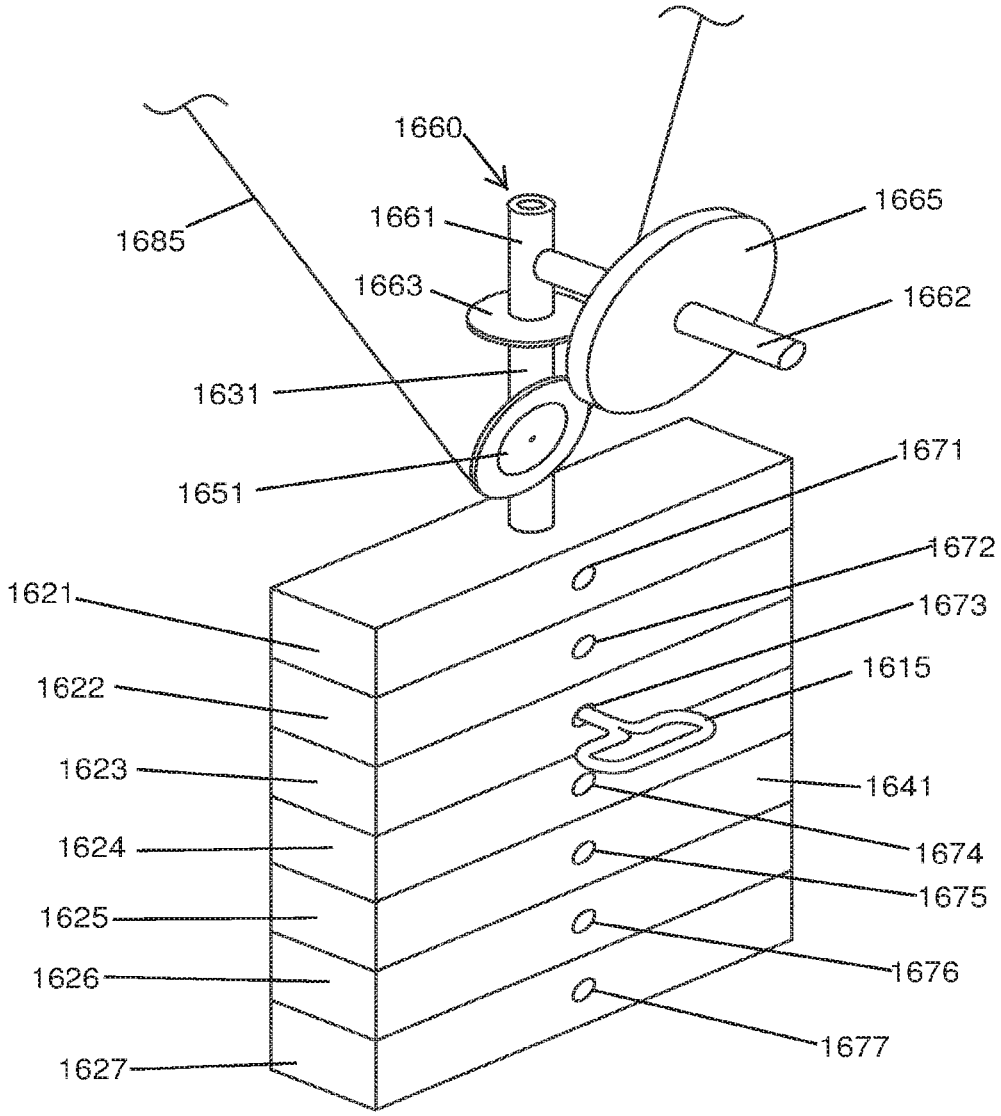
FIG. 16 provides a perspective view of weight stack 1641 with free weight 1665.

FIG. 16 provides a perspective view of weight stack 1641 with free weight 1665. As illustrated previously for other embodiments, cable 1685 can operate to lift pulley 1651 when an exercise is performed. Pulley 1651 in this case is connected to rod 1631, which engages weight stack 1641. Rod 1631 has a series of holes (not seen) aligned with holes 1671, 1672, 1673, 1674, 1675, 1676, and 1677 in weight plates 1621, 1622, 1623, 1624, 1625, 1626, and 1627, respectively, of weight stack 1641. Weight selection key 1615 is placed by an athlete into desired hole 1673, so that when cable 1685 lifts pulley 1651 and thereby rod 1631, weight plates 1621, 1622 and 1623 will be lifted also. This illustrates one way of selectively connecting weight stack 1641 to one or more exercise attachment points (not shown) via cable 1685. Here, device 1660 allows the addition of free weight plate 1665. Device 1660 comprises hollow shaft 1661 which fits over rod 1631, and comprises a pulley-protecting collar 1663. Hollow shaft 1661 further comprises rod 1662, to which free weight 1665 has been added. Rod 1662 represents a free weight attachment point. In this way, greater versatility in the increment and the amount of weight provided by weight stack 1641 can be obtained.

Figure 17:
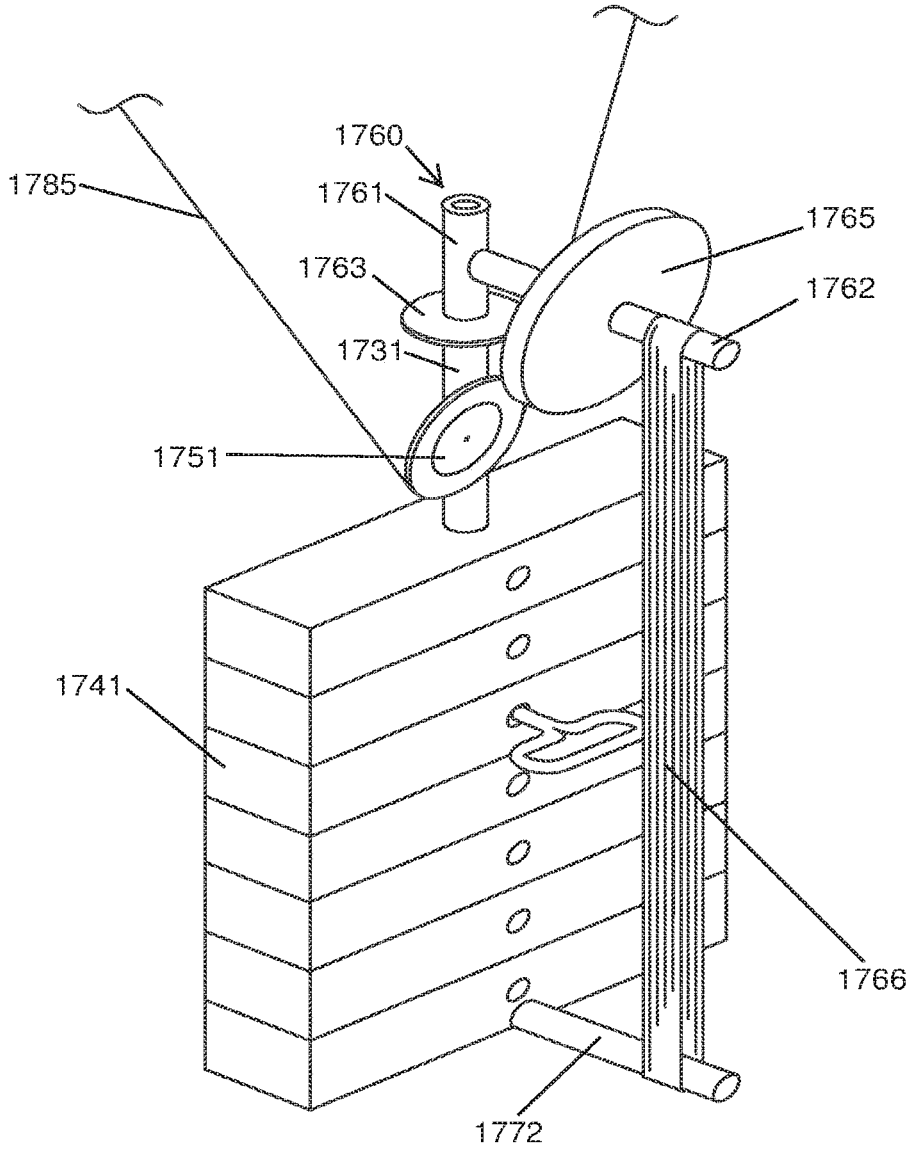
FIG. 17 provides a perspective view of weight stack 1741 with elastic band 1766.

FIG. 17 provides a perspective view of weight stack 1741 with elastic band 1766. As illustrated previously for other embodiments, cable 1785 can operate to lift pulley 1751 when an exercise is performed. Pulley 1751 in this case is connected to rod 1731, which engages weight stack 1741. Here, device 1760 allows the addition of free weight plate 1765 and elastic band 1766. Device 1760 comprises hollow shaft 1761 which fits over rod 1731, and comprises a pulley-protecting collar 1763. Shaft 1761 further comprises rod 1762, to which free weight 1765 has been added. In addition, elastic band 1766 has been added to rod 1762. Elastic band anchor 1772 also engages elastic band 1766, so that when cable 1785 lifts pulley 1751 and thereby rod 1731, resistance is provided by weight stack 1741, free weight 1765, and elastic band 1766. Rod 1762 provides both a free weight attachment point and an elastic band attachment point. Elastic band anchor 1772 provides an elastic band attachment point. In this way, greater versatility in the increment, the amount of weight, and the nature of the resistance provided by weight stack 1741 can be obtained.

Figure 18:
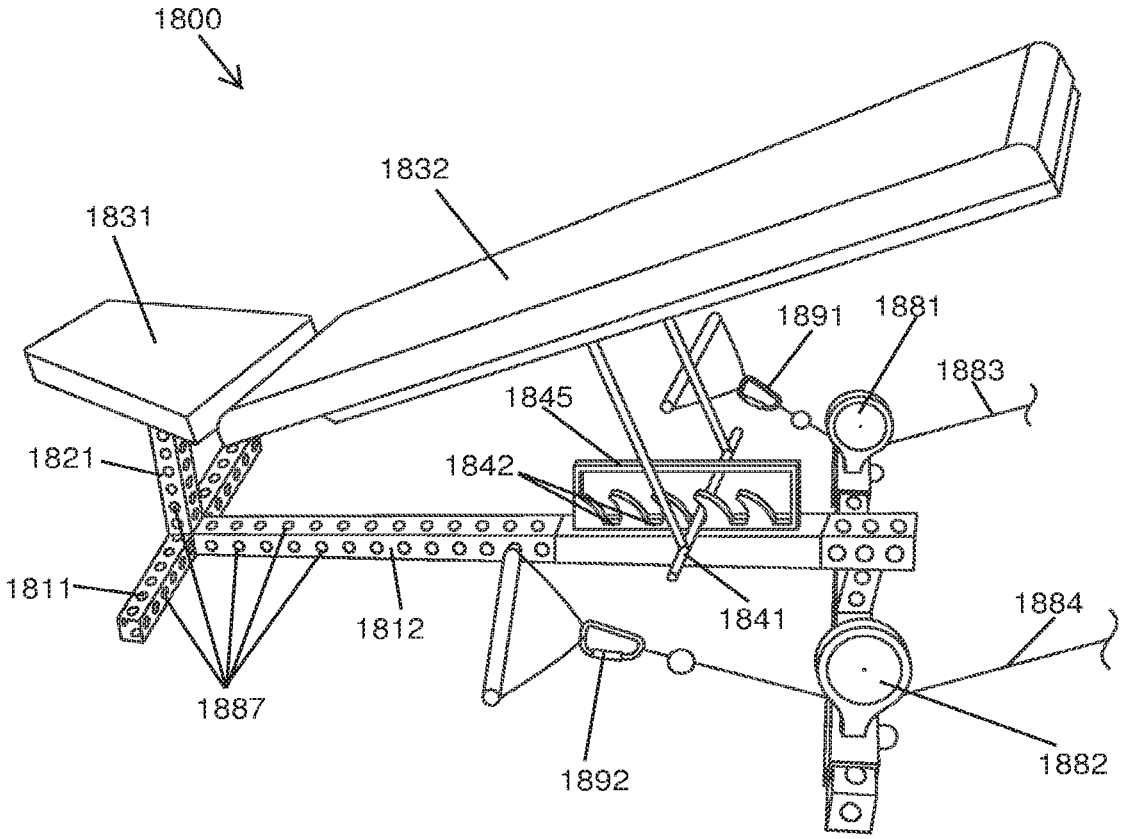
FIG. 18 provides a perspective view of exercise bench 1800.

FIG. 18 provides a perspective view of exercise bench 1800. Exercise bench 1800 comprises horizontal member 1811 mutually supporting vertical member 1821, which together constitute part of a bench frame supporting seat cushion 1831. Back cushion 1832 is further supported by the frame at member 1812, and is capable of adopting an incline angle. Exercise bench 1800 comprises numerous bench accessory receiving ports 1887, and a plurality of incline angle selection slots 1842. Back cushion brace 1841 engages a chosen incline angle selection slot 1842 and establishes a chosen incline angle for back cushion 1832 relative to the horizontal. Brace guard 1845 prevents back cushion brace 1841 from escaping incline angle selection slots 1842. Together, back cushion brace 1841, the plurality of incline angle selection slots 1842, and brace guard 1845 can be said to constitute an incline angle selection device.

Here, exercise bench 1800 is shown with floating pulleys 1881 and 1882. Floating pulley 1881 allows extension cable 1883 to attach a hand grip at carabiner 1891. The other end of extension cable 1883 (not shown) can connect to an exercise attachment point on the apparatus (not shown). Floating pulley 1882 allows extension cable 1884 to attach to hand grip at carabiner 1892. The other end of extension cable 1884 (not shown) can connect to an exercise attachment point on the apparatus (not shown). Carabiners 1891 and 1892 can be said to provide bench exercise attachment points.

Figure 20:
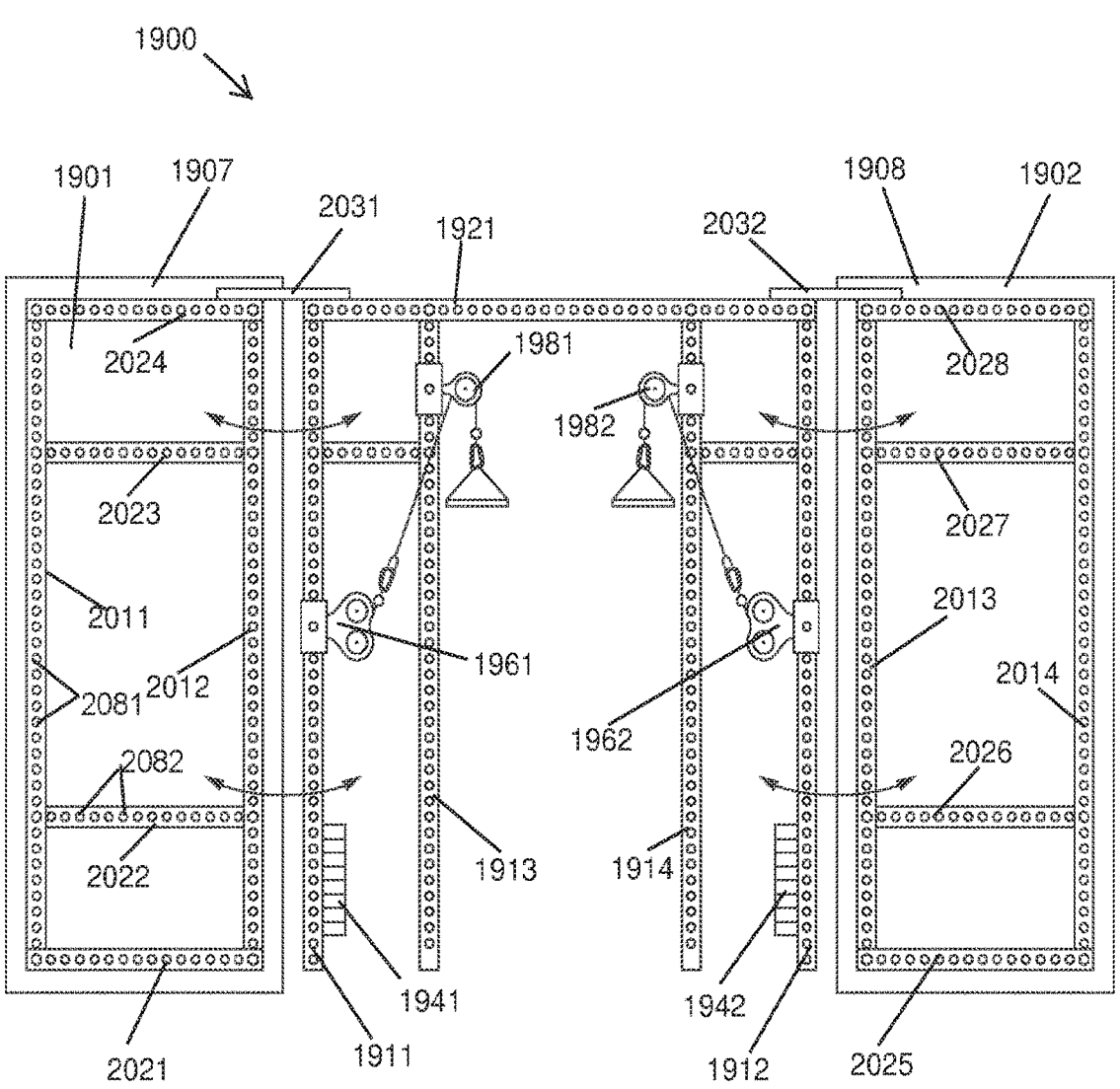
FIGS. 19, 20, and 21 depict apparatus 1900 having doors 1901, 1902.
Figure 19:
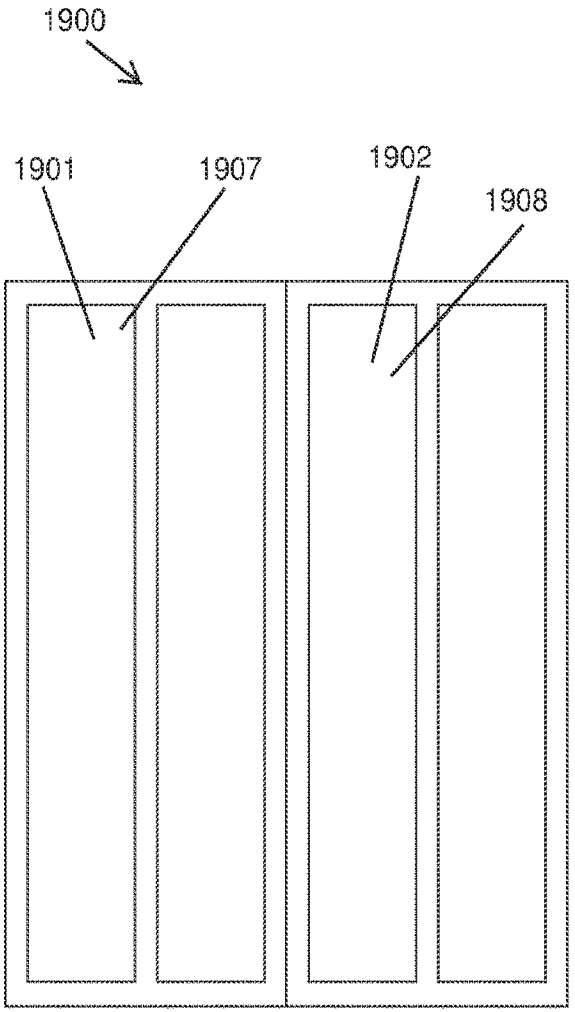
Figure 21:
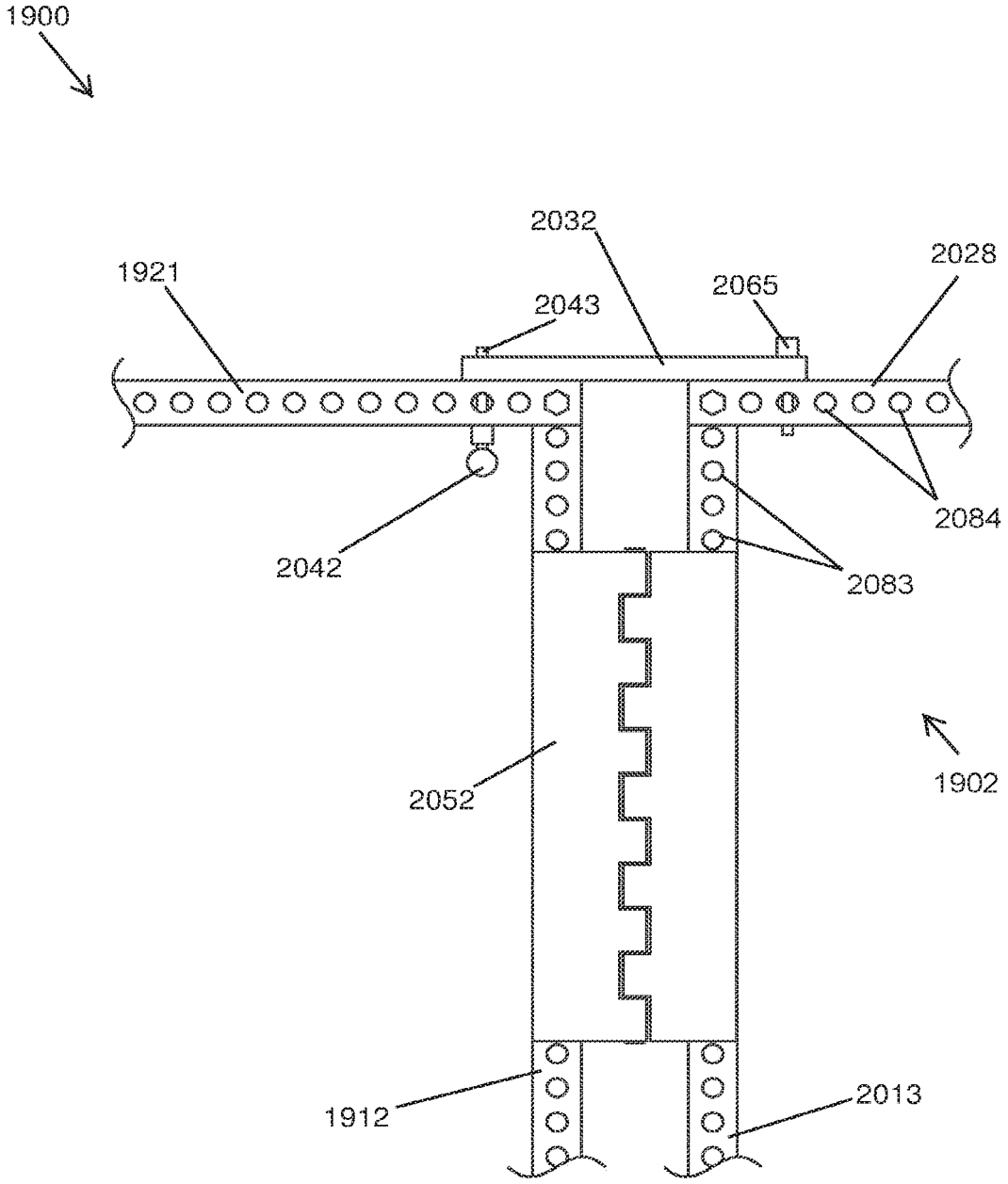

FIGS. 19, 20, and 21 depict apparatus 1900 having doors 1901, 1902. In FIG. 19, doors 1901, 1902 are closed, and panels 1907, 1908 conceal or disguise apparatus 1900. In FIG. 20, doors 1901, 1902 are open. Apparatus 1900 comprises vertical members 1911, 1912, 1913, and 1914 mutually supporting horizontal member 1921 (among others). Each vertical member and each horizontal member have accessory receiving ports substantially along the entire length. A cable (not shown) selectively connects weight stack 1941 to exercise attachment point 1961. Another cable (not shown) selectively connects weight stack 1942 to exercise attachment point 1962. Floating pulley 1981 is removably and adjustably attached to vertical member 1913. Floating pulley 1982 is removably and adjustably attached to vertical member 1914. The frame of apparatus 1900 further comprises door 1901 pivotally mounted on vertical member 1911, at least by door brace 2031, and door 1902 pivotally mounted on vertical member 1912, at least by door brace 2032 and hinge 2052.

Door 1901 comprises door vertical members 2011 and 2012 mutually supporting door horizontal members 2021, 2022, 2023, and 2024. Door vertical members 2011, 2012 comprise first door vertical accessory receiving ports (e.g., 2081) having axes in a fourth direction and second door vertical accessory receiving ports in a fifth direction (not shown). Door horizontal members 2021, 2022, 2023, and 2024 have first door horizontal accessory receiving ports (e.g., 2082) having axes in the fourth direction and second door horizontal accessory receiving ports having axes in a sixth direction (not shown). Panel 1907 is mounted to door 1901.

Door 1902 comprises door vertical members 2013 and 2014 mutually supporting door horizontal members 2025, 2026, 2027, and 2028. Door vertical members 2013, 2014 comprise first door vertical accessory receiving ports (e.g., 2083) having axes in a fourth direction and second door vertical accessory receiving ports in a fifth direction (not shown). Door horizontal members 2025, 2026, 2027, and 2028 have first door horizontal accessory receiving ports (e.g., 2084) having axes in the fourth direction and second door horizontal accessory receiving ports having axes in a sixth direction (not shown). Panel 1908 is mounted to door 1902.

Door brace 2032 operates by engaging pin 2065 in door horizontal member 2028, on one end, and on the other end, spring-loaded pin 2043 is operated with knob 2042. In this way, door 1902 can be secured at a number of desired positions simply by pulling knob 2042 and rotating door 1902, followed by releasing knob 2042 when door 1902 has reached a desirable position, and allowing pin 2043 to engage an accessory receiving port along horizontal member 1921. Doors 1901, 1902 can provide considerable additional versatility: door 1902, for example, can receive floating pulley 1982 in any of its accessory receiving ports, and floating pulley 1981 for that matter. In addition, doors 1901, 1902 can receive additional accessories such as Smith machine 1500, rack accessories 1451, 1452, chin up bar attachments, dip bar attachments, or the like. Indeed, any matter of exercise accessories can engage any of the accessory receiving ports found anywhere on apparatus 1900, to allow for exercise against a resistance provided by either or both weight stacks 1941, 1942, free weights, elastic bands, the weight of the athlete's own body, or a combination thereof.

Figure 22:
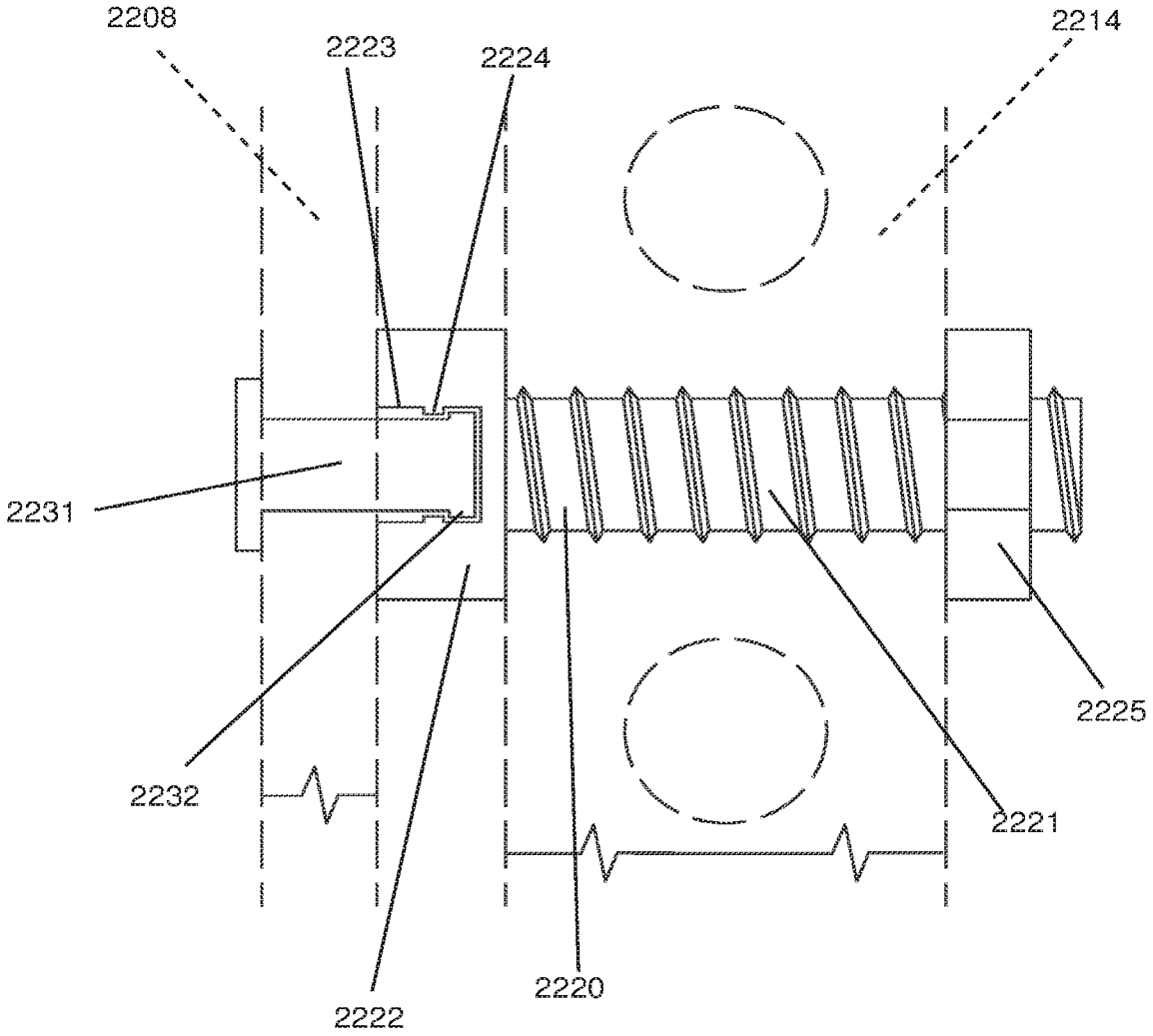
FIG. 22 depicts hollow-headed bolt 2220 mounting panel 2208 to vertical member 2214 via rivet 2231.

FIG. 22 depicts hollow-headed bolt 2220 mounting panel 2208 to vertical member 2214 via rivet 2231. Hollow-headed bolt 2220 comprises threaded shaft 2221 and head 2222. Axial recess 2223 in head 2222 further comprises an annulus 2224 adapted to receive and retain a corresponding annular structure 2232 on rivet 2231. Nut 2225 secures hollow-headed bolt to vertical member 2214. Nut 2225 and hollow-headed bolt 2220 can be made of any suitable material, such as, for example, steel. Rivet 2231 can be made of any suitable material, such as, for example, structural polymers such as high-density polyethylene, or metal or metal alloys such as aluminum or steel.

Figure 24:
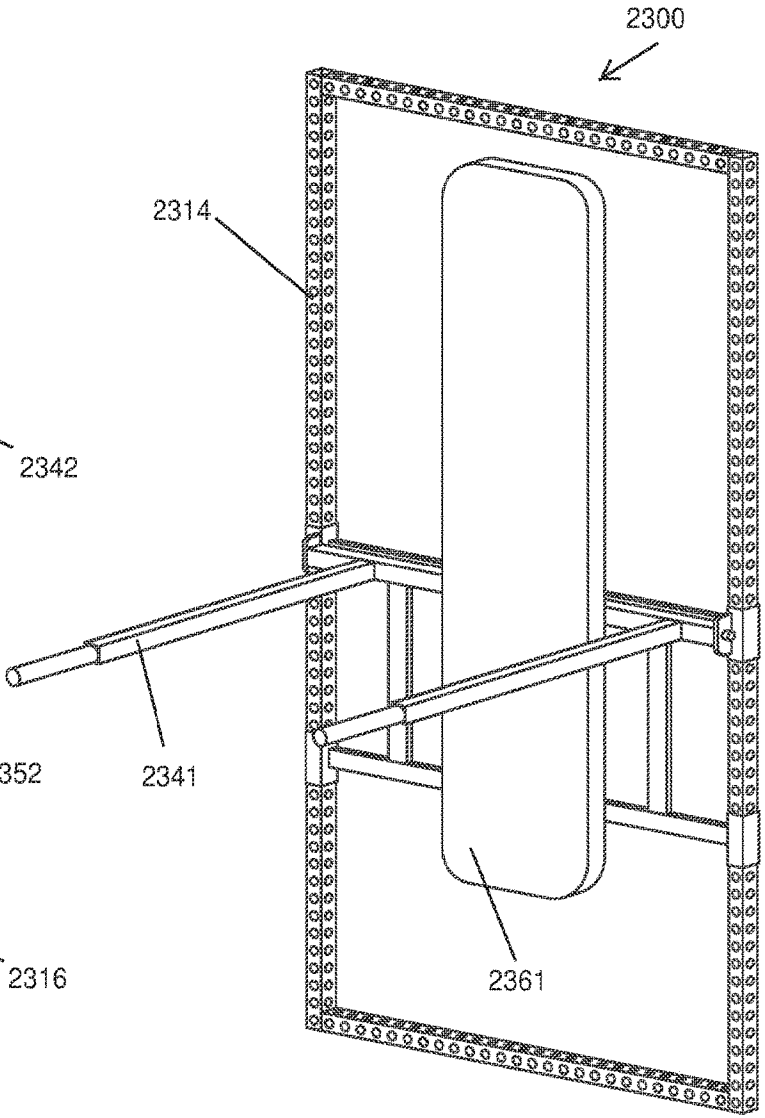
FIGS. 23 and 24 depict apparatus 2300 comprising dip bar 2350.
Figure 23:
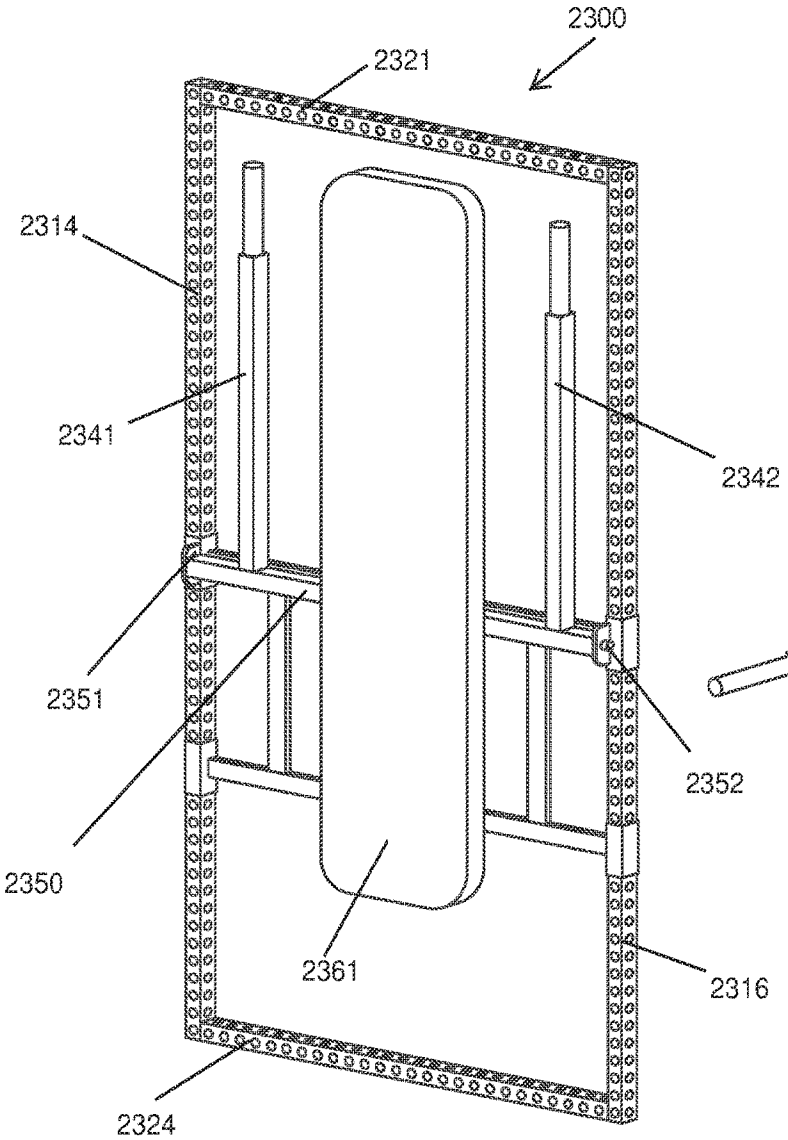

FIGS. 23 and 24 depict apparatus 2300 comprising dip bar 2350. Apparatus 2300 comprises vertical members 2314, 2316 mutually supporting horizontal members 2321, 2324, which could be part of a door of the frame of apparatus 2300. Dip bar 2350 comprises arm supports 2341, 2342, and is attached to vertical members 2314, 2316 at hinges 2351 and 2352, respectively. Back pad 2361 allows an athlete to use dip bar 2350 to perform leg extension exercises, for example, while facing away from apparatus 2300. FIG. 23 shows dip bar 2350 in the stowed position; FIG. 24 shows dip bar 2350 deployed and ready for exercise. Apparatus 2300 can further comprise weight stacks, cables, exercise attachment points, and floating pulleys, among other things, as described herein.

Figure 25:
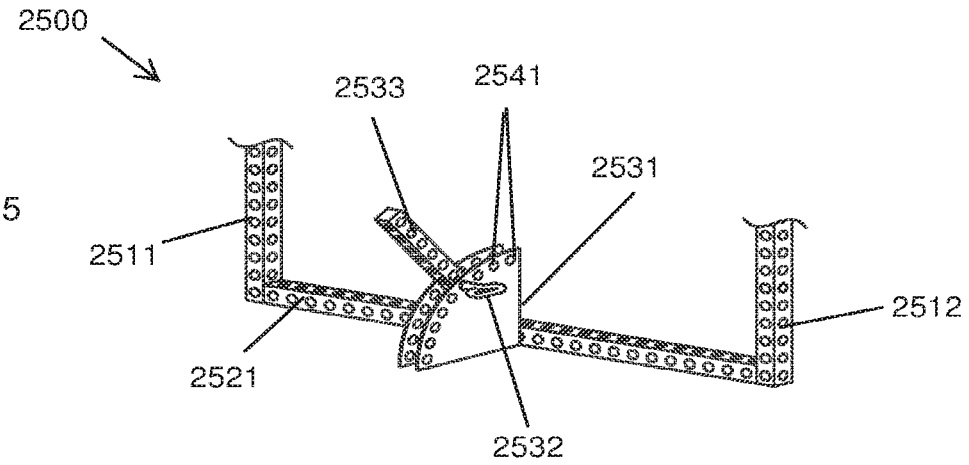
FIG. 25 depicts apparatus 2500 comprising angle selector 2531.

FIG. 25 depicts apparatus 2500 comprising angle selector 2531. Apparatus 2500 comprises vertical members 2511, 2512, which mutually support horizontal member 2521. Angle selector 2531 is mounted on horizontal member 2521, and comprises a plurality of holes 2541 that can select and secure an angle for receiver 2533 using key 2532. Receiver 2533 is adapted to receive any suitable device, such as, for example, a floating pulley or a longitudinal member of a multi-use exerciser. Apparatus 2500 can further comprise weight stacks, cables, exercise attachment points, and floating pulleys, among other things, as described herein.

Figure 26:
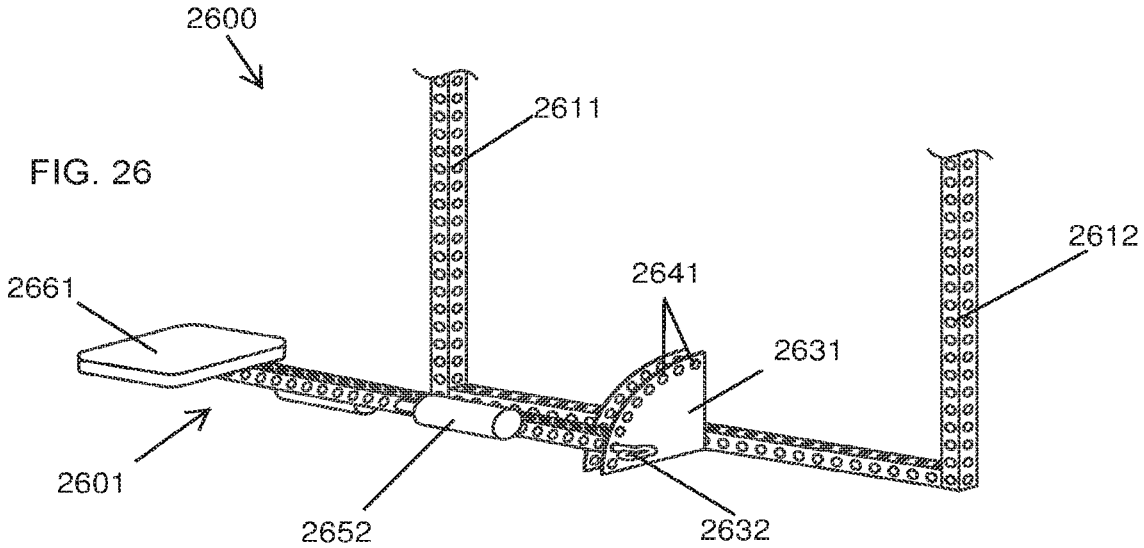
FIGS. 26 and 27 depict apparatus 2600 comprising multi-use exerciser 2601.
Figure 27:
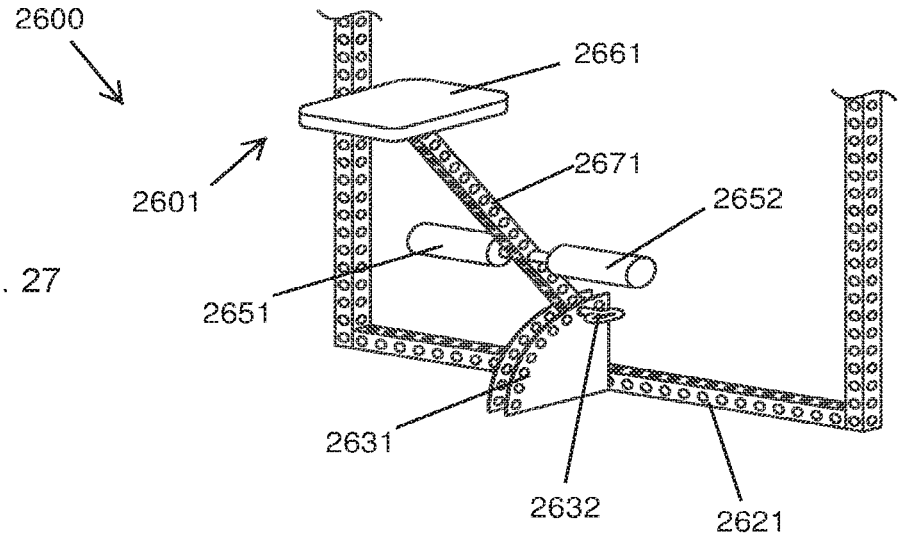

FIGS. 26 and 27 depict apparatus 2600 comprising multi-use exerciser 2601. Apparatus 2600 comprises vertical members 2611, 2612, mutually supporting horizontal member 2621, which could form part of the door of the frame of apparatus 2600. Multi-use exerciser 2601 comprises an angle selector 2631 supporting a longitudinal member 2671, wherein longitudinal member 2671 anchors opposing ankle braces 2651, 2652 proximal to angle selector 2631, and further supporting a multi-use pad 2661 distal from the angle selector 2631. Angle selector 2631 comprises a plurality of holes 2641 that can select and secure an angle for multi-use exerciser 2601 using key 2632. Multi-use pad 2661 can adopt any suitable angle; in these figures, it is shown in a substantially-horizontal position to receive an athlete who would engage ankle braces 2651, 2652 to perform crunches while facing apparatus 2600, or back extensions while facing away from apparatus 2600. Alternatively, multi-use pad 2661 can be secured in an angle differing from the horizontal to support a bicep curl exercise, for example. When not in use, multi-use exerciser 2601 can be stowed so that longitudinal member 2671 is substantially parallel with vertical member 2611, for example, or longitudinal member 2671 can be removed from angle selector 2631, and stowed elsewhere, such as at another convenient location within apparatus 2600. Apparatus 2600 can comprise weight stacks, cables, exercise attachment points, and floating pulleys, among other things, as described herein.

Figure 28:
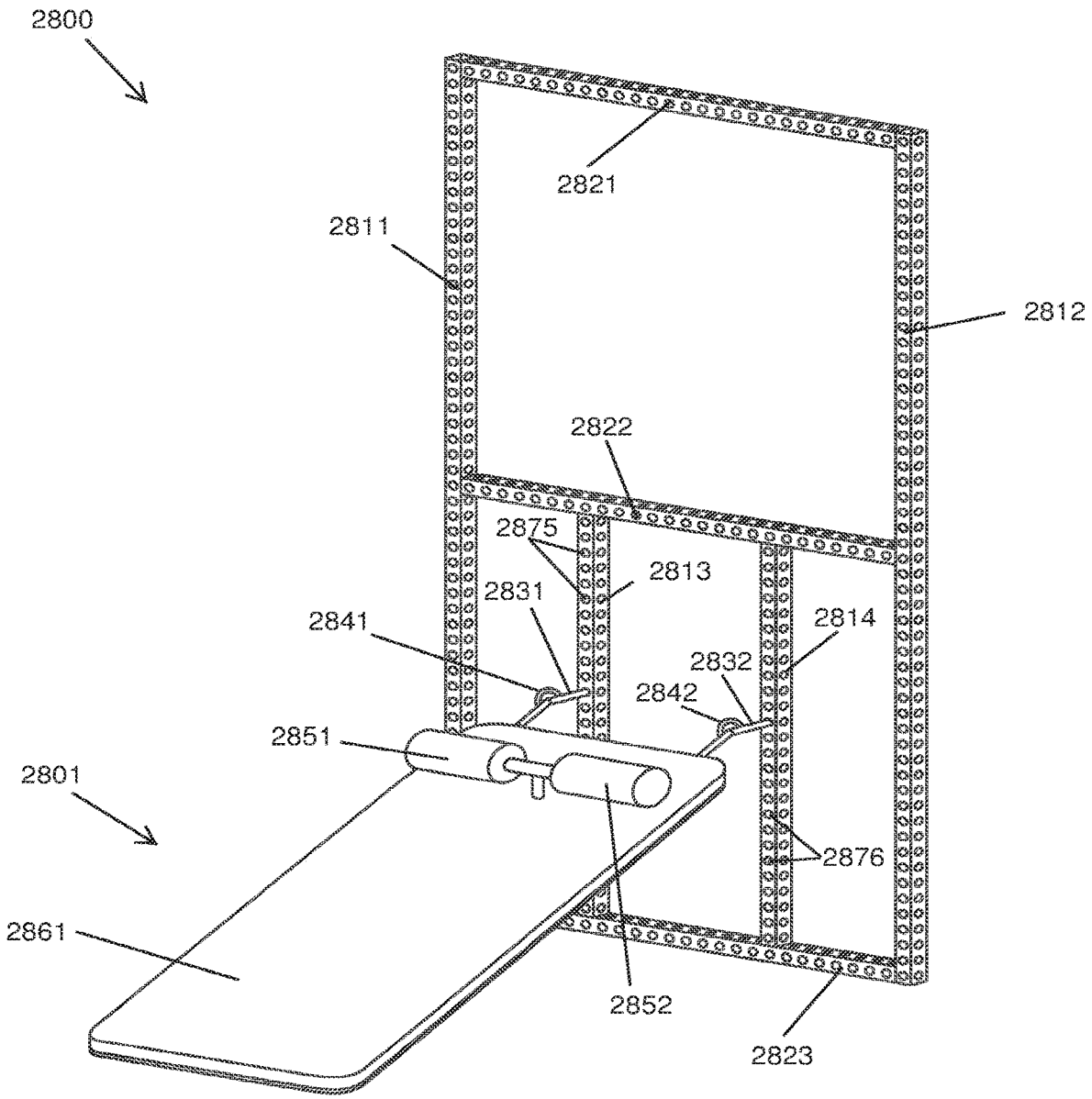
FIG. 28 depicts apparatus 2800 comprising sit-up board 2801.

FIG. 28 depicts apparatus 2800 comprising sit-up board 2801. Apparatus 2800 comprises vertical members 2811, 2812, 2813, 2814 mutually supporting horizontal members 2821, 2822, 2823. Optionally, vertical members 2811, 2812, 2813, 2814 and horizontal members 2821, 2822, and 2823 could form a door of the frame of apparatus 2800. Sit-up board 2801 comprises padded board 2861 mounting foot braces 2851, 2852, and pins 2831, 2832, which engage the accessory receiving ports 2875, 2876 of vertical members 2813, 2814, respectively. Pins 2831, 2832 comprise hinges 2841, 2842, respectively, to facilitate incline angle selection of sit-up board 2801. Sit-up board 2801 can allow for a variety of exercises beyond sit ups. For example, floating pulleys removably and adjustably attached to any of vertical members 2811, 2812, 2813, and 2814 and horizontal members 2821, 2822, and 2823 can allow an athlete lying on sit-up board 2801 to engage the weight stacks of apparatus 2800 and perform various exercises against a resistance while executing a crunch motion or while holding crunch posture. For example, one foot can engage one of foot braces 2851, 2852, while the other foot can pull a weight from the weight stack via a floating pulley and ankle strap (not shown), all while the athlete touches an opposing elbow to the knee of the foot pulling the weight. Apparatus 2800 can comprise weight stacks, cables, exercise attachment points, and floating pulleys, among other things, as described herein.

Figure 29:
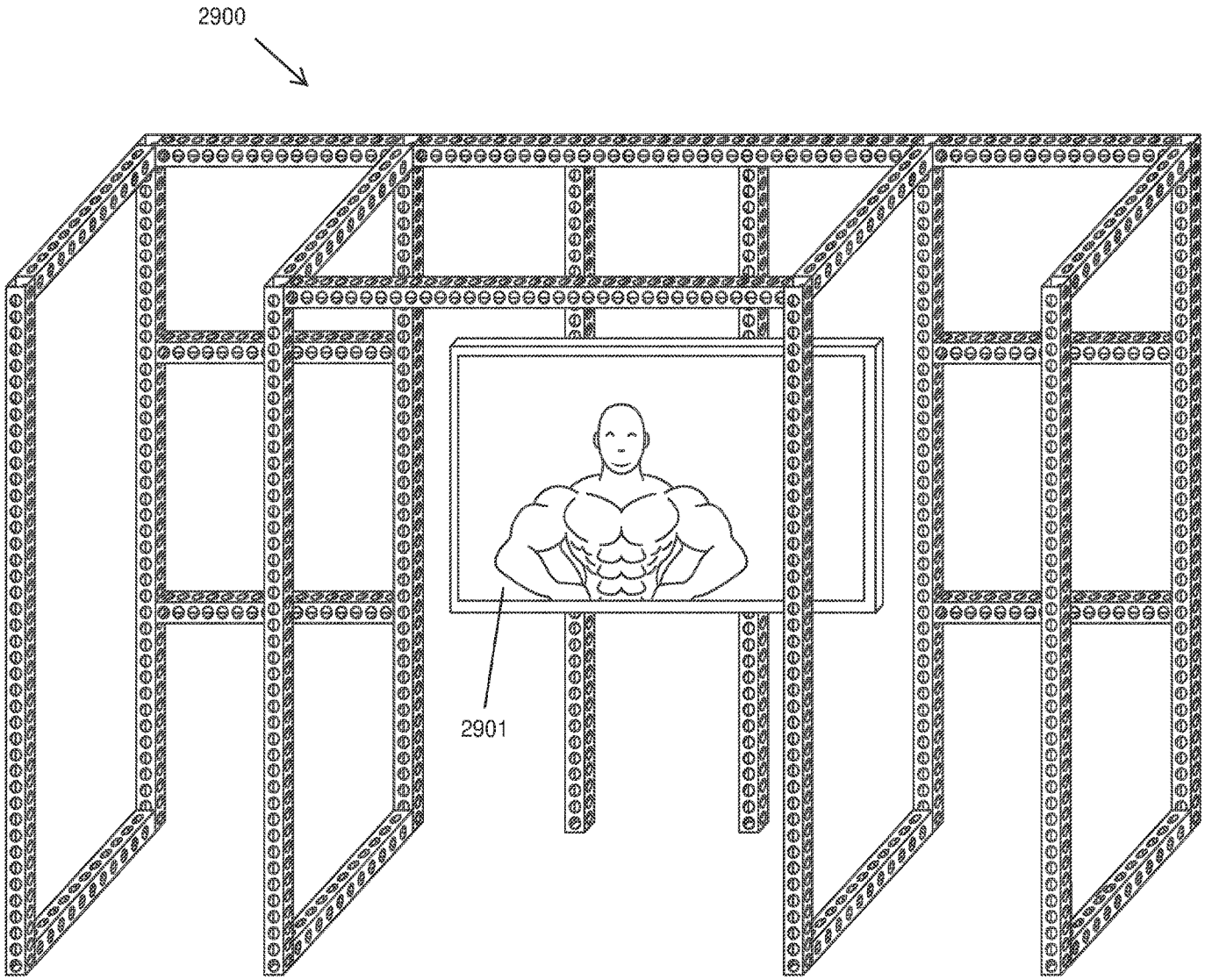
FIG. 29 depicts apparatus 2900 comprising flat-screen TV 2901.

FIG. 29 depicts apparatus 2900 comprising flat-screen television 2901. Apparatus 2900 can comprise weight stacks, cables, exercise attachment points, and floating pulleys, among other things, as described herein.

Figure 30:
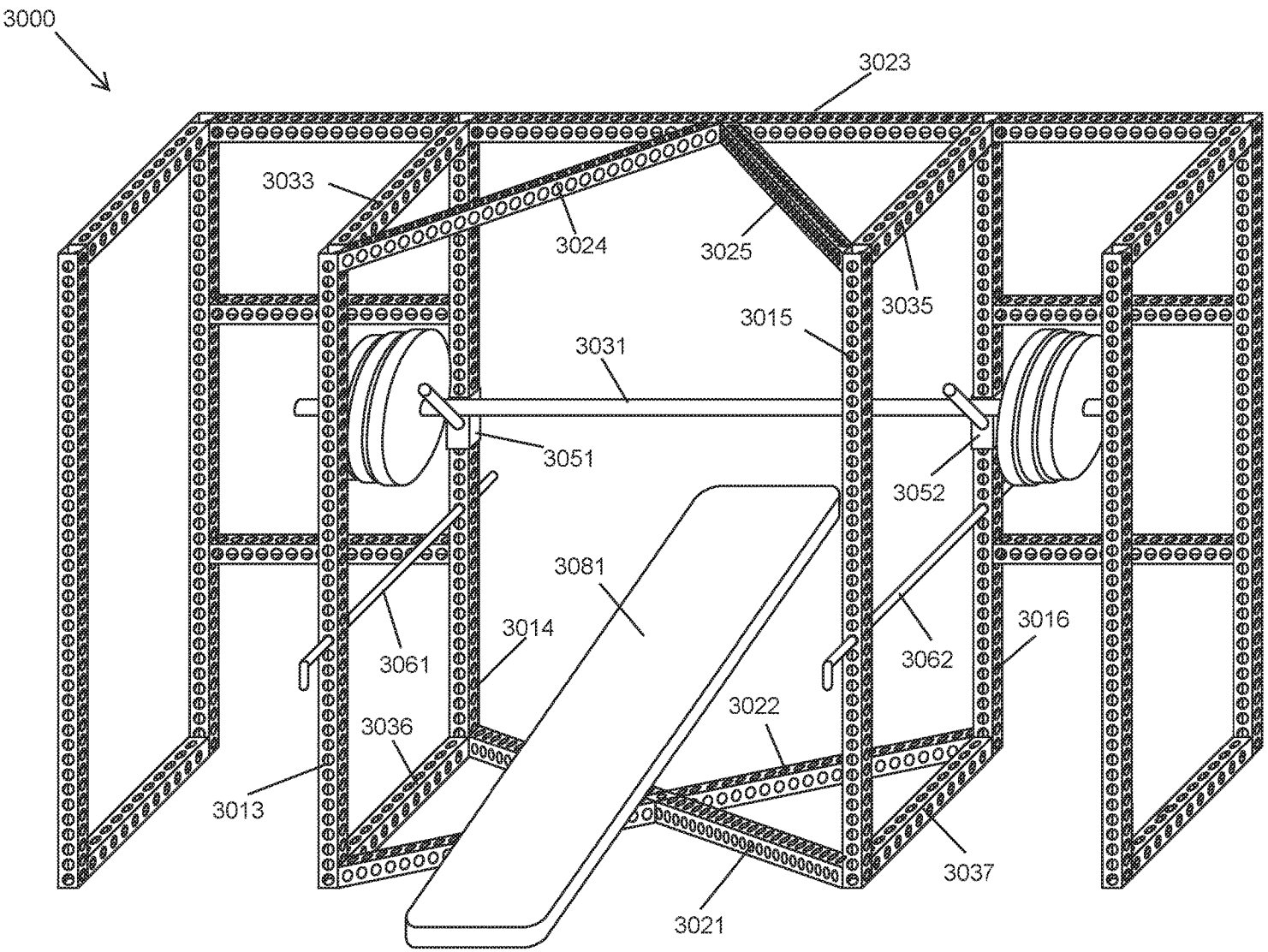
FIG. 30 provides a perspective view of apparatus 3000.

FIG. 30 provides a perspective view of apparatus 3000. Apparatus 3000 illustrates a power rack for receiving at least one barbell 3031 for the performance of at least one exercise with the barbell 3031. Vertical members 3013, 3014, 3015, and 3016 (and others) mutually support horizontal members 3021, 3022, 3023, 3024, 3025, 3033, 3035, 3036, and 3037 (and others) to form a frame for apparatus 3000. Each vertical member and each horizontal member of apparatus 3000 is depicted with accessory receiving ports (unlabeled) substantially along the entire length of each member. Rack accessories 3051, 3052 are removably attached to vertical members 3014 and 3016, respectively, and hold barbell 3031. Rod 3061 is positioned between vertical members 3013 and 3014 to protect an athlete exercising with barbell 3031; similarly, rod 3062 is positioned between vertical members 3015 and 3016 for the same purpose. Bench 3081 appears in one possible position that supports exercises using barbell 3031. Apparatus 3000 can further comprise weight stacks, cables, exercise attachment points, and floating pulleys, among other things, as described herein.

Figure 31:
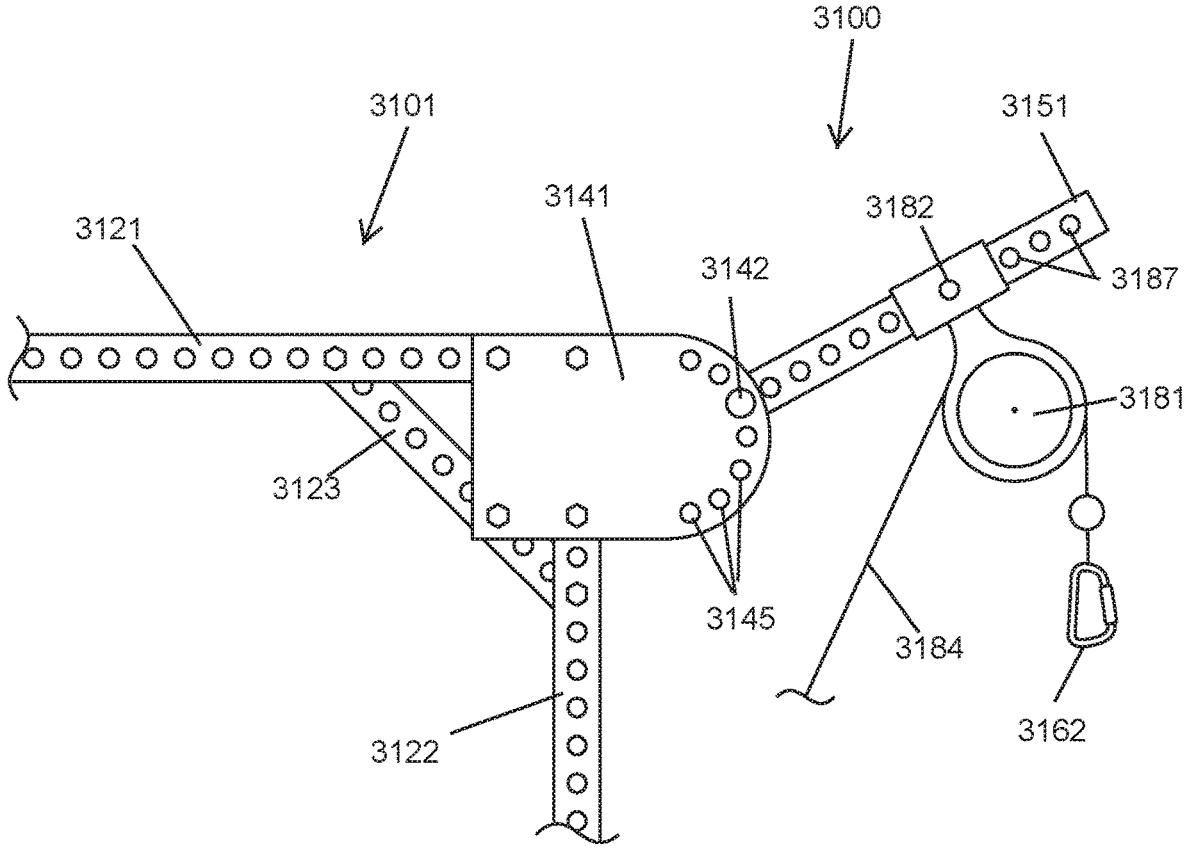
FIG. 31 depicts a right-side elevation view of extension arm 3100.

FIG. 31 depicts a right-side elevation view of extension arm 3100. Extension arm 3100 comprises angular selection bracket 3141, which appears in FIG. 31 to be bolted to horizontal member 3121, vertical member 3122, and diagonal member 3123 of apparatus 3101. Angular selection bracket 3141 further comprises a plurality of angle selection ports 3145. Angular selection bracket 3141 attaches extension arm 3100 to apparatus 3101. Knob 3142 operates a spring-loaded pin (not shown) that secures extension member 3151 at any one of a plurality of extension angles. Each extension angle, defined between vertical member 3122 and extension member 3151 can be selected by manipulating knob 3142 relative to the several angle selection ports 3145. Extension member 3151 extending from angular selection bracket 3141 comprises a plurality of extension receiving ports 3187. Floating pulley 3181, comprising extension cable 3184 ending at carabiner 3162, is removably and adjustably attached to extension arm 3151 by manipulating knob 3182, which operates another spring-loaded pin (not shown). It can be said that carabiner 1362 represents both a floating exercise attachment point and an extension exercise attachment point in this embodiment.

Figure 32:
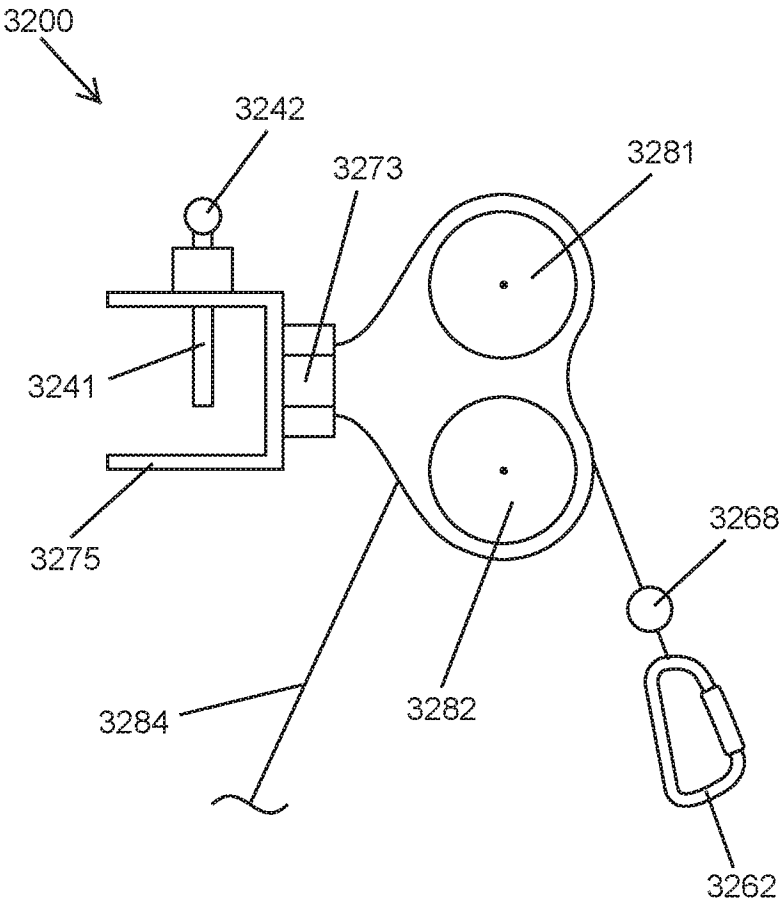
FIG. 32 depicts floating pulley 3200.

FIG. 32 depicts floating pulley 3200. Floating pulley 3200 comprises two pulley wheels 3281, 3282. Floating pulley 3200 further comprises brace 3275, which houses knob 3242, which in turn operates spring-loaded pin 3241. Spring-loaded pin 3241 can engage an accessory receiving port. It can be said that floating pulley 3200 has an accessory engagement structure comprising brace 3275, knob 3242, and spring-loaded pin 3241 for removably and adjustably coupling to an accessory receiving port on an apparatus. Floating pulley 3200 further comprises extension cable 3284 passing between pulley wheels 3281, 3282, and terminating at a second end with carabiner 3262. Pulley stop 3268 prevents extension cable 3284 from exiting floating pulley 3200. Hinge 3273 allows floating pulley wheels 3281, 3282 to swing back and forth (in this case, into and out of the plane of the page). Any suitable exercise equipment, such as, for example, a hand grip, ankle strap, torso strap, head strap, barbell, dumbbell, or the like, or a multivector extension device as described herein, can be attached to carabiner 3262. Sometimes, if desirable, a further extension cable and a further floating pulley can be attached to carabiner 3262 for maximum flexibility in designing further exercises.

Figure 33:
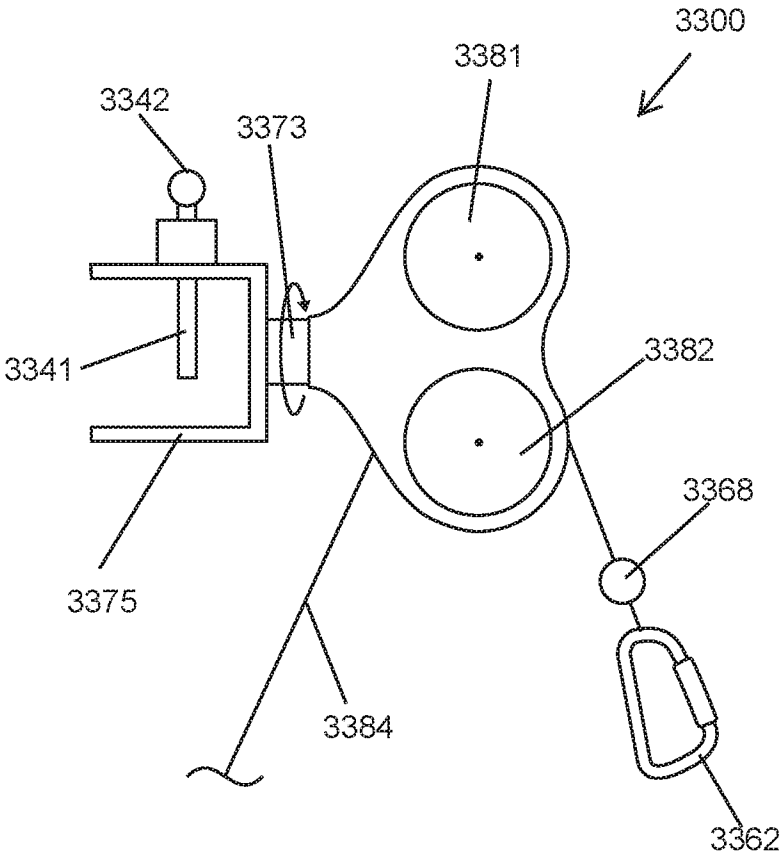
FIG. 33 depicts floating pulley 3300.

FIG. 33 depicts floating pulley 3300. Floating pulley 3300 comprises two pulley wheels 3381, 3382. Floating pulley 3300 further comprises brace 3375, which houses knob 3342, which in turn operates spring-loaded pin 3341. Spring-loaded pin 3341 can engage an accessory receiving port. It can be said that floating pulley 3300 has an accessory engagement structure comprising brace 3375, knob 3342, and spring-loaded pin 3341 for removably and adjustably coupling to an accessory receiving port on an apparatus. Floating pulley 3300 further comprises extension cable 3384 passing between pulley wheels 3381, 3382 and terminating at a second end with carabiner 3362. Pulley stop 3368 prevents extension cable 3384 from exiting floating pulley 3300. Pivot 3373 allows floating pulley wheels 3381, 3382 to rotate up to 360 degrees (in this case, into and out of the plane of the page). Any suitable exercise equipment, such as, for example, a hand grip, ankle strap, torso strap, head strap, barbell, dumbbell, or the like, or a multivector extension device as described herein, can be attached to carabiner 3362. Sometimes, if desirable, a further extension cable and a further floating pulley can be attached to carabiner 3362 for maximum flexibility in designing further exercises.

Figure 34:
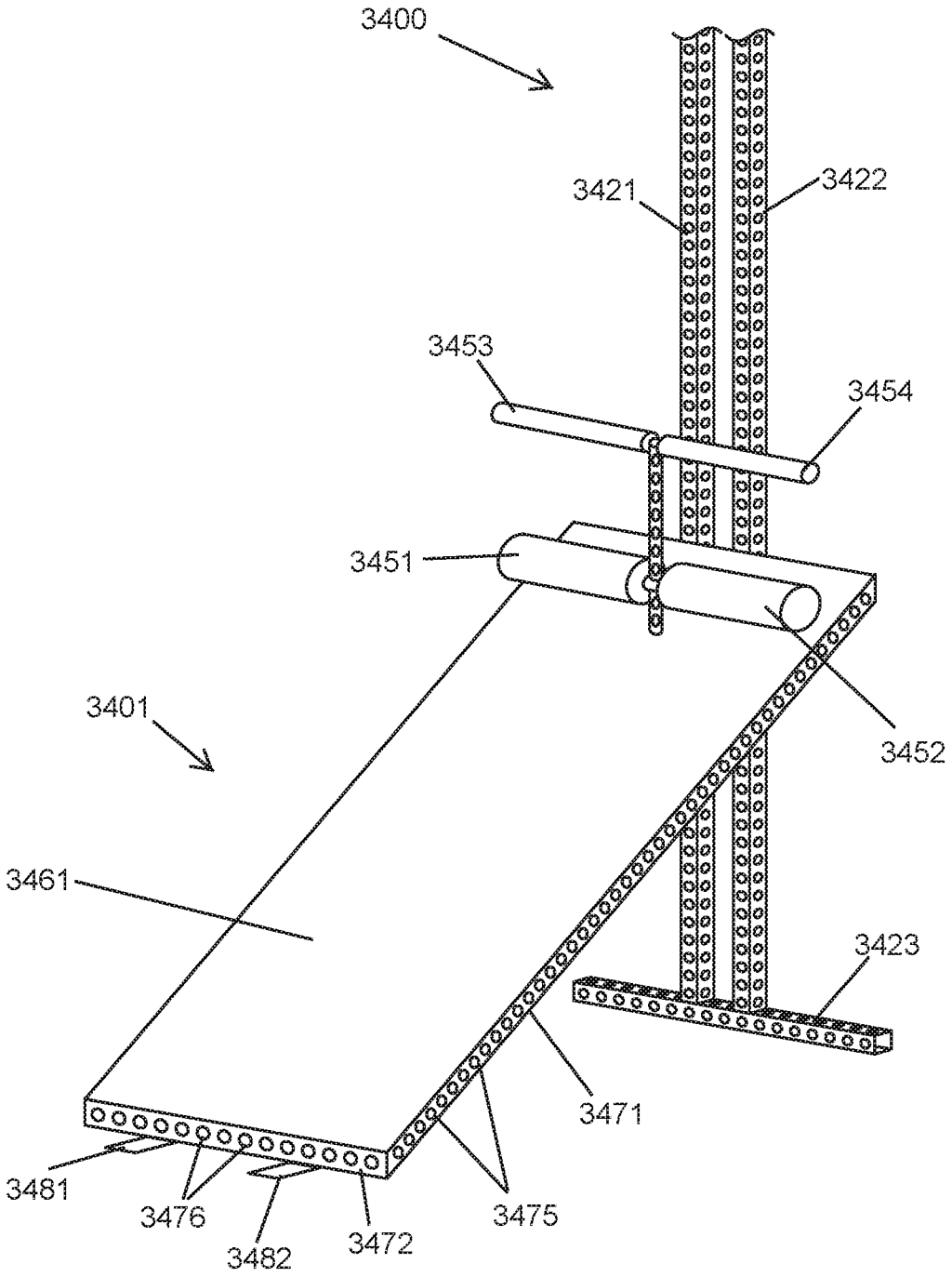
FIG. 34 depicts apparatus 3400 comprising sit-up board 3401.

FIG. 34 depicts apparatus 3400 comprising sit-up board 3401. Apparatus 3400 comprises vertical members 3421 and 3422 mutually supporting horizontal member 3423. Optionally, vertical members 3421, 3422 and horizontal member 3423 could form a door of the frame of apparatus 3400. Sit-up board 3401 comprises padded board 3461 mounting foot braces 3451, 3452, hand grips 3453, 3454, and pins (not seen) that engage the accessory receiving ports of vertical members 3421, 3422, respectively. Sit-up board 3401 further comprises a longitudinal member 3471 and lateral member 3472 supporting padded board 3461. Longitudinal member 3471 comprises a plurality of sit-up board accessory receiving ports 3475. Lateral member 3472 comprises a plurality of sit-up board accessory receiving ports 3476. Sit-up board 3401 further comprises footers 3481, 3482 for stabilizing sit-up board 3401. Sit-up board 3401 can allow for a variety of exercises beyond sit ups. For example, floating pulleys removably and adjustably attached to any of longitudinal member 3471 and lateral member 3472 via sit-up board accessory receiving ports 3475, 3476, respectively can allow an athlete lying on sit-up board 3401 to engage the weight stacks of apparatus 3400 and perform various exercises against a resistance while executing a crunch motion or while holding crunch posture. For example, the feet can engage foot braces 3451, 3452, while one or both hands can pull a weight from the weight stack via a floating pulley and ankle strap (not shown), all while the athlete performs a sit up or crunch exercise. Apparatus 3400 can comprise weight stacks, cables, exercise attachment points, and floating pulleys, among other things, as described herein.

Figure 35:
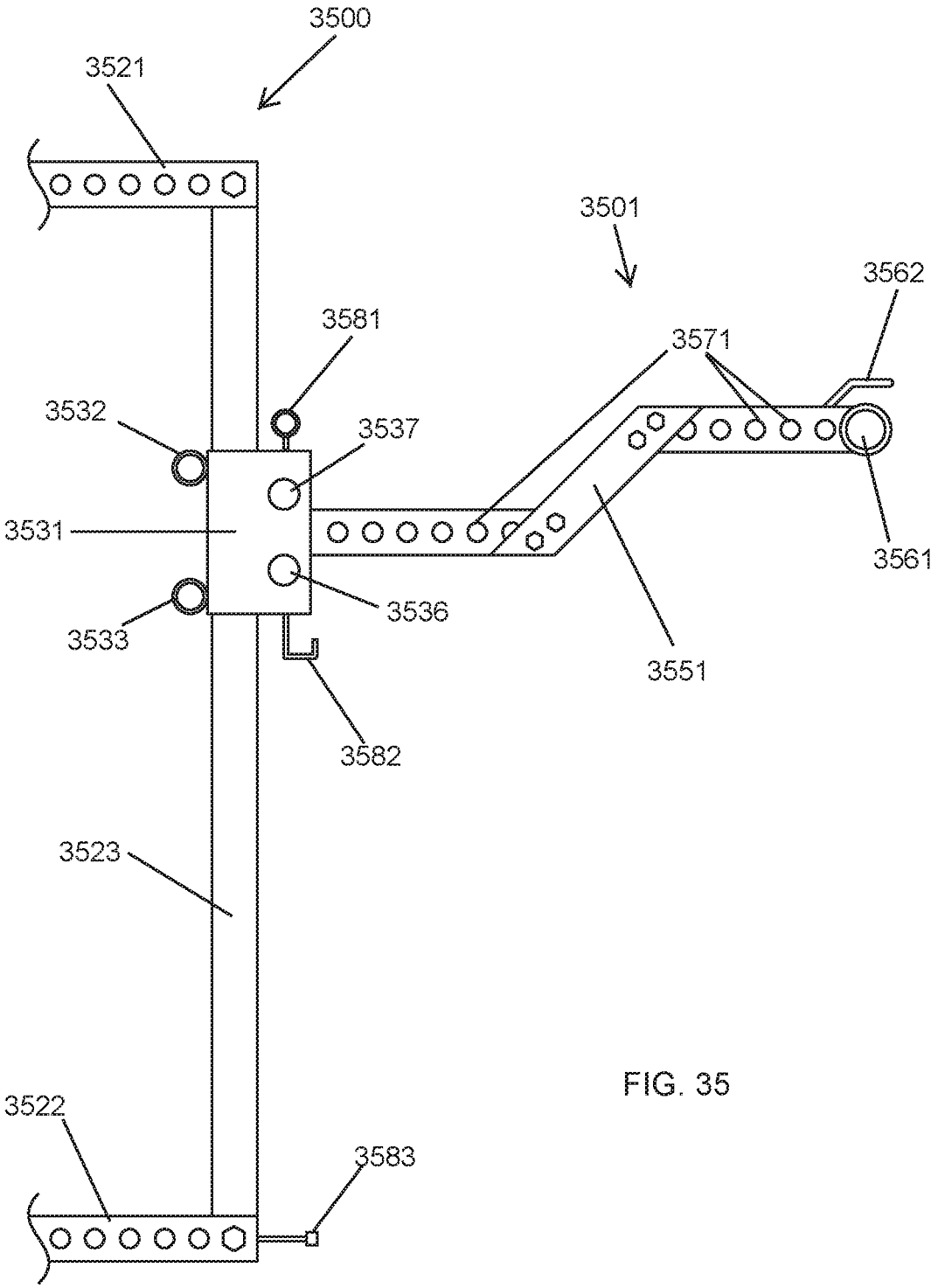
FIG. 35 provides a right-side elevation view of gliding extension device 3501.

FIG. 35 provides a right-side elevation view of gliding extension device 3501. The gliding extension device 3501 comprises a roller carriage 3531 that houses rollers 3532, 3533, 3536, 3537, which glidingly engage guide rod 3523. Extension frame 3551 of gliding extension device 3501 extends from roller carriage 3531 at its proximal end to the distal end having exercise engagement device 3561, which is a single hand grip, and brake lever 3562. Extension frame 3551 further comprises a plurality of extension receiving ports 3571 for providing one or more extension exercise attachment points with the deployment of a floating pulley (not shown). Roller carriage 3531 further comprises exercise attachment point receiver 3581, which is an eye bolt suitable for receiving a carabiner from an exercise attachment point or a floating exercise attachment point, for example. Roller carriage 3531 further comprises elastic band receiver 3582, which is a J-hook for receiving an elastic band (not shown). Such an elastic band can further engage elastic band anchor 3583, which attaches to horizontal member 3522. Guide rod 3523 is supported by horizontal members 3521, 3522 of apparatus 3500. Optionally, a vertical member parallel to guide rod 3523 can support or assist the use of gliding extension device 3501, for example, by providing anchor points for a break mechanism. In gliding extension device 3501, brake lever 3562 releases a braking clamp (not shown) at the roller carriage to allow the gliding extension device 3501 to move. In general, a braking clamp can arrest the movement of a roller, more than one roller, the guide rod, or combinations thereof. In addition, a break mechanism can insert a spring-loaded pin into one of a series of slots, optionally along the guide rod, or one of a series of accessory receiving ports along a member of the frame of apparatus 3500 that runs parallel to guide rod 3523. The several possible brake mechanisms can be designed to immobilize the gliding extension device 3501 for the safety and convenience of an athlete using it.

Figure 36:
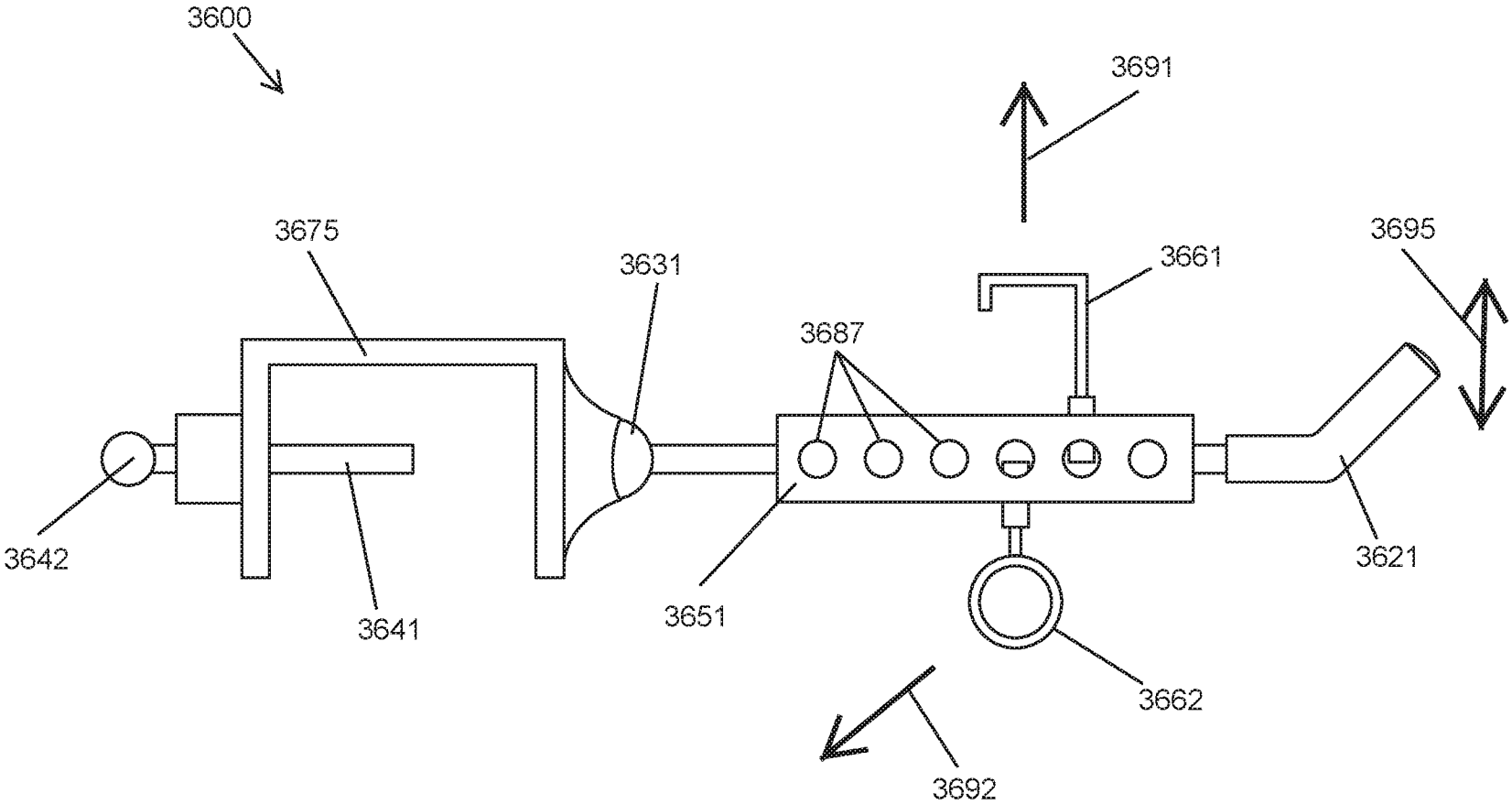
FIG. 36 provides a perspective view of multivector extension device 3600.

FIG. 36 provides a perspective view of multivector extension device 3600. Multivector extension device 3600 comprises brace 3675 for removably and adjustably attaching device 3600 to a frame of an apparatus (not shown). Brace 3675 comprises knob 3642, which manipulates spring-loaded pin 3641. Multivector extension arm 3651 comprises a plurality of accessory receiving ports 3687, and attaches to brace 3675 via a ball joint 3631. Ball joint 3631 allows multivector extension arm 3651 significant freedom of movement relative to brace 3675. Ball joints 3631 can be made of any suitable materials. For example, multivector extension arm can terminate at ball joint 3631 with a steel core surrounded by a spherical polytetrafluoroethylene or Teflon® ball. Alternatively, ball joint 3631 can comprise steel lubricated with a suitable grease chosen from, for example, high molecular weight alkanes or silicone greases. Single hand grip 3621, which is an exercise engagement device, attaches to the multivector extension arm 3651 via an accessory receiving port (not seen). J-hook 3661 for receiving an elastic band (not shown) is an exercise attachment point receiver, and is attached to multivector extension arm 3651 via an accessory receiving port 3687. Eye bolt 3662 for receiving a carabiner that selectively connects ultimately to a weight stack of an apparatus (not shown), and is an exercise attachment point receiver attached to multivector extension arm 3651 via an accessory receiving port 3687.

To illustrate multivector exercise, FIG. 36 shows first vector 3691, which depicts the direction of resistance of an elastic band attached to exercise attachment point receiver (J-hook) 3661. Second vector 3692 depicts the direction of resistance provided by a weight stack connected via carabiner through an exercise attachment point or a floating exercise attachment point (not shown). Exercise direction 3695 depicts the up-and-down motion of the desired exercise. An athlete, in this example, would grasp single hand grip 3621 and pull down against the resistance provided by the elastic band at J-hook 3661. However, the resistance provided by the weight stack at eye bolt 3662 would force the athlete to use additional effort to stabilize the multivector extension device 3600 against the resistance along vector 3692. This additional effort can help the athlete strengthen the shoulder, elbow, and hand joints in a manner not possible if the only resistance was provided by the elastic band along vector 3691. Any number of resistances can be applied, and the athlete is limited only by imagination. Of course, opposing resistances will cancel each other; but it should be noted that the relative orientation of the vectors likely will change as the exercise motion continues. In other words, the relative orientation (and magnitude, in the case of an elastic band) of the vectors 3691, 3692 will change as single hand grip 3621 is moved through exercise motion 3695.

Figure 37:
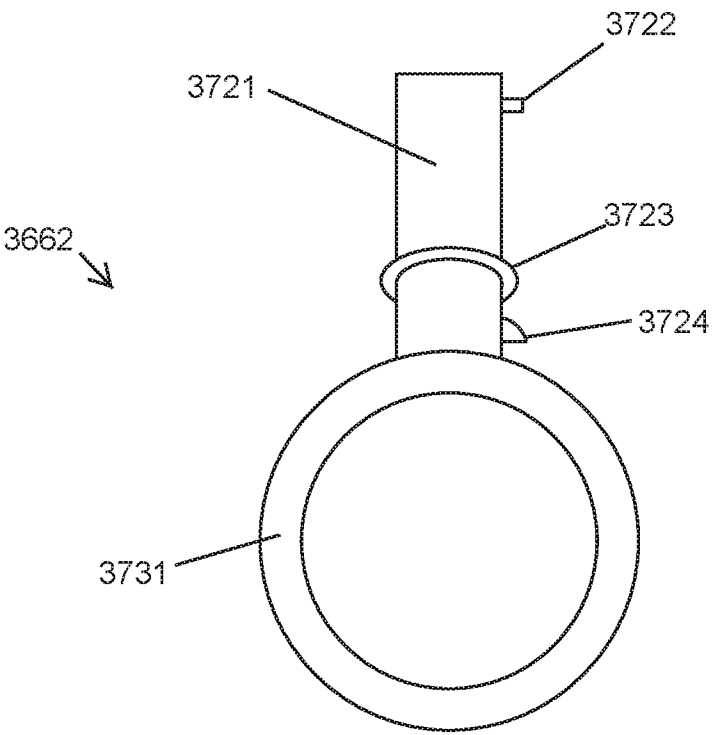
FIG. 37 depicts eye bolt 3662.

FIG. 37 depicts eye bolt 3662. Eye bolt 3662 comprises ring 3731 anchored to shaft 3721 which is inserted into an accessory receiving port (not shown). To secure shaft 3721 in an accessory receiving port, shaft 3721 comprises spring-loaded pin 3722, which is activated (withdrawn into shaft 3721) by lever 3724. Collar 3723 protects lever 3724 from inadvertent engagement by the accessory receiving port during an exercise.

Figure 38:
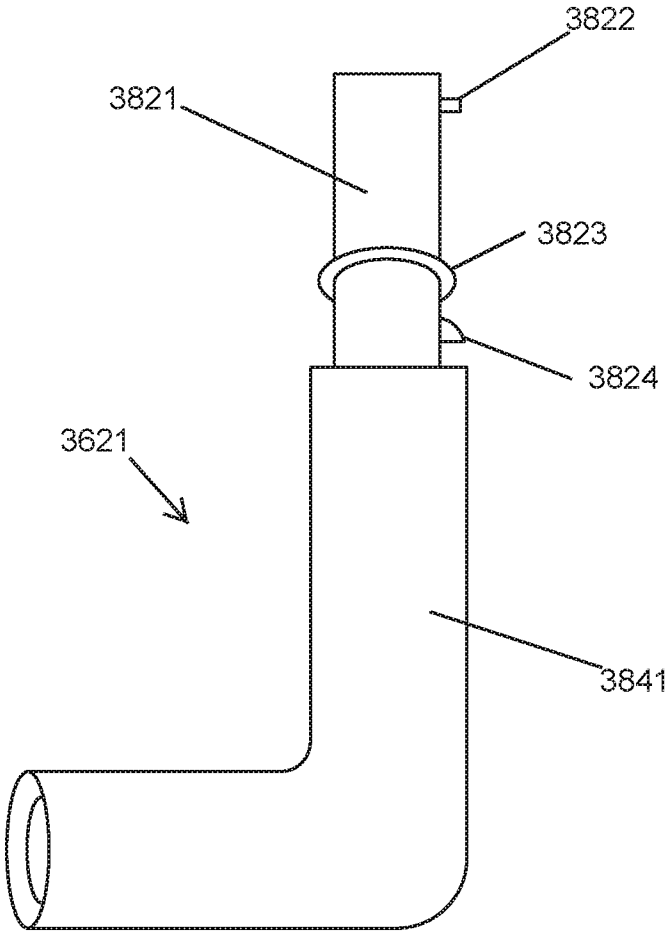
FIG. 38 depicts hand grip 3621.

FIG. 38 depicts hand grip 3621. Hand grip 3621 comprises foam gripping portion 3841 anchored to shaft 3821 which is inserted into an accessory receiving port (not shown). To secure shaft 3821 in an accessory receiving port, shaft 3821 comprises spring-loaded pin 3822, which is activated (withdrawn into shaft 3821) by lever 3824. Collar 3823 protects lever 3824 from inadvertent engagement by the accessory receiving port during an exercise.

Figure 39:
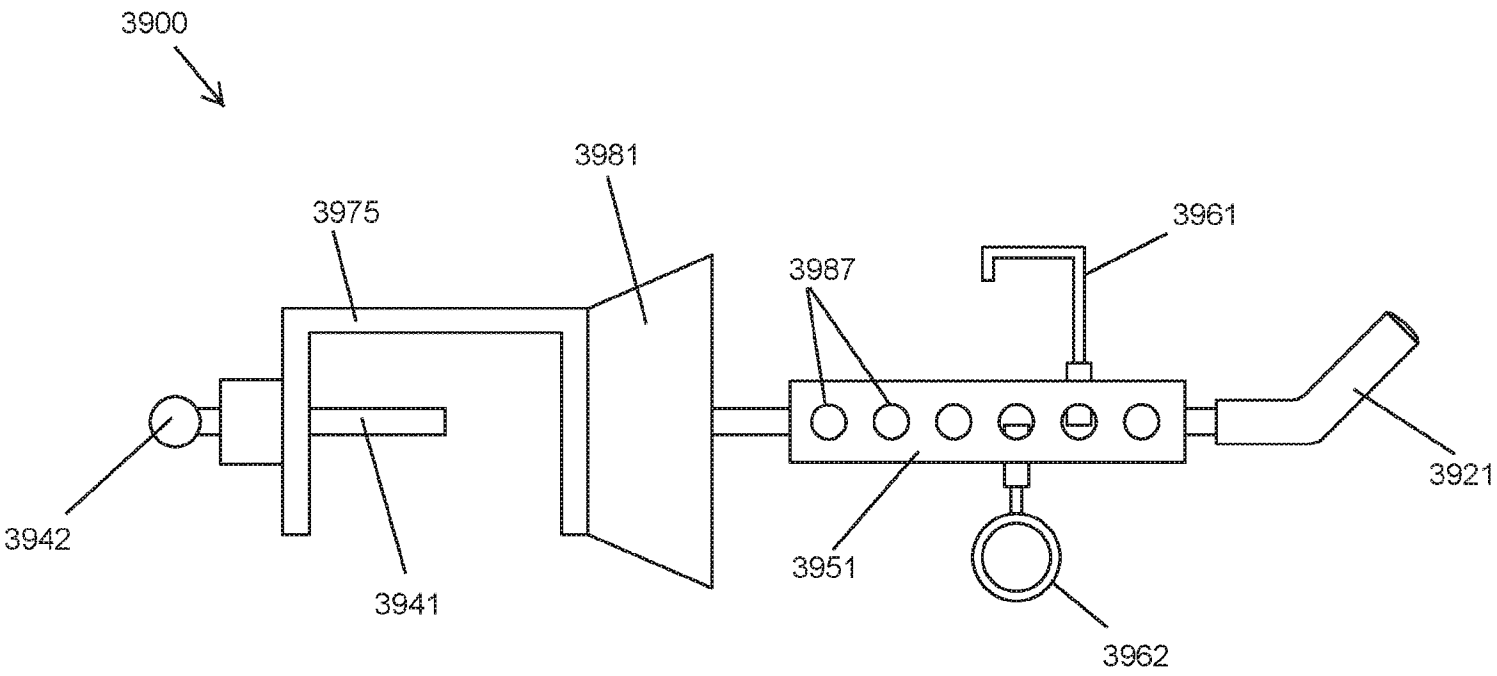
FIGS. 39 and 44 provide a right-side view of multivector extension device 3900.
Figure 44:
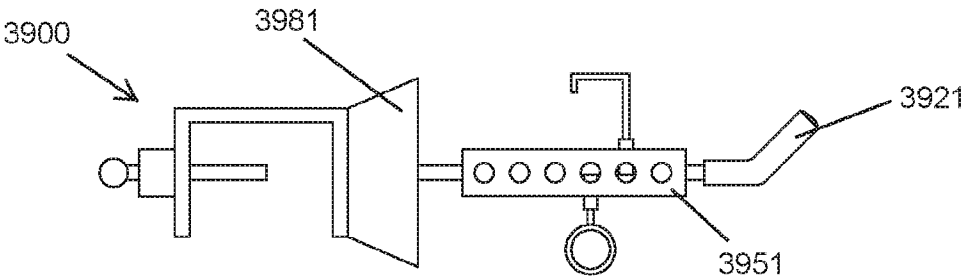

FIGS. 39 and 44 provide a right-side view of multivector extension device 3900 further comprising a support cone 3981. Multivector extension device 3900 comprises brace 3975 for removably and adjustably attaching device 3900 to a frame of an apparatus (not shown). Brace 3975 comprises knob 3942, which manipulates spring-loaded pin 3941. Multivector extension arm 3951 comprises a plurality of accessory receiving ports 3987, and attaches to brace 3975 via a ball joint (not seen). Single hand grip 3921, which is an exercise engagement device, attaches to the multivector extension arm 3951 via an accessory receiving port (not seen). J-hook 3961 for receiving an elastic band (not shown) is an exercise attachment point receiver, and is attached to multivector extension arm 3951 via an accessory receiving port 3987. Eye bolt 3962 for receiving a carabiner that selectively connects ultimately to a weight stack of an apparatus (not shown), is an exercise attachment point receiver attached to multivector extension arm 3951 via an accessory receiving port 3987. Support cone 3981 is positioned about the ball joint (not seen) to protect the frame (not shown) from contact by multivector extension arm 3951. Operating multivector extension device 3900 is similar to the operation of multivector extension device 3600, as shown in FIG. 36.

Figure 40:
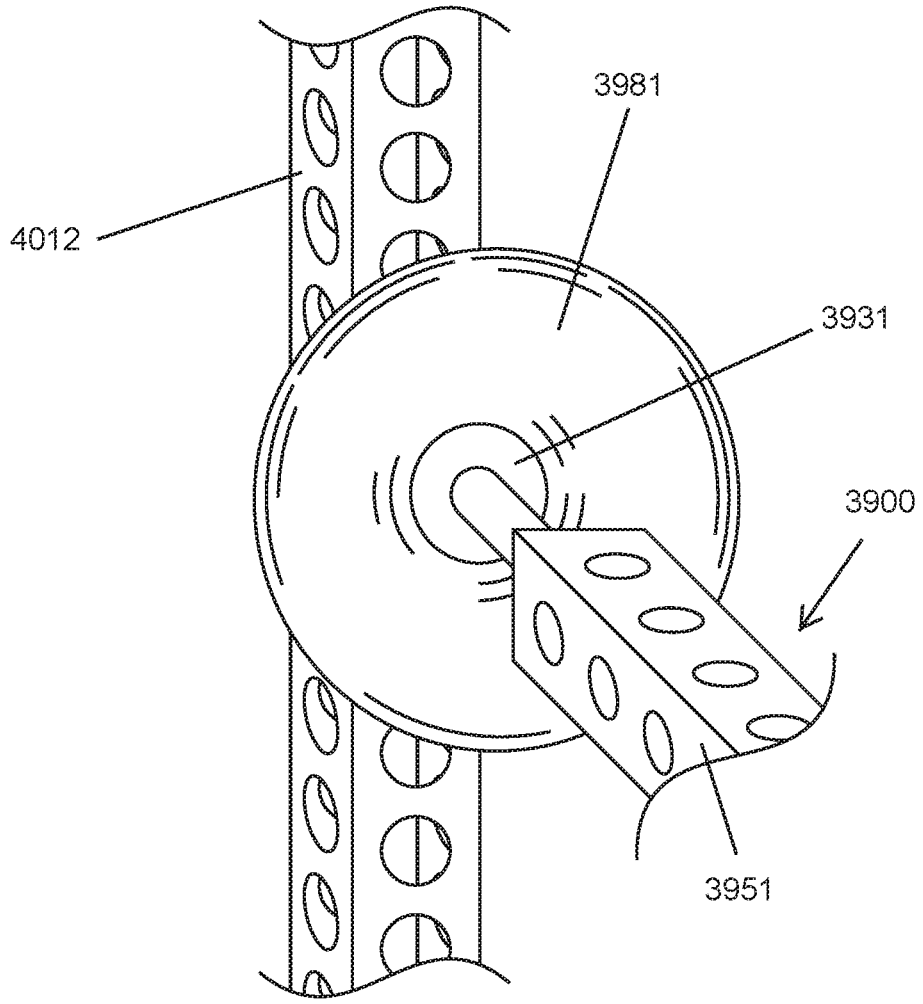
FIG. 40 provides a partial perspective view demonstrating how support cone 3981 of multivector extension device 3900 protects frame member 4012 from contact by multivector extension arm 3951.

FIG. 40 provides a partial perspective view demonstrating how support cone 3981 of multivector extension device 3900 protects frame member 4012 from contact by multivector extension arm 3951. Ball joint 3931, which joins multivector extension arm 3951 to brace 3975 (seen in FIG. 39), appears in FIG. 40. When multivector extension device is attached to frame member 4012, support cone 3981 is positioned about ball joint 3931 to keep multivector extension arm 3951 from contacting frame 4012.

Figure 41:
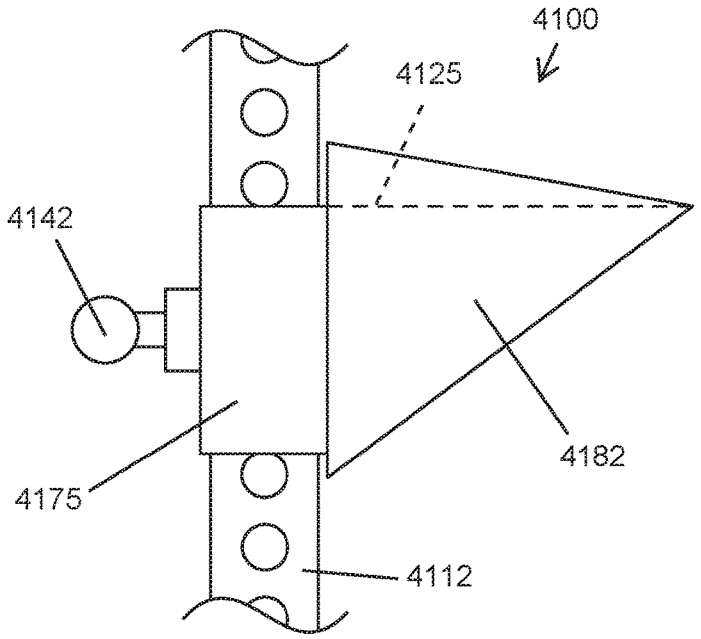
FIG. 41 shows a right-side view.
Figure 42:
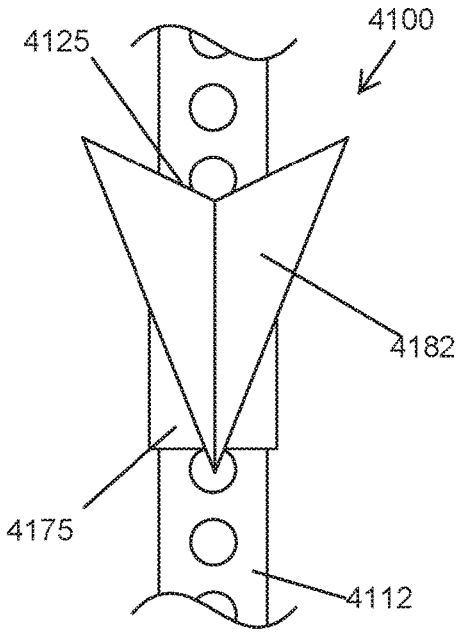
FIG. 42 shows a front view, of multivector extension support 4100.

FIG. 41 shows a right-side view, and FIG. 42 shows a front view, of multivector extension support 4100. Multivector extension support 4100 comprises brace 4175 for removably and adjustably attaching to frame member 4112 of an apparatus for exercising against a resistance. Brace 4175 comprises a spring-loaded pin manipulated by knob 4142 for engaging frame member 4112. Multivector extension support 4100 also comprises resilient support 4182 attached to brace 4175 for receiving and protecting frame number 4112 from contact by a multivector extension device (not shown). Resilient support 4182 defines recess 4125 for receiving the multivector extension device.

Figure 43:
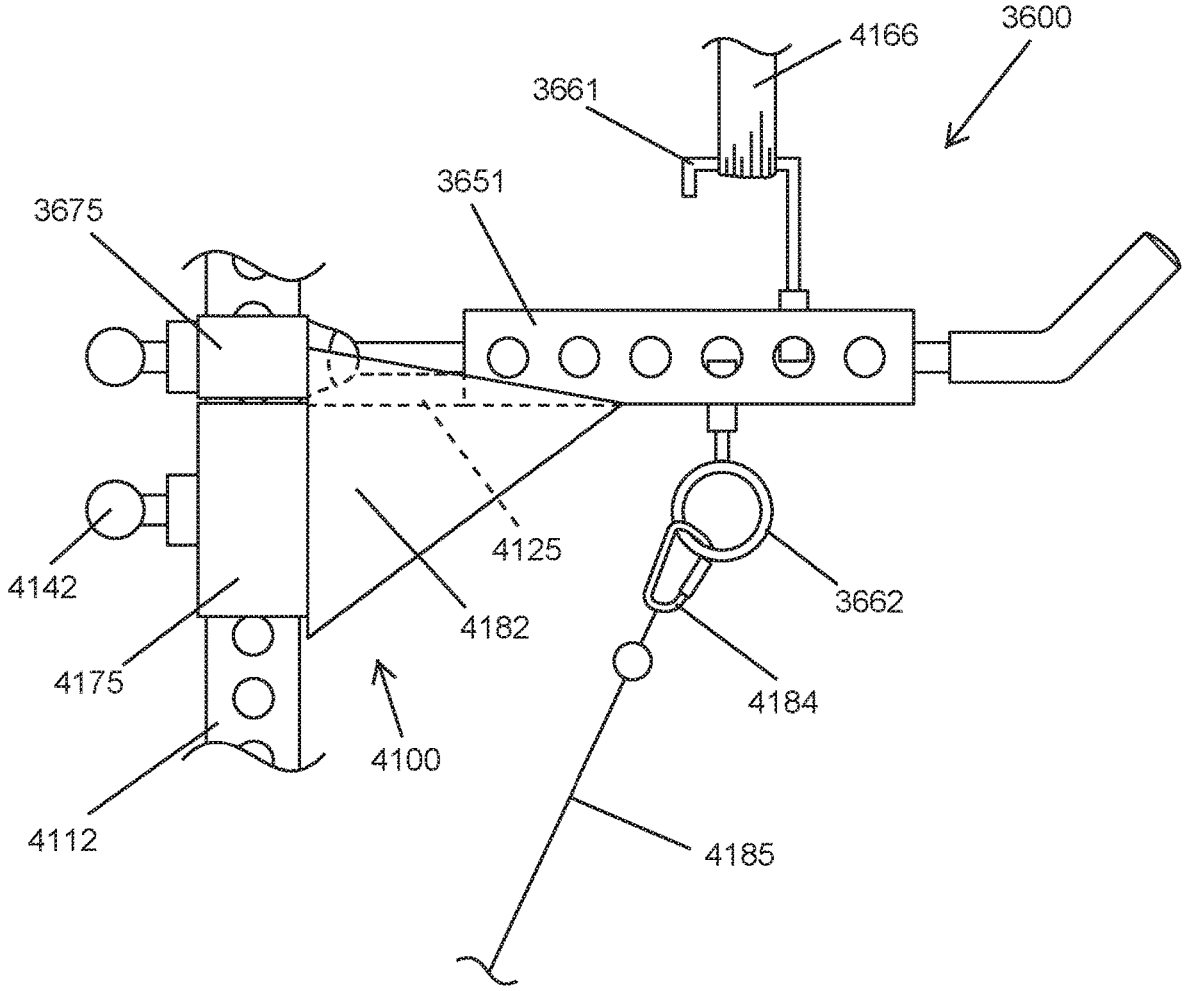
FIG. 43 shows a right-side view of multivector extension device 3600 in operation with multivector extension support 4100.

FIG. 43 shows a right-side view of multivector extension device 3600 in operation with multivector extension support 4100. Multivector extension arm 3651 fits into recess 4125 defined by resilient support 4182 of multivector extension support 4100. Also seen in FIG. 43, elastic band 4166 engages J-hook 3661 of multivector extension device 3600. Carabiner 4184 connects cable 4185 and a weight stack (not shown) to eye bolt 3662. Elastic band 4166 and cable 4185 apply different vectors of resistance to multivector extension arm 3651 (see vectors 3691 and 3692 in FIG. 36). Multivector extension support 4100 can help locate multivector extension device 3600 in between sets, and prevent contact between multivector extension arm 3651 and frame member 4112.

Figure 45:
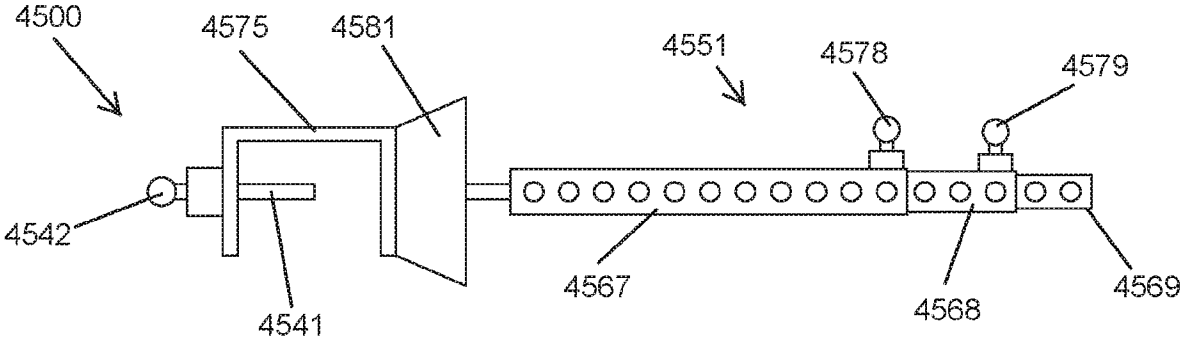
FIGS. 45 and 46 provide a right-side view of multivector extension device 4500.
Figure 46:
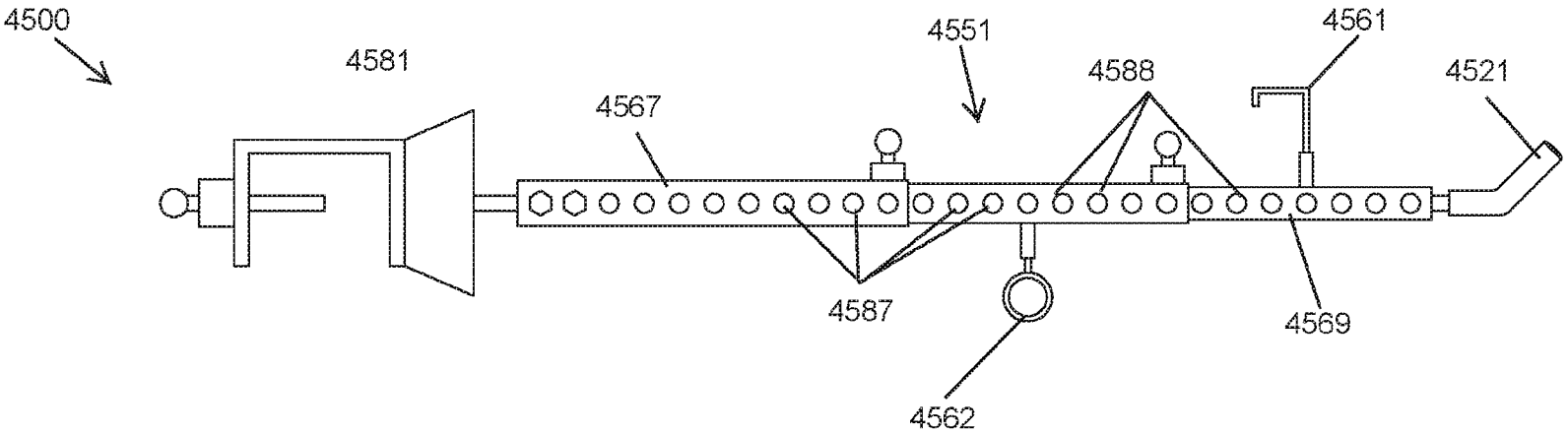

FIGS. 45 and 46 provide a right-side view of multivector extension device 4500. Multivector extension device 4500 comprises brace 4575 for removably and adjustably attaching device 4500 to a frame of an apparatus (not shown). Brace 4575 comprises knob 4542, which manipulates spring-loaded pin 4541. Multivector extension arm 4551 comprises a plurality of accessory receiving ports 4587, and attaches to brace 4575 via a ball joint (not seen). Multivector extension arm 4551 comprises first telescoping member 4567, second telescoping member 4568, and third telescoping member 4569. Second telescoping member 4568 and third telescoping member 4569 are selectively secured to the multivector extension arm 4551 with spring-loaded pins 4578 and 4579. Second telescoping member 4568 has outer dimensions that are smaller than the inner dimensions of first telescoping member 4567, allowing second telescoping member 4568 to slide inside of first telescoping member 4567. Spring-loaded pin 4578 selectively secures second telescoping member 4568 at a chosen position or length relative to the first telescoping number 4567. Similarly, third telescoping member 4569 has outer dimensions that are smaller than the inner dimensions of second telescoping member 4568, allowing third telescoping member 4569 to slide inside of second telescoping member 4568. Spring-loaded pin 4579 selectively secures third telescoping member 4569 at a chosen position or length relative to second telescoping member 4568. It can be said that first telescoping member 4567, second telescoping member 4568, and third telescoping member 4569 are nested.

Single hand grip 4521, which is an exercise engagement device, attaches to the multivector extension arm 4551 via an accessory receiving port (not seen) on third telescoping member 4569. J-hook 4561 for receiving an elastic band (not shown) is an exercise attachment point receiver, and is attached to multivector extension arm 4551 via an accessory receiving port 4587, which can also be referred to as a telescoping member accessory receiving port 4588, on third telescoping member 4569. Eye bolt 4562 for receiving a carabiner that selectively connects ultimately to a weight stack of an apparatus (not shown), is an exercise attachment point receiver attached to multivector extension arm 4551 via an accessory receiving port 4587, which can also be referred to as a telescoping member accessory receiving port 4588, on second telescoping member 4568. Support cone 4581 is positioned about the ball joint (not seen) to protect the frame (not shown) from contact by multivector extension arm 4551. Operating multivector extension device 4500 is similar to the operation of multivector extension device 3600, as shown in FIG. 36, with the added advantage of lengthening the device as allowed by telescoping members 4568 and 4569.

Figure 47:
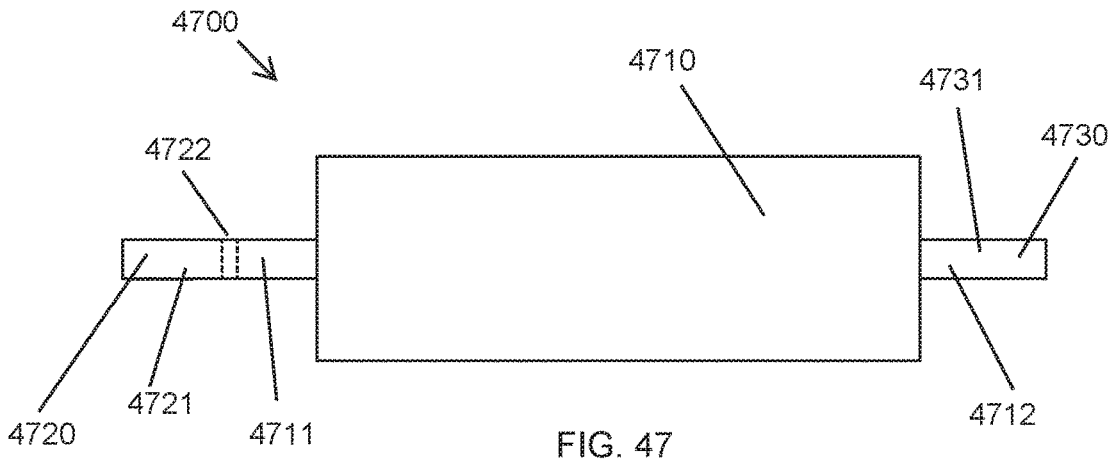
FIG. 47 shows a front view.
Figure 48:
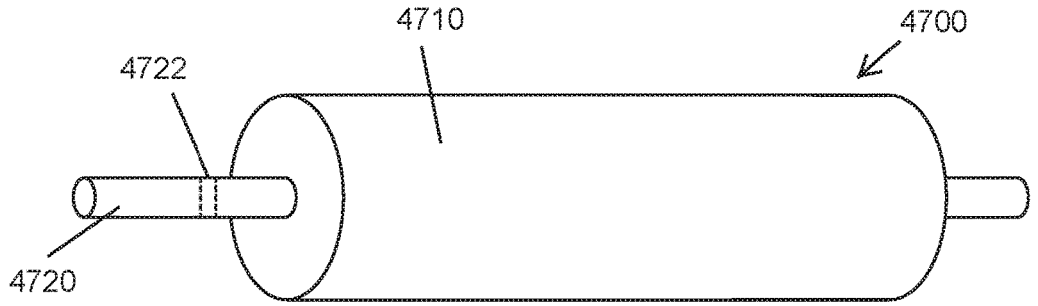
FIG. 48 shows a perspective view, of mobile member 4700.
Figure 49:
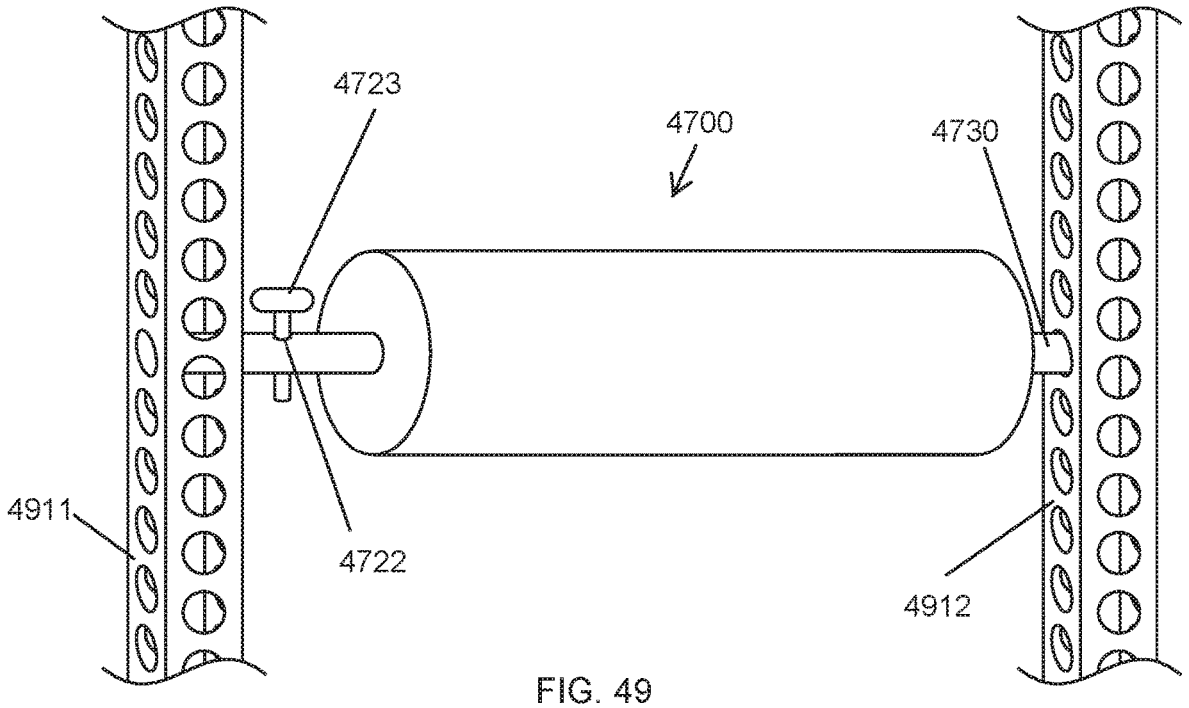
FIG. 49 shows mobile member 4700 engaged between frame members 4911 and 4912.

FIG. 47 shows a front view, and FIG. 48 shows a perspective view, of mobile member 4700. FIG. 49 shows mobile member 4700 engaged between frame members 4911 and 4912. Mobile member 4700 comprises elongate section 4710 which has a first end 4711 opposite second end 4712. First end 4711 has first frame engagement device 4720, which comprises first rod 4721 and port 4722 for receiving retention key 4723, for securing mobile member 4700 to frame member 4911. Second end 4712 contains second frame engagement device 4730, which comprises second rod 4731, for securing mobile member 4700 to frame member 4912. Elongate section 4710 comprises a foamed polymer. In this embodiment, first rod 4721 is longer than second rod 4731. In operation, first rod 4721 is entered in a first accessory receiving port of frame member 4911. Second rod 4731 is aligned with and enters a second accessory receiving port of frame member 4912. When the mobile member 4700 is positioned correctly, with both first rod 4721 and second rod 4731 engaging frame members 4911 and 4912, first key 4723 is placed in first port 4722 to secure mobile member 4700 between frame members 4911 and 4912. To disengage mobile member 4700, first key 4723 is removed from first port 4722, mobile member 4700 is slated toward frame member 4911 until second rod 4731 disengages frame member 4912, and then first rod 4721 can be slid from frame member 4911. Mobile member 4700 can enable a variety of exercises, such as, for example, those that require robust support for a portion of an athlete's body, like arm curls, floating crunches, back extensions, and the like.

Figure 50:
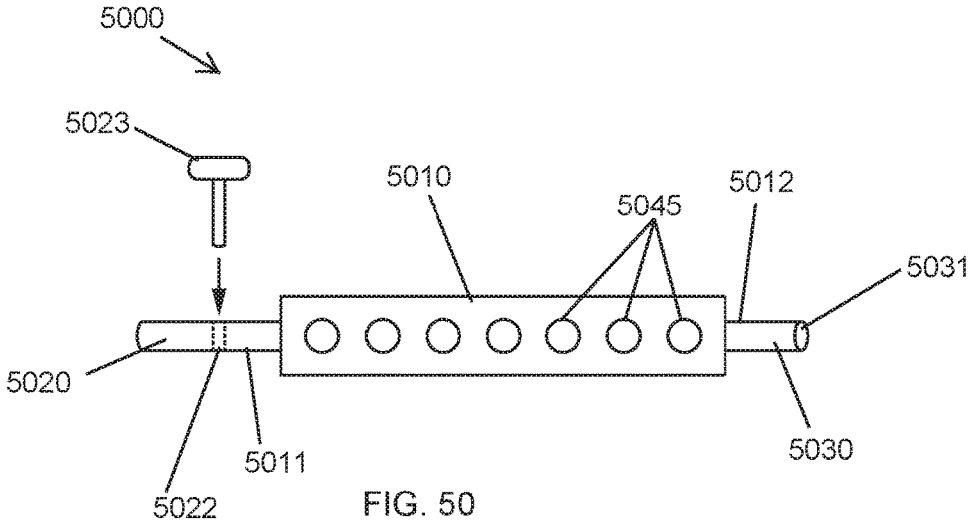
FIG. 50 shows a front view of mobile member 5000.

FIG. 50 shows a front view of mobile member 5000. Mobile member 5000 comprises elongate section 5010 which has a first end 5011 opposite second end 5012. First end 5011 has first frame engagement device 5020, which comprises first rod 5021 and port 5022 for receiving retention key 5023, for securing mobile member 5000 to a first frame member (not shown). Second end 5012 contains second frame engagement device 5030, which comprises second rod 5031, for securing mobile member 5000 to a second frame member (not shown). In this embodiment, first rod 5021 is longer than second rod 5031. Elongate section 5010 comprises square tubing, which allows for the selective attachment of any desired accessories such as, for example, a floating pulley (not shown). Accordingly, mobile member 5000 affords greater flexibility to an apparatus already capable of unprecedented arrangements for exercise. Elongate section 5010 comprises first mobile accessory receiving ports 5045 having axes in a first mobile direction (normal to the page), and second mobile accessory receiving ports (not seen) having axes in a second mobile direction (in the plane of the page).

Figure 51:
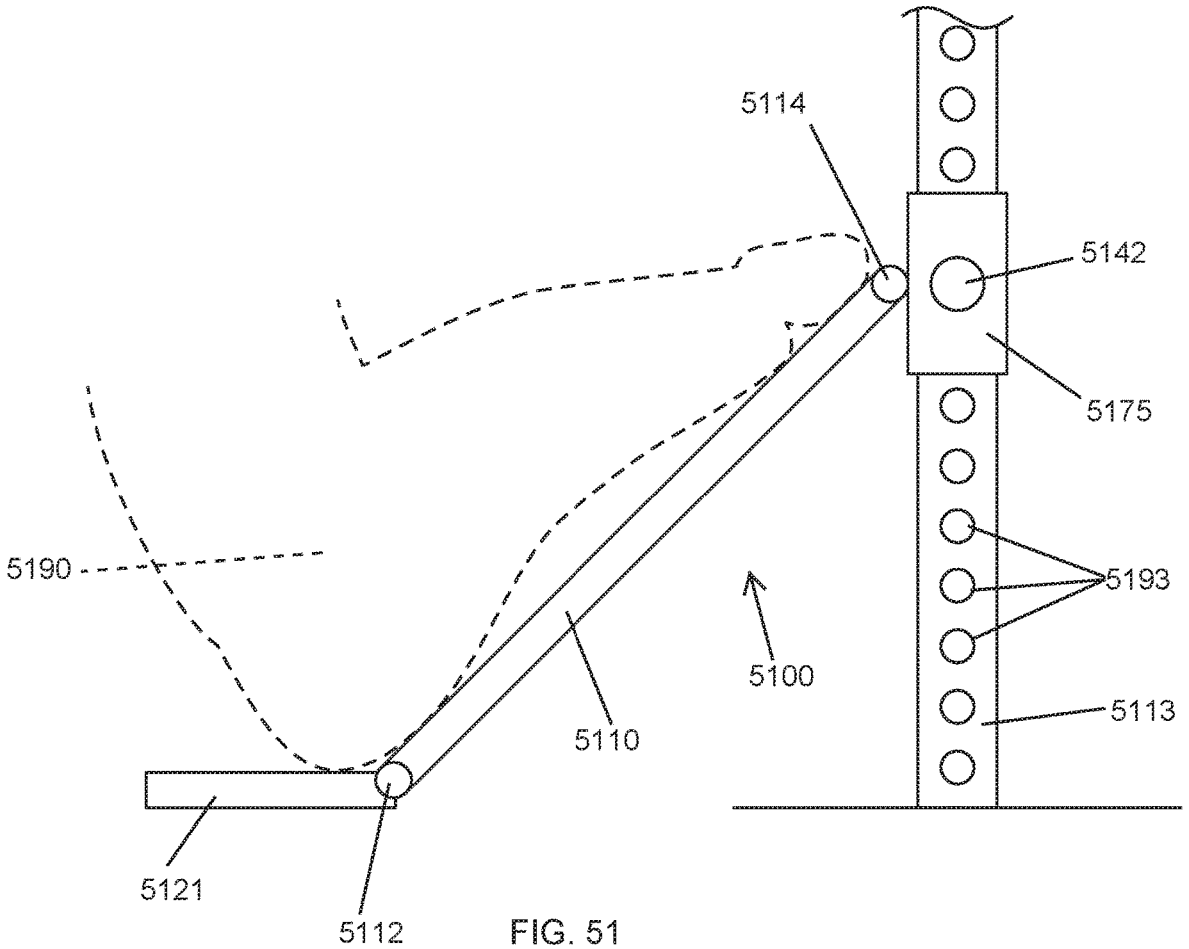
FIG. 51 shows a left-side view of foot stretching device 5100.

FIG. 51 shows a left-side view of foot stretching device 5100. Foot stretching device 5100 comprises brace 5175 for removably and adjustably attaching to a frame, such as, for example frame member 5113, by engaging a spring-loaded pin manipulated by knob 5142 into an accessory receiving port 5193. Foot stretching device 5100 also comprises an elongate sole portion 5110 attached to brace 5175 by brace hinge 5114. Heel portion 5121 attaches to the elongate sole portion 5110 by heel hinge 5112. The angle of stretch that an athlete's foot 5190 experiences can be adjusted by moving brace 5175 up or down frame member 5113.

Figure 52:
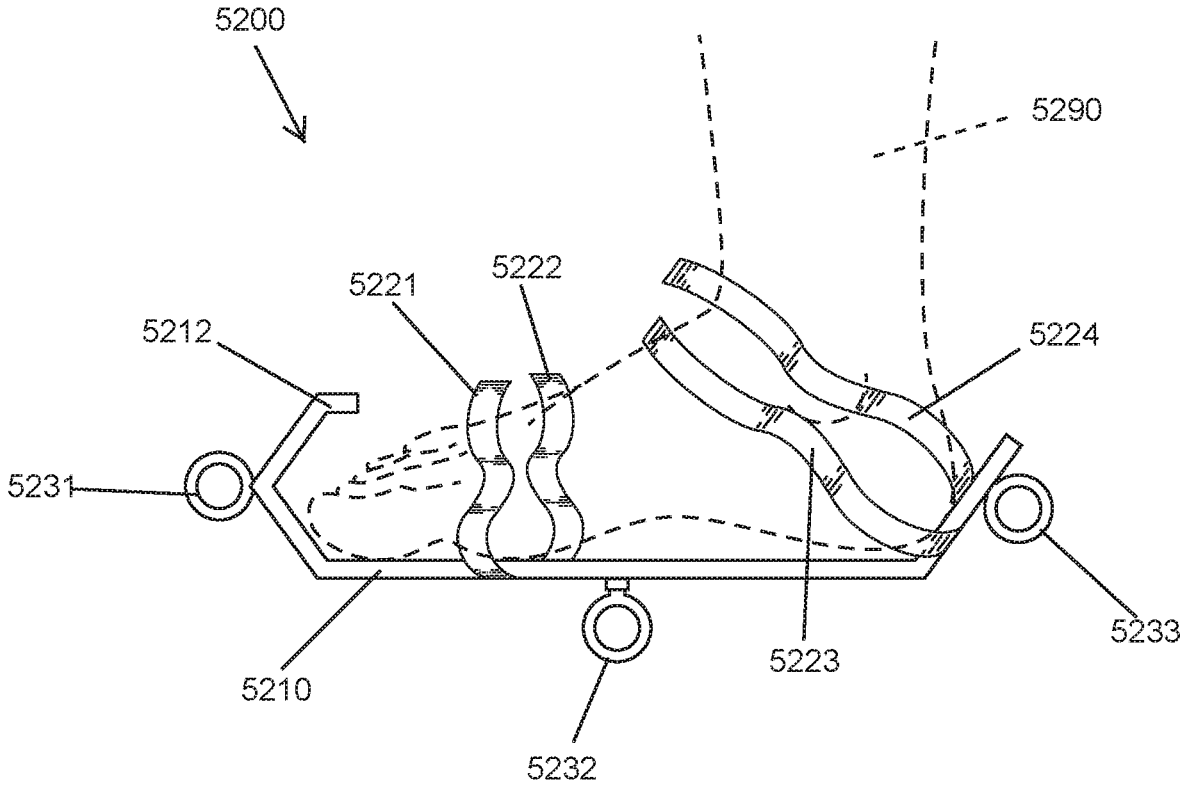
FIG. 52 shows a left-side view of foot exercise attachment 5200.

FIG. 52 shows a left-side view of foot exercise attachment 5200. Foot exercise attachment 5200 comprises scaffold 5210 for receiving a foot 5290 of an athlete. Scaffold 5210 also comprises toe portion 5212 for engaging the top of the toes of the foot 5290, or a shoe in some cases. Scaffold 5210 anchors straps 5221, 5222, 5223, and 5224 for securing the scaffold 5210 to the foot 5290. Straps 5221 and 5222 are adapted to engage each other with, for example, hook-and-loop fabric, and straps 5223 and 5224 are adapted to engage each other with, for example, hook-and-loop fabric. Scaffold 5210 also comprises one or more exercise attachment point receivers in the form of eyebolts 5231, 5232, and 5233 for engaging a resistance to the scaffold 5210.

Figure 53:
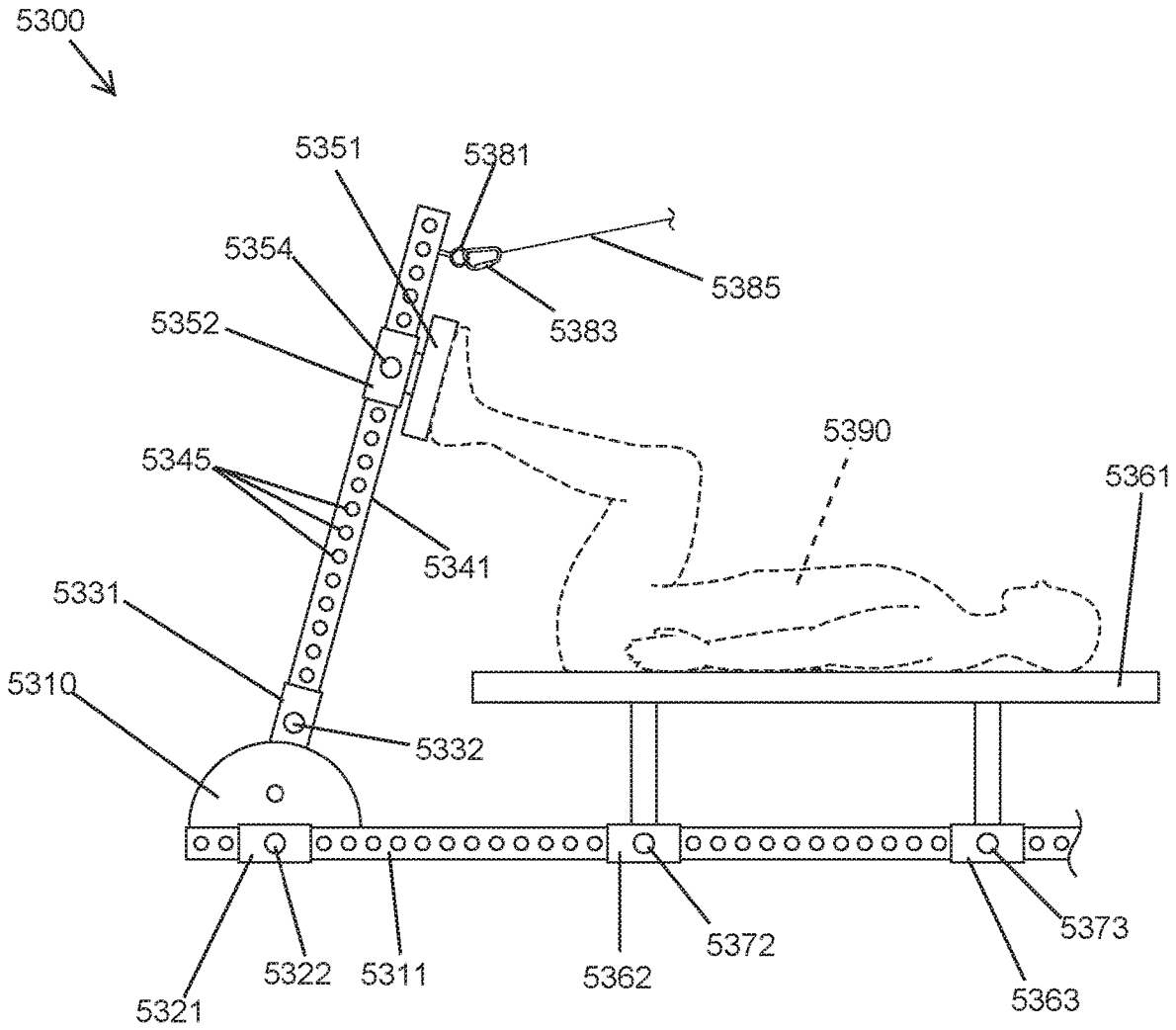
FIG. 53 shows a left-side view of leg press accessory 5300.

FIG. 53 shows a left-side view of leg press accessory 5300. Leg press accessory 5300 comprises angular guide 5310 having an angular guide brace 5321 for removably and adjustably attaching the leg press accessory 5300 to horizontal member 5311. Extension member receiver 5331 is anchored to angular guide 5310 so that extension member receiver 5331 can move an arcuate manner within angular guide 5310, in this case, in the plane of the page. Extension member receiver 5331 has received extension member 5341 having foot pad 5351 held in place on extension member 5341 with a footpad brace 5352 comprising spring-loaded pin 5354 for engaging the extension member 5341 at one of extension receiving ports 5345. Another of extension receiving ports 5345 has received exercise attachment point receiver 5381, which is an eye bolt to which carabiner 5383 and cable 5385 have attached. Cable 5385 ultimately joins to a weight stack (not shown) to provide resistance against athlete 5390 straightening his legs. Leg press accessory 5300 is accompanied by bench 5361, which engages horizontal member 5311 with bench braces 5362, 5363. Knobs 5322, 5372, and 5373 manipulate spring-loaded pins that secure their respective bases 5321, 5362, and 5363 to horizontal member 5311.

Figure 54:
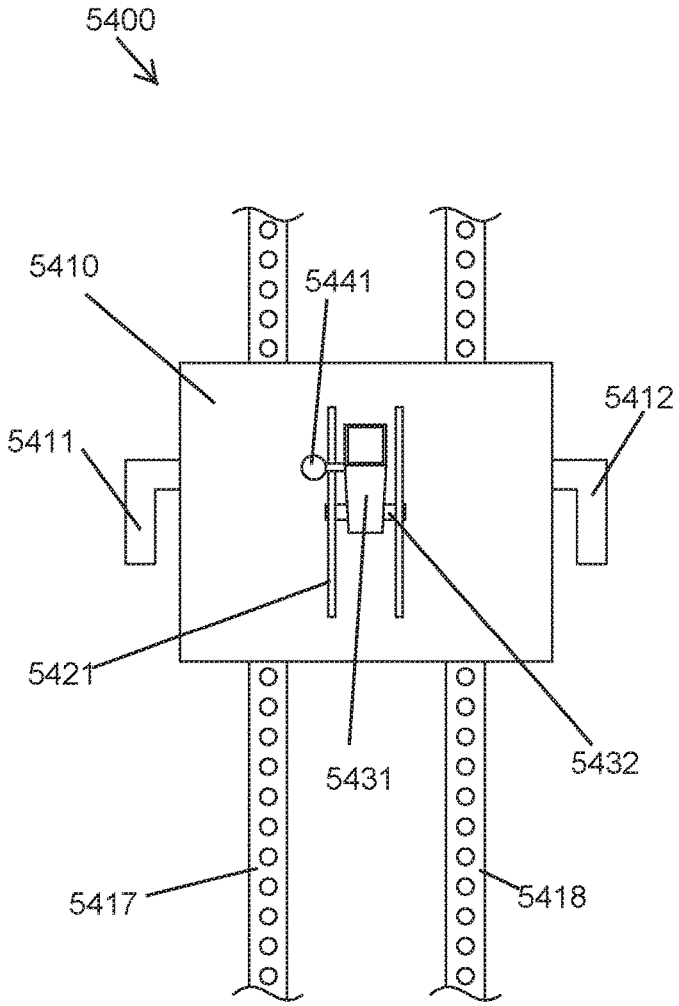
FIGS. 54 and 55 show adjustable arcuate base 5400.
Figure 55:
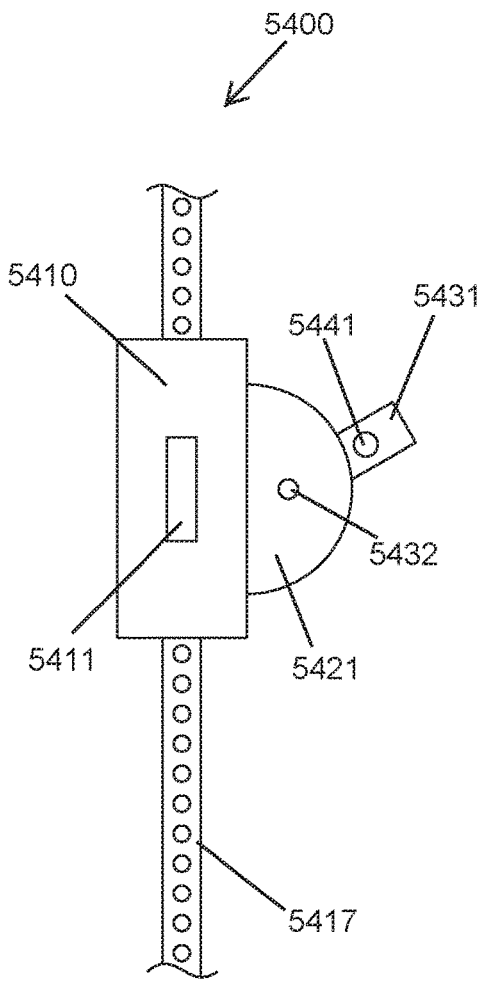

FIGS. 54 and 55 show adjustable arcuate base 5400. Adjustable arcuate base 5400 comprises stage 5410, which itself comprises retractable pins 5411, 5412 for engaging accessory receiving ports on vertical members 5417, 5418, respectively. In operation, an athlete can pull retractable pins 5411, 5412 laterally to disengage vertical members 5417, 5418. Adjustable arcuate base 5400 then can be moved up or down to a new position relative to vertical members 5417, 5418. At the new position, retractable pins 5411, 5412 are released to engage new accessory receiving ports on vertical members 5417, 5418, respectively, thereby securing adjustable arcuate base 5400 in the new position. In this embodiment, retractable pins 5411, 5412 are spring loaded.

Angular guide 5421 is affixed to stage 5410, and anchors extension member receiver 5431 at axle 5432. Extension member receiver 5431 can move in an arcuate manner within angular guide 5421, for example, during exercise. Extension member receiver 5431 further comprises spring-loaded pin 5441, so that extension member receiver 5431 is adapted to receive an extension member (not shown) and secure the extension member with spring-loaded pin 5441. Any suitable extension member can engage extension member receiver 5431. In one case, an extension member can comprise square tubing with extension receiving ports for receiving exercise engagement devices (e.g., single hand grip 3621 in FIG. 36) and exercise attachment point receivers (e.g., J-hook 3661 and eye bolt 3662 in FIG. 36).

Figure 56:
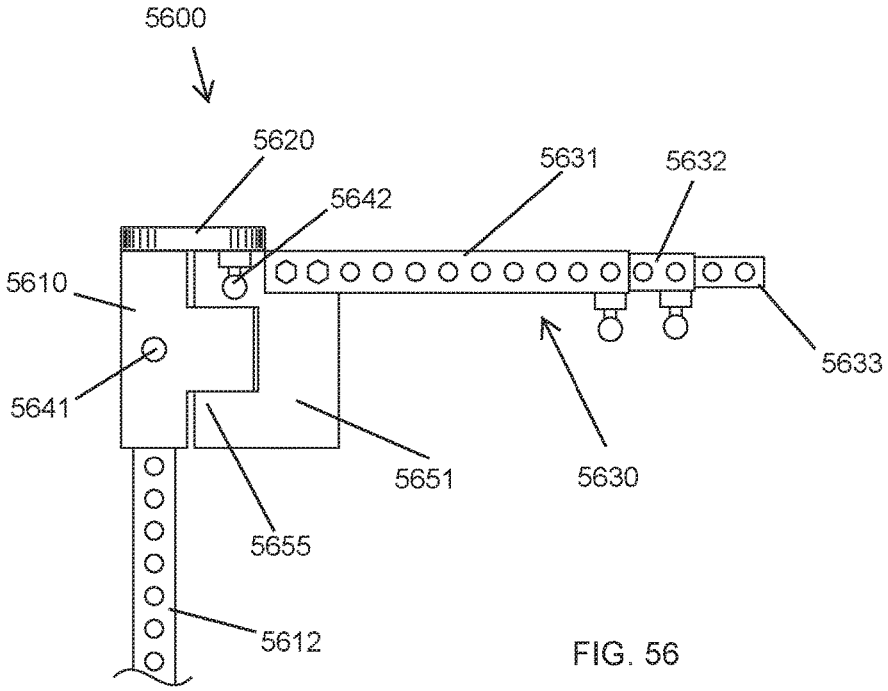
FIGS. 56, 57, and 58 show angular telescopic extension member 5600.
Figure 57:
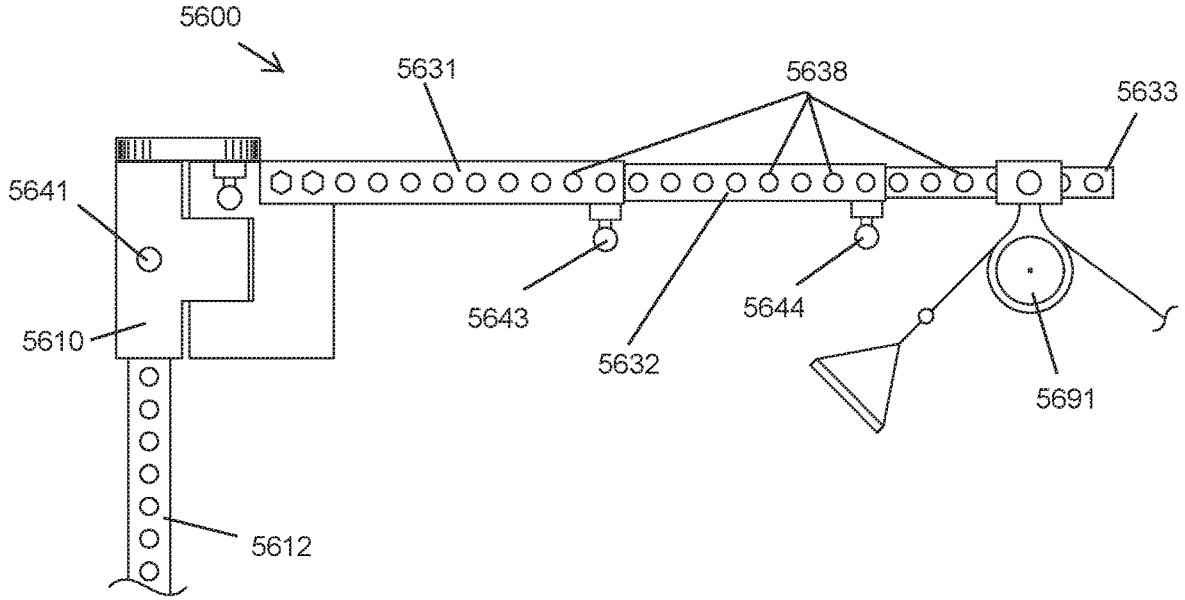
Figure 58:
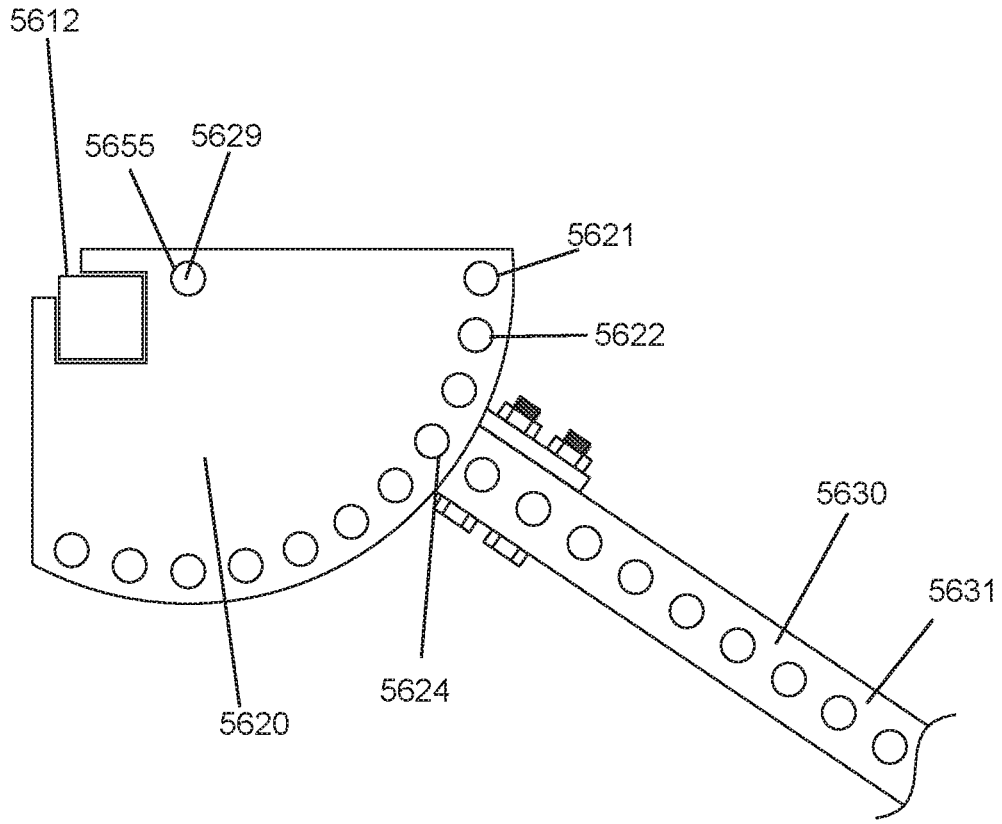

FIGS. 56, 57, and 58 show angular telescopic extension device 5600. FIG. 56 provides a right-side view of the device with nested extension members 5632, 5633 contracted into the shortest configuration. FIG. 57 provides the same view, but with nested extension members 5632, 5633 fully extended, and with floating pulley 5691 providing an extension exercise attachment point. FIG. 58 provides a partial top plan view of angular telescopic extension device 5600.

Angular telescopic extension device 5600 comprises angular selection brace 5610 for selectively attaching angular telescopic extension device 5600 to frame member 5612 of an apparatus for exercising against a resistance. Angular selection brace 5610 comprises retractable pin 5641 for engaging an accessory receiving port in the frame member 5612. Angle selector 5620 comprises a plurality of angle selection ports 5621, 5622, 5624, for example, and is attached to the angular selection brace 5610. Angular selection bracket 5651 is connected to angular selection brace 5610 by a hinge 5655 having hinge axle 5629. Hinge 5655 defines an axis of rotation at hinge axle 5629. Angle selecting retractable pin 5642 engages angle selection port 5624 in FIG. 58, thereby establishing a telescopic extension angle. That angle is determined by an imaginary line from hinge axle 5629 to angle selection port 5621, on one hand, and another imaginary line from hinge axle 5629 to angle selection port 5624, on the other hand.

Telescopic extension arm 5630 extends from angular selection bracket 5651 and comprises first nested extension member 5631, second nested extension member 5632, and third nested extension member 5633. Nested extension members 5631, 5632, and 5633 comprise a plurality of extension receiving ports 5638. Spring-loaded pins 5643 and 5644 allow nested extension members 5632, 5633 to be independently secured at chosen lengths.

Figure 59:
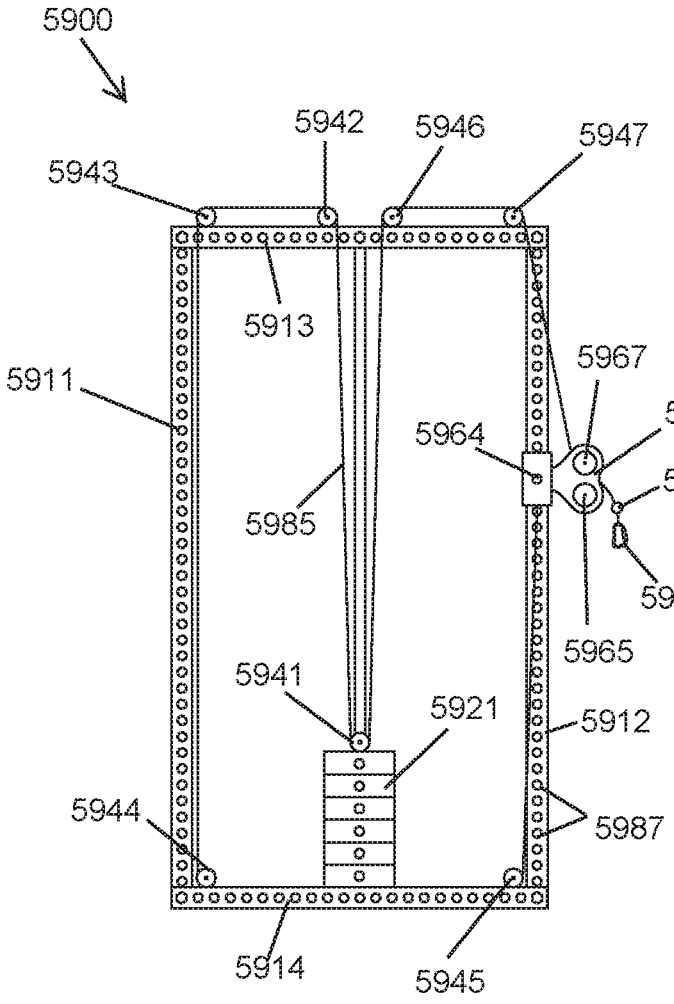
FIGS. 59 and 60 depict portable weight stack assembly 5900.
Figure 60:
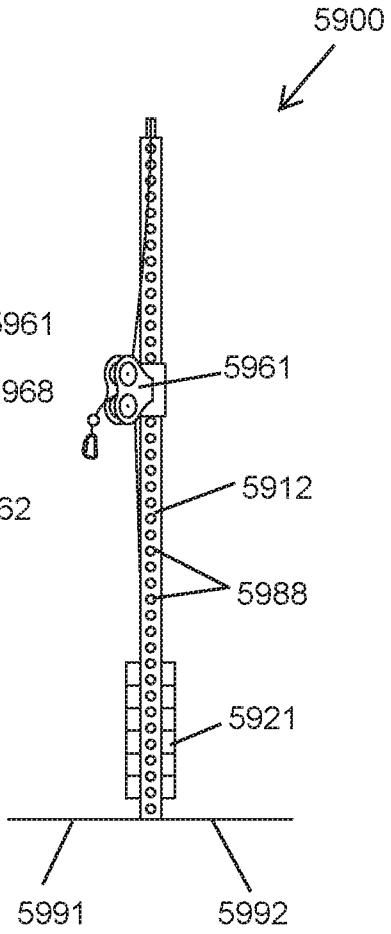

FIGS. 59 and 60 depict portable weight stack assembly 5900. Portable weight stack assembly 5900 comprises portable frame 5910, which comprises portable vertical members 5911, 5912 mutually supporting horizontal members 5913, 5914. Portable weight stack 5921 contained by portable frame 5910 is selectively connected by portable cable 5985 routed about portable frame 5910 via a plurality of portable pulleys 5941, 5942, 5943, 5944, 5945, 5946, and 5947 to slidably adjustable portable exercise attachment point 5961. Footers 5991, 5992 stabilize frame 5910. Portable exercise attachment point 5961 comprises two pulleys 5965, 5967 that allow cable 5985 significant versatile freedom of movement when carabiner 5962 is moved during an exercise. Pulley stop 5968, which is a rubber sphere, prevents cable 5985 from exiting portable exercise attachment point 5961. Portable exercise attachment point 5961 is slidably adjustable along vertical member 5912 by manipulating knob 5964. Vertical member 5912 comprises first portable vertical accessory receiving ports 5987 having axes in a first portable direction, i.e., normal to the page in FIG. 59. Vertical member 5912 comprises second portable vertical accessory receiving ports 5988 having axes in a second portable direction, i.e., normal to the page in FIG. 60.

Figure 61:
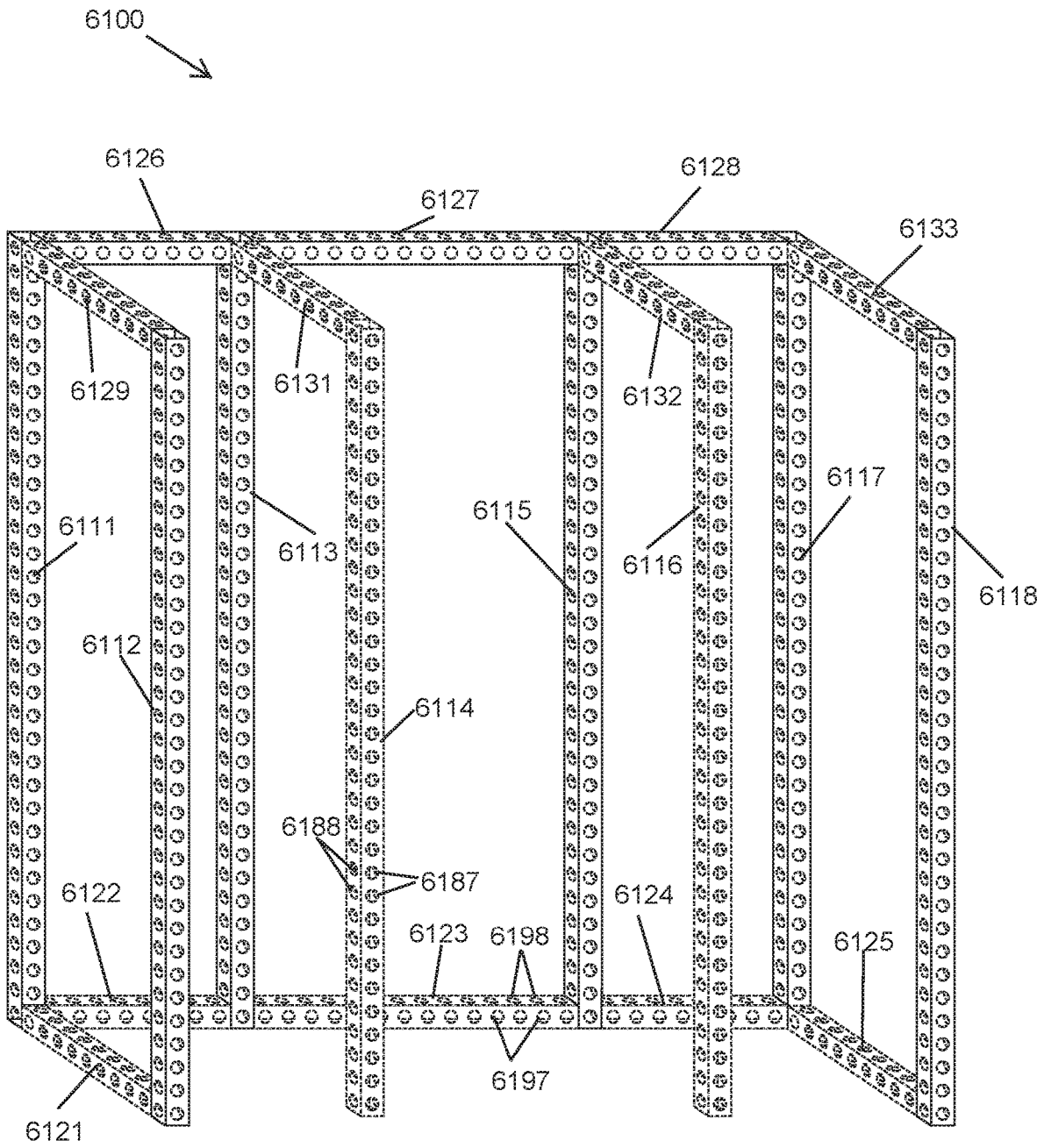
FIGS. 61, 62, 63, 64, 65, 66, and 67 provide several views of frame 6100, which has square tubing.
Figure 62:
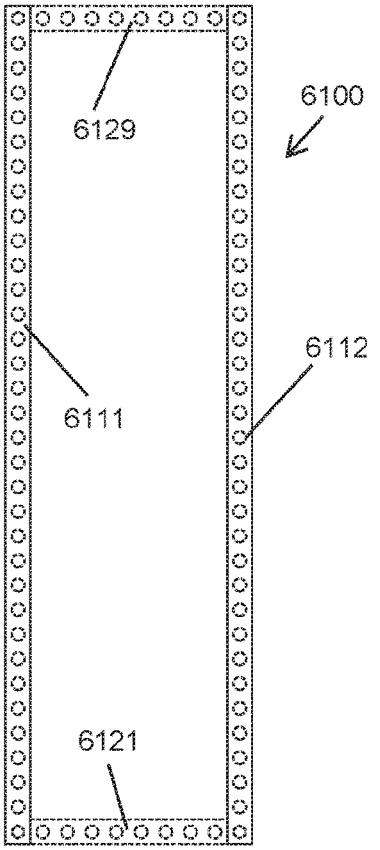
Figure 63:
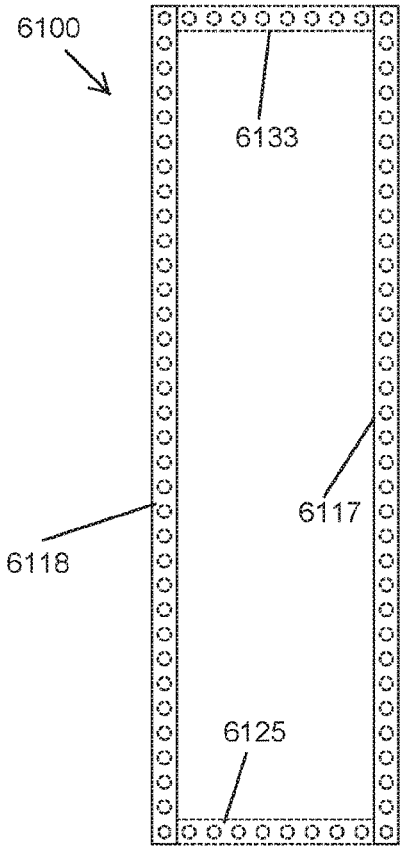
Figure 64:
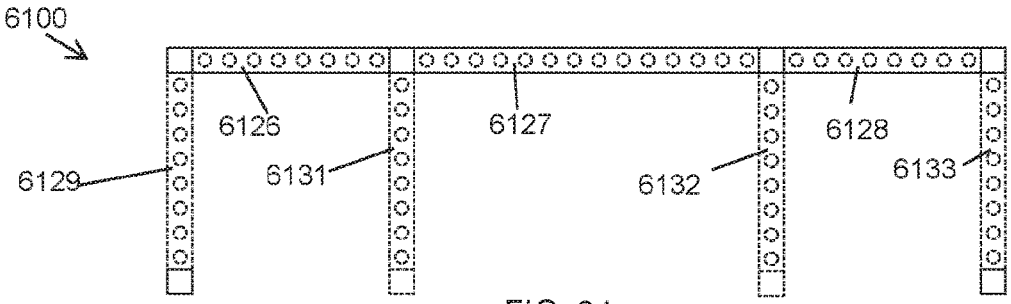
Figure 65:
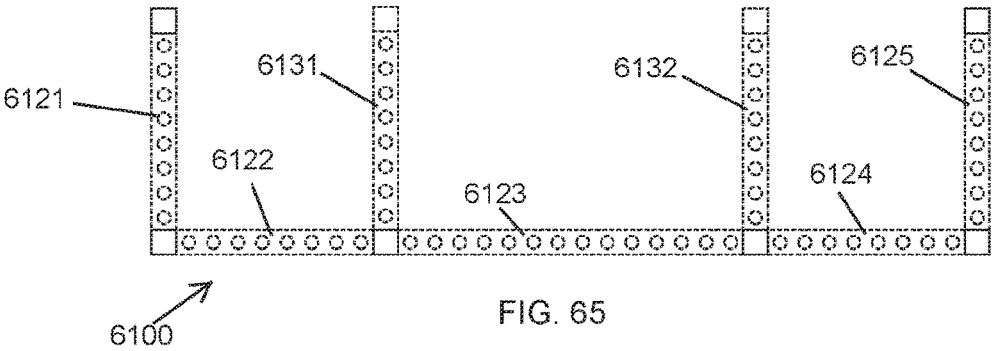
Figure 66:
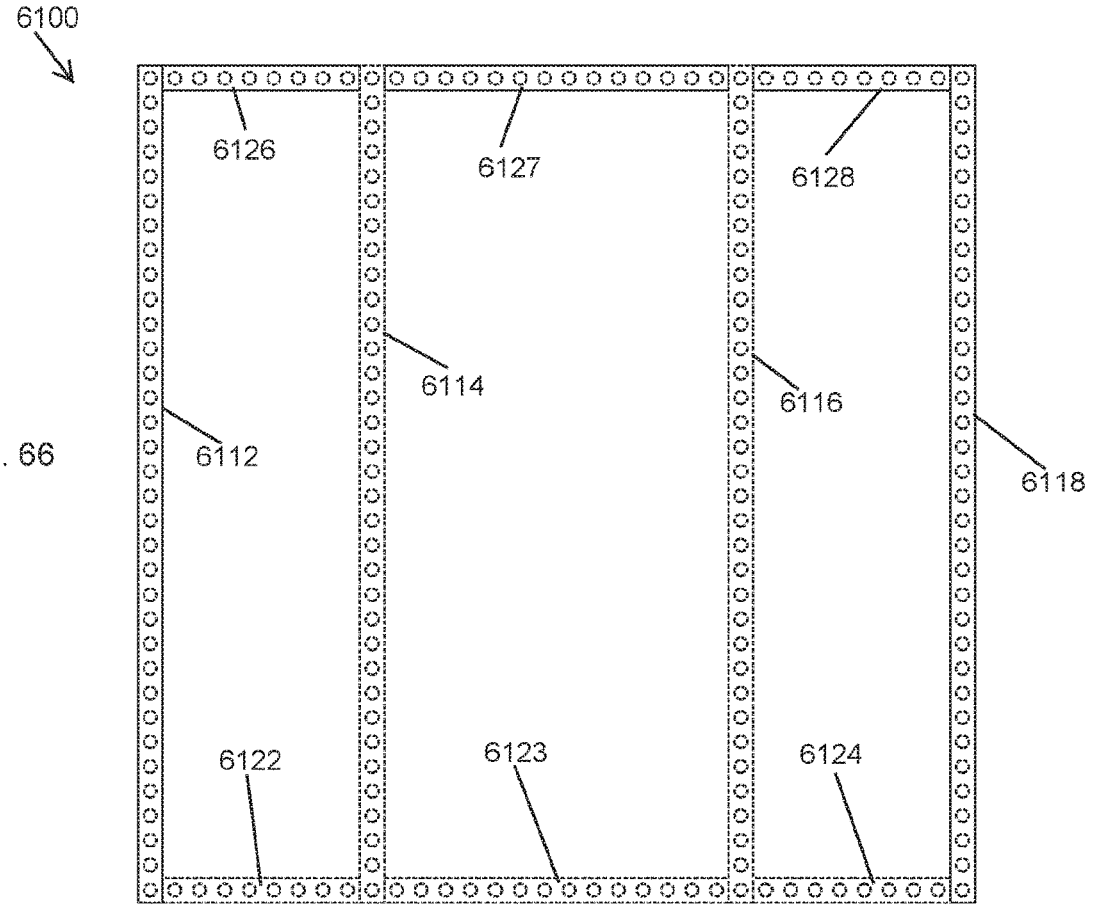
Figure 67:
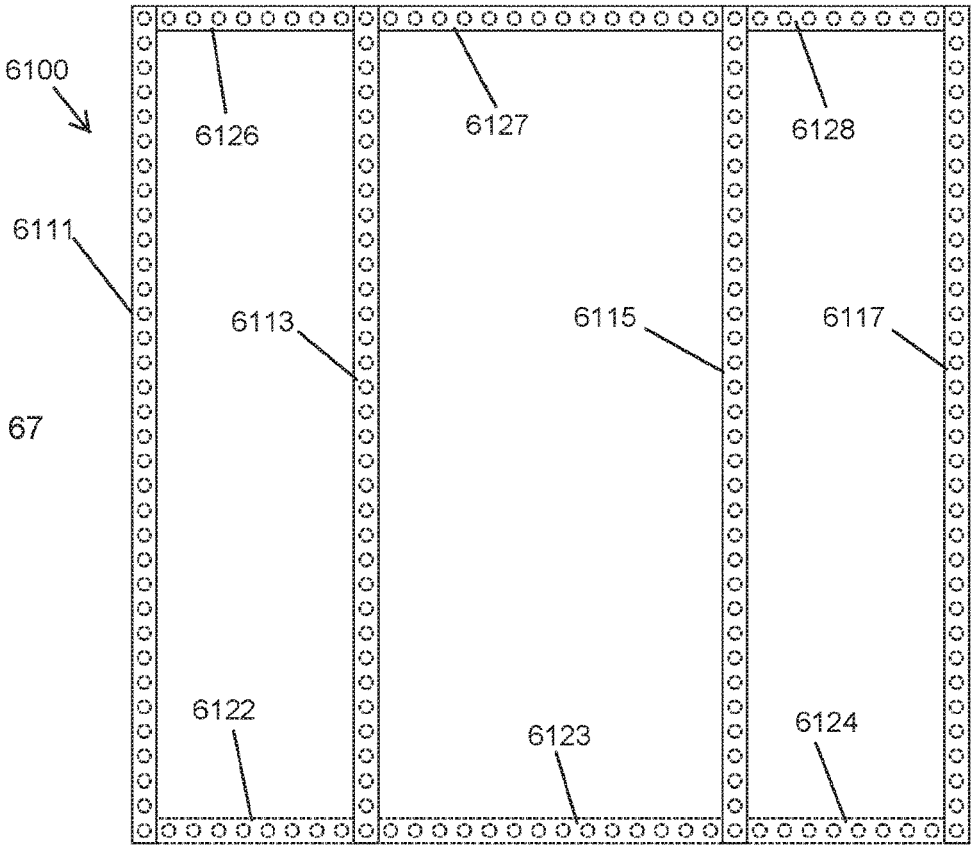

FIGS. 61, 62, 63, 64, 65, 66, and 67 provide several views of frame 6100, which has square tubing. FIG. 61 provides a front perspective view; FIG. 62 provides a right-side view; FIG. 63 provides a left-side view; FIG. 64 provides a top plan view; FIG. 65 provides a bottom plan view; FIG. 66 provides a front elevation view; and FIG. 67 provides a back elevation view. A plurality of vertical members 6111, 6112, 6113, 6114, 6115, 6116, 6117, and 6118 mutually support a plurality of horizontal members 6121, 6122, 6123, 6124, 6125, 6126, 6127, 6128, 6129, 6131, 6132, and 6133. The rectangular footprint defined by horizontal members 6121, 6122, 6123, 6124 and 6125 has an aspect ratio of about 2:9. In other words, the distance from vertical member 6111 to vertical member 6112, the depth, is about 2 feet; the distance from vertical member 6111 to vertical member 6117, the width, is about 9 feet, in one embodiment. Frame 6100 is about 9 feet in height, i.e., the longest dimension of vertical member 6111. Vertical member 6114 has first vertical accessory receiving ports 6187 having axes in a first direction, and second vertical accessory receiving ports 6188 having axes in a second direction. Horizontal member 6123 has first horizontal accessory receiving ports 6197 in the first direction, and second horizontal accessory receiving ports 6198 in a third direction.

Figure 68:
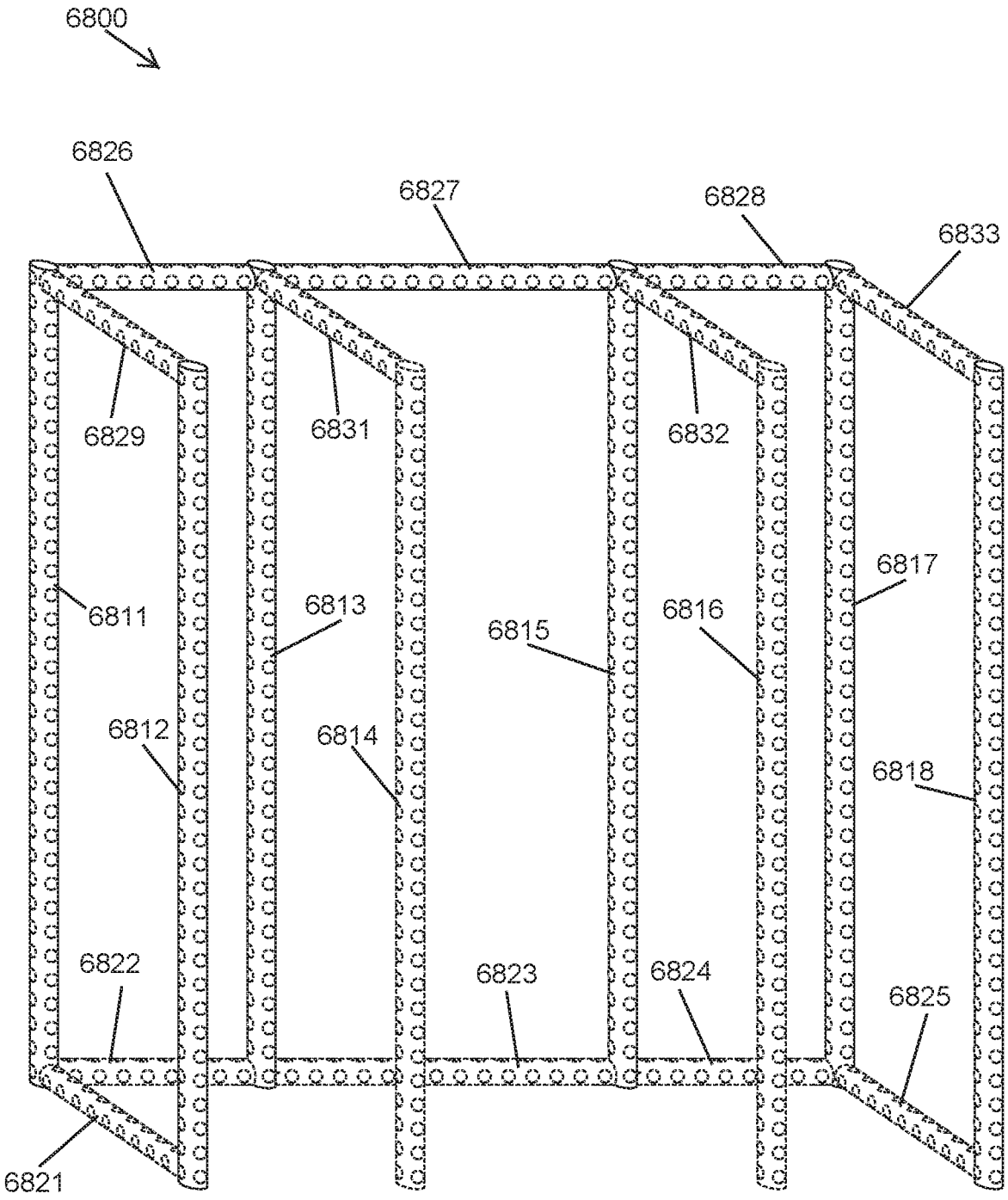
FIG. 68 provides a front perspective view of frame 6800, which has round tubing.

FIG. 68 provides a front perspective view of frame 6800, which has round tubing. A plurality of vertical members 6811, 6812, 6813, 6814, 6815, 6816, 6817, and 6818 mutually support a plurality of horizontal members 6821, 6822, 6823, 6824, 6825, 6826, 6827, 6828, 6829, 6831, 6832, and 6833.

Figure 69:
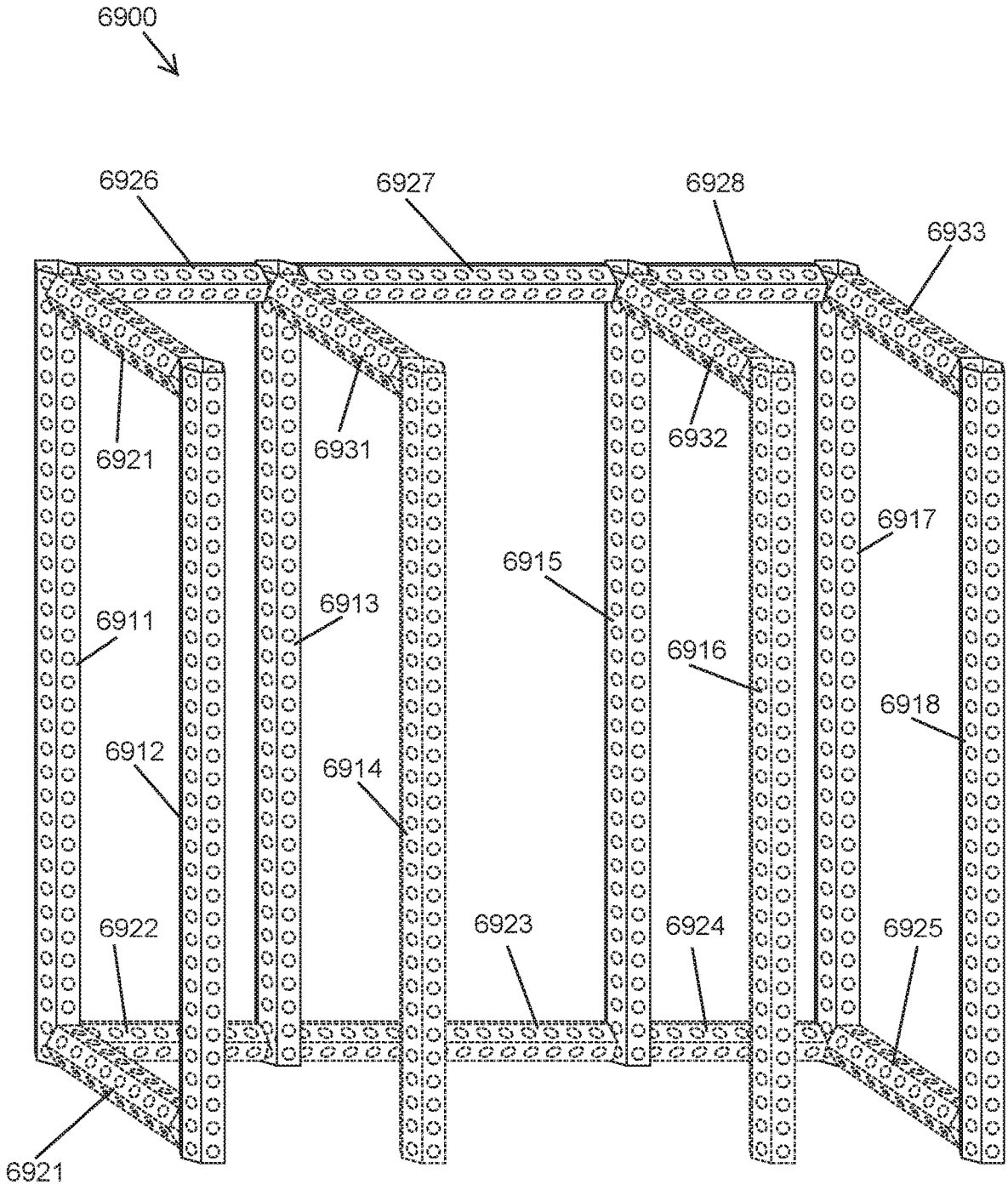
FIG. 69 provides a front perspective view of frame 6900, which has hexagonal tubing.

FIG. 69 provides a front perspective view of frame 6900, which has hexagonal tubing. A plurality of vertical members 6911, 6912, 6913, 6914, 6915, 6916, 6917, and 6918 mutually support a plurality of horizontal members 6921, 6922, 6923, 6924, 6925, 6926, 6927, 6928, 6929, 6931, 6932, and 6933.

EMBODIMENTS

Embodiment 1. An apparatus for exercising against a resistance, comprising:

a frame, comprising a plurality of vertical members mutually supporting a plurality of horizontal members;

the resistance comprising at least one weight stack contained by the frame; one or more cables routed about the frame via a plurality of pulleys selectively connecting the at least one weight stack to one or more exercise attachment points;

at least one floating pulley removably and adjustably attached to the frame comprising at least one extension cable having a first end opposite a second end, the first end being attachable to the one or more exercise attachment points, and the second end providing at least one floating exercise attachment point;

wherein at least some of the vertical members of the plurality of vertical members have first vertical accessory receiving ports having axes in a first direction, and second vertical accessory receiving ports having axes in a second direction.

Embodiment 2. The apparatus of embodiment 1, wherein at least some of the horizontal members of the plurality of horizontal members have first horizontal accessory receiving ports having axes in the first direction, and second horizontal accessory receiving ports having axes in a third direction.

Embodiment 3. The apparatus of any one of embodiments 1-2, wherein the frame comprises square tubing.

Embodiment 4. The apparatus of any one of embodiments 1-3, wherein the first direction is substantially perpendicular to the second direction.

Embodiment 5. The apparatus of any one of embodiments 1-4, wherein the resistance comprises two independent weight stacks contained by the frame.

Embodiment 6. The apparatus of any one of embodiments 1-5, wherein at least one of the one or more exercise attachment points is slidably adjustable along one of the vertical members of the plurality of vertical members.

Embodiment 7. The apparatus of any one of embodiments 1-6, wherein at least one of the one or more exercise attachment points is slidably adjustable along one of the horizontal members of the plurality of horizontal members.

Embodiment 8. The apparatus of any one of embodiments 1-7, wherein at least one vertical member of the plurality of vertical members has a vertical length, and comprises first vertical accessory receiving ports and second vertical accessory receiving ports for substantially the entire vertical length.

Embodiment 9. The apparatus of any one of embodiments 1-8, wherein at least one horizontal member of the plurality of horizontal members has a horizontal length, and comprises first horizontal accessory receiving ports and second horizontal accessory receiving ports for substantially the entire horizontal length.

Embodiment 10. The apparatus of any one of embodiments 1-9, wherein the first direction and the second direction are substantially parallel to the horizontal.

Embodiment 11. The apparatus of any one of embodiments 2-10, wherein the third direction is substantially normal to the horizontal.

Embodiment 12. The apparatus of any one of embodiments 1-11, wherein the frame further comprises at least one door pivotally mounted on at least one vertical member in the plurality of vertical members.

Embodiment 13. The apparatus of embodiment 12, wherein the at least one door comprises two doors.

Embodiment 14. The apparatus of any one of embodiments 12-13, wherein the at least one door comprises at least one door vertical member mutually supporting at least one door horizontal member; and wherein the at least one door vertical member comprises first door vertical accessory receiving ports having axes in a fourth direction, and second door vertical accessory receiving ports in a fifth direction.

Embodiment 15. The apparatus of embodiment 14, wherein the at least one door horizontal member comprises first door horizontal accessory receiving ports having axes in the fourth direction, and second door horizontal accessory receiving ports having axes in a sixth direction.

Embodiment 16. The apparatus of any one of embodiments 14-15, wherein the fourth direction is substantially perpendicular to the fifth direction.

Embodiment 17. The apparatus of any one of embodiments 14-16, wherein the fourth direction and the fifth direction are substantially parallel to the horizontal.

Embodiment 18. The apparatus of any one of embodiments 15-17, wherein the sixth direction is substantially normal to the horizontal.

Embodiment 19. The apparatus of any one of embodiments 14-18, wherein the at least one door vertical member comprises square tubing.

Embodiment 20. The apparatus of any one of embodiments 14-19, wherein the at least one door horizontal member comprises square tubing.

Embodiment 21. The apparatus of any one of embodiments 1-20, comprising at least one decorative panel mounted to the frame.

Embodiment 22. The apparatus of any one of embodiments 12-21, comprising at least one decorative panel mounted to the at least one door.

Embodiment 23. The apparatus of any one of embodiments 21-22, wherein the at least one decorative panel is mounted using at least one hollow-headed bolt, the hollow-headed bolt comprising a head and a threaded shaft, the head comprising an axial recess for receiving and retaining a panel-mounting rivet.

Embodiment 24. The apparatus of embodiment 12, wherein the at least one door comprises at least one of the one or more exercise attachment points, the at least one floating exercise attachment point, or a combination thereof.

Embodiment 25. The apparatus of embodiment 13, wherein each of the two doors comprises at least one of the one or more exercise attachment points, the at least one floating exercise attachment point, or a combination thereof.

Embodiment 26. The apparatus of any one of embodiments 1-25, wherein the at least one floating pulley is removably and adjustably attached to the frame by coupling to one or more of the first vertical accessory receiving ports, one or more of the second vertical accessory receiving ports, or a combination thereof.

Embodiment 27. The apparatus of any one of embodiments 2-25, wherein the at least one floating pulley is removably and adjustably attached to the frame by coupling to one or more of the first horizontal accessory receiving ports, one or more of the second horizontal accessory receiving ports, or a combination thereof.

Embodiment 28. The apparatus of any one of embodiments 14-27, wherein the at least one floating pulley is removably and adjustably attached to the frame by coupling to one or more of the first door vertical accessory receiving ports, one or more of the second door vertical accessory receiving ports, or a combination thereof.

Embodiment 29. The apparatus of any one of embodiments 15-28, wherein the at least one floating pulley is removably and adjustably attached to the frame by coupling to one or more of the first door horizontal accessory receiving ports, one or more of the second door horizontal accessory receiving ports, or a combination thereof.

Embodiment 30. The apparatus of any one of embodiments 1-29, comprising at least one power rack for receiving at least one barbell and allowing the performance of at least one exercise with the at least one barbell.

Embodiment 31. The apparatus of any one of embodiments 1-30, comprising at least one Smith machine for receiving at least one barbell and allowing the performance of at least one exercise with the at least one barbell.

Embodiment 32. The apparatus of any one of embodiments 1-31, comprising at least one elastic band attachment point to provide or augment the resistance.

Embodiment 33. The apparatus of any one of embodiments 1-32, comprising at least one free weight attachment point to provide or augment the resistance.

Embodiment 34. The apparatus of any one of embodiments 1-33, wherein the resistance is selectively provided by the at least one weight stack, at least one free weight device, at least one elastic band, the weight of a person exercising with the apparatus, or a combination thereof.

Embodiment 35. A floating pulley for an apparatus for exercising against a resistance, the floating pulley comprising:

an extension cable having a first end opposite a second end, the first end being attachable to an exercise attachment point on the apparatus, and the second end providing a floating exercise attachment point; and an accessory engagement structure for removably and adjustably coupling to an accessory receiving port on the apparatus.

Embodiment 36. The floating pulley of embodiment 35, further comprising:

a first pulley stop proximal to the first end of the extension cable; and a second pulley stop proximal to the second end of the extension cable.

Embodiment 37. The floating pulley of any one of embodiments 35-36, wherein the floating pulley comprises a single pulley wheel.

Embodiment 38. The floating pulley of any one of embodiments 35-36, wherein the floating pulley comprises two pulley wheels, and the extension cable passes between the two pulley wheels.

Embodiment 39. The floating pulley of any one of embodiments 35-38, wherein the accessory engagement structure comprises a hinge for attaching the floating pulley to the accessory engagement structure.

Embodiment 40. The floating pulley of any one of embodiments 35-39, wherein the accessory engagement structure comprises a pivot for attaching the floating pulley to the accessory engagement structure.

Embodiment 41. The floating pulley of any one of embodiments 35-40, wherein the apparatus for exercising against a resistance is the apparatus of any one of embodiments 1-34.

Embodiment 42. A method of exercising against a resistance, comprising:

obtaining an apparatus comprising:

a frame, comprising a plurality of vertical members mutually supporting a plurality of horizontal members;

the resistance comprising at least one weight stack contained by the frame;

one or more cables routed about the frame via a plurality of pulleys selectively connecting the at least one weight stack to one or more exercise attachment points;

at least one floating pulley removably and adjustably attached to the frame comprising at least one extension cable having a first end opposite a second end, the first end being attachable to the one or more exercise attachment points, and the second end providing at least one floating exercise attachment point;

wherein at least some of the vertical members of the plurality of vertical members have first vertical accessory receiving ports having axes in a first direction, and second vertical accessory receiving ports having axes in a second direction;

connecting at least one exercise engagement device to one or more exercise attachment points, the at least one floating exercise attachment point, or a combination thereof; and moving the at least one exercise engagement device against the resistance, thereby exercising against the resistance.

Embodiment 43. The method of embodiment 42, wherein the apparatus is the apparatus of any one of embodiments 1-34.

Embodiment 44. The method of any one of embodiments 42-43, wherein the at least one floating pulley comprises the floating pulley of any one of embodiments 35-41.

Embodiment 45. A method of making the apparatus of any one of embodiments 1-34, comprising:

routing the one or more cables about the frame via the plurality of pulleys to selectively connect the at least one weight stack to the one or more exercise attachment points.

Embodiment 46. A method of making the floating pulley of any one of embodiments 35-41, comprising routing the extension cable through the floating pulley.

Embodiment 47. An exercise bench adapted for use with an apparatus for exercising against a resistance, the exercise bench comprising:

a bench frame comprising at least one horizontal bench member mutually supporting at least one vertical bench member;

a seat cushion supported by the bench frame; and one or more bench accessory receiving ports in the frame, the one or more bench accessory receiving ports being adapted to receive at least one floating pulley to provide at least one bench exercise attachment point.

Embodiment 48. The exercise bench of embodiment 47, further comprising:

a back cushion supported by the frame and capable of adopting an incline angle.

Embodiment 49. The exercise bench of embodiment 48, wherein the incline angle ranges from −80 degrees to 120 degrees, relative to the horizontal.

Embodiment 50. The exercise bench of embodiment 49, wherein the incline angle ranges from zero degrees to 60 degrees relative to the horizontal.

Embodiment 51. The exercise bench of any one of embodiments 47-50, further comprising an incline angle selection device comprising:

a back cushion brace engaging the back cushion;

a plurality of incline angle selection slots for receiving the back cushion brace and establishing the incline angle with the back cushion brace; and a brace guard for preventing the back cushion brace from departing from the incline angle selection device.

Embodiment 52. An extension arm for an apparatus for exercising against a resistance, the extension arm comprising:

a brace for removably and adjustably attaching to a frame of the apparatus;

an extension member extending from the base and comprising a plurality of extension receiving ports for providing one or more extension exercise attachment points.

Embodiment 53. The extension arm of embodiment 52, wherein the extension arm is adapted to receive at least one floating pulley capable of selectively connecting at least one weight stack of the apparatus to establish the one or more extension exercise attachment points.

Embodiment 54. The extension arm of any one of embodiments 52-53, wherein the apparatus is the apparatus of any one of embodiments 1-34.

Embodiment 55. The extension arm of any one of embodiments 52-54, wherein the floating pulley is the floating pulley of any one of embodiments 35-41.

Embodiment 56. The apparatus of any one of embodiments 1-34, further comprising a dip bar, a multi-use exerciser, a sit-up board, a television, a sound system, a media player, or a combination thereof.

Embodiment 57. The apparatus of embodiment 56, wherein the multi-use exerciser comprises an angle selector supporting a longitudinal member, the longitudinal member anchoring opposing ankle braces proximal to the angle selector, and supporting a multi-use pad distal from the angle selector.

Embodiment 58. A gliding extension device for an apparatus for exercising against a resistance, the gliding extension device comprising:

a roller carriage comprising a plurality of rollers adapted to glidingly engage a guide rod;

an extension frame extending from the roller carriage, the extension frame comprising a proximal end adjacent the roller carriage and a distal end;

an exercise engagement device at or near the distal end; and an exercise attachment point receiver attached to the roller carriage, the proximal end of the extension frame, or both.

Embodiment 59. The gliding extension device of embodiment 58, wherein the exercise engagement device is a single hand grip.

Embodiment 60. The gliding extension device of embodiment 58, wherein the exercise engagement device is a two-handed bar.

Embodiment 61. The gliding extension device of any one of embodiments 58-60, further comprising a brake mechanism, the brake mechanism comprising a brake lever at the exercise engagement device, and a braking clamp at the roller carriage for arresting at least one roller among the plurality of rollers, the guide rod, or both, the brake lever adapted to disengage the braking clamp when the brake lever is manipulated.

Embodiment 62. The gliding extension device of any one of embodiments 58-61, further comprising an elastic band receiver attached to the roller carriage, the proximal end of the extension frame, or both.

Embodiment 63. The gliding extension device of any one of embodiments 58-62, wherein the extension frame further comprises a plurality of extension receiving ports for providing one or more extension exercise attachment points.

Embodiment 64. An extension arm for an apparatus for exercising against a resistance, the extension arm comprising:

an angular selection bracket for attaching the extension arm to a frame of the apparatus, the angular selection bracket comprising a plurality of angle selection ports for establishing a plurality of extension angles;

an extension member extending from the angular selection bracket and comprising a plurality of extension receiving ports for providing one or more extension exercise attachment points;

wherein an extension angle in the plurality of extension angles is determined by a portion of a member of the frame and a portion of the extension member.

Embodiment 65. The extension arm of embodiment 64, wherein the extension arm is adapted to receive at least one floating pulley capable of selectively connecting at least one weight stack of the apparatus to establish the one or more extension exercise attachment points.

Embodiment 66. The extension arm of any one of embodiments 64-65, wherein the apparatus is the apparatus of any one of embodiments 1-34 and 56-57.

Embodiment 67. The extension arm of any one of embodiments 64-66, wherein the floating pulley is the floating pulley of any one of embodiments 35-41.

Embodiment 68. A sit-up board for an apparatus for exercising against a resistance, the sit-up board comprising:

a padded board for supporting an athlete;

at least one longitudinal member supporting the padded board; and at least one lateral member supporting the padded board;

wherein the at least one longitudinal member, the at least one lateral member, or both, comprise a plurality of sit-up board accessory receiving ports.

Embodiment 69. The sit-up board of embodiment 68, further comprising two foot braces for receiving the feet of the athlete.

Embodiment 70. The sit-up board of embodiment 69, further comprising two handgrips for receiving the hands of the athlete.

Embodiment 71. The sit-up board of any one of embodiments 68-70, further comprising one or more pins for engaging accessory receiving ports of a frame of the apparatus for exercising against a resistance.

Embodiment 72. The sit-up board of any one of embodiments 68-71, further comprising one or more footers for stabilizing the sit-up board.

Embodiment 73. A multivector extension device for an apparatus for exercising against a resistance, the multivector extension device comprising:

a brace for removably and adjustably attaching to a frame of the apparatus;

a multivector extension arm comprising a plurality of accessory receiving ports;

a ball joint joining the multivector extension arm to the brace while allowing the multivector extension arm significant freedom of movement relative to the brace;

at least one exercise engagement device removably attached to the multivector extension arm via a first accessory receiving port in the plurality of accessory receiving ports; and at least one exercise attachment point receiver removably attached to the multivector extension arm via a second accessory receiving port in the plurality of accessory receiving ports.

Embodiment 74. The multivector extension device of embodiment 73, wherein the brace comprises a spring-loaded pin manipulated by a knob for engaging the frame of the apparatus.

Embodiment 75. The multivector extension device of any one of embodiments 73-74, wherein the multivector extension arm comprises square tubing.

Embodiment 76. The multivector extension device of any one of embodiments 73-75, wherein the at least one exercise engagement device comprises a single hand grip.

Embodiment 77. The multivector extension device of any one of embodiments 73-75, wherein the at least one exercise engagement device comprises a two-handed bar.

Embodiment 78. The multivector extension device of any one of embodiments 73-77, wherein the at least one exercise attachment point receiver comprises a J-hook for receiving an elastic band.

Embodiment 79. The multivector extension device of any one of embodiments 73-78, wherein the at least one exercise attachment point receiver comprises an eye bolt for receiving a carabiner.

Embodiment 80. The multivector extension device of any one of embodiments 73-79, wherein the at least one exercise attachment point receiver comprises a spring-loaded pin for securing the exercise attachment point receiver in an accessory receiving port.

Embodiment 81. The multivector extension device of any one of embodiments 73-80, wherein the at least one exercise engagement device comprises a spring-loaded pin for securing the exercise engagement device in an accessory receiving port.

Embodiment 82. The multivector extension device of any one of embodiments 73-81, wherein the multivector extension arm comprises at least two telescoping members, and the plurality of accessory receiving ports comprises a plurality of telescoping member accessory receiving ports.

Embodiment 83. The multivector extension device of embodiment 82, wherein at least one of the at least two telescoping members is selectively secured to the multivector extension arm with at least one spring-loaded pin.

Embodiment 84. The multivector extension device of any one of embodiments 82-83, wherein the at least one exercise engagement device is removably attached to the multivector extension arm via a third accessory receiving port in the plurality of telescoping member accessory receiving ports.

Embodiment 85. The multivector extension device of any one of embodiments 82-84, wherein the at least one exercise attachment point receiver is removably attached to the multivector extension arm via a fourth accessory receiving port in the plurality of telescoping member accessory receiving ports.

Embodiment 86. The multivector extension device of any one of embodiments 73-85, wherein the brace further comprises a support cone positioned about the ball joint to protect the frame from contact by the multivector extension arm.

Embodiment 87. The multivector extension device of embodiment 86, wherein the support cone comprises natural rubber, synthetic rubber, polyurethane, silicone, or a combination thereof.

Embodiment 88. The multivector extension device of any one of embodiments 73-87, wherein the apparatus for exercising against a resistance is the apparatus of any one of embodiments 1-34 and 56-57.

Embodiment 89. A multivector extension support for an apparatus for exercising against a resistance, the multivector extension support comprising: a brace for removably and adjustably attaching to a frame of the apparatus; and a resilient support attached to the brace for receiving and protecting the frame from contact by a multivector extension device.

Embodiment 90. The multivector extension support of embodiment 89, wherein the brace comprises a spring-loaded pin for engaging the frame of the apparatus.

Embodiment 91. The multivector extension support of any one of embodiments 89-90, wherein the resilient support defines a recess for receiving the multivector extension device.

Embodiment 92. The multivector extension support of any one of embodiments 89-91, wherein the resilient support comprises natural rubber, synthetic rubber, polyurethane, silicone, or a combination thereof.

Embodiment 93. The multivector extension support of any one of embodiments 89-92, wherein the multivector extension device is the multivector extension device of any one of embodiments 73-88.

Embodiment 94. The multivector extension support of any one of embodiments 89-93, wherein the apparatus for exercising against a resistance is the apparatus of any one of embodiments 1-34 and 56-57.

Embodiment 95. A method of exercising against a plurality of resistances having multiple vectors, comprising:

obtaining a multivector extension device comprising:

a brace for removably and adjustably attaching to a frame of an apparatus;

a multivector extension arm comprising a first accessory receiving port, a second accessory receiving port, and a third accessory receiving port;

a ball joint joining the multivector extension arm to the brace while allowing the multivector extension arm significant freedom of movement relative to the brace;

a first exercise attachment point receiver removably attached to the multivector extension arm via the first accessory receiving port;

a second exercise attachment point receiver removably attached to the multivector extension arm via the second accessory receiving port; and an exercise engagement device removably attached to the multivector extension arm via the third accessory receiving port; and attaching a first resistance to the first exercise attachment point receiver;

attaching a second resistance to the second exercise attachment point receiver, wherein the first resistance has a first vector and the second resistance has a second vector, wherein the first vector differs from the second vector, and wherein the first vector and the second vector thereby form the plurality of resistances having multiple vectors; and moving the exercise engagement device against the plurality of resistances having multiple vectors, thereby exercising against a plurality of resistances having multiple vectors.

Embodiment 96. The method of embodiment 95, wherein the multivector extension device is the multivector extension device of any one of embodiments 73-88.

Embodiment 97. The method of any one of embodiments 95-96, wherein the apparatus is the apparatus of any one of embodiments 1-34 and 56-57.

Embodiment 98. A mobile member for an apparatus for exercising against a resistance, the mobile member comprising:

an elongate section having a first end opposite a second end;

a first frame engagement device, at the first end of the elongate section, for securing the mobile member to a first member of a frame of the apparatus; and a second frame engagement device, at the second end of the elongate section, for securing the mobile member to a second member of the frame.

Embodiment 99. The mobile member of embodiment 98, wherein the elongate section comprises square tubing.

Embodiment 100. The mobile member of any one of embodiments 98-99, comprising between the first end and the second end, first mobile accessory receiving ports having axes in a first mobile direction, and second mobile accessory receiving ports having axes in a second mobile direction.

Embodiment 101. The mobile member of any one of embodiments 98-99, wherein the elongate section comprises a foamed polymer, a cushion, or a combination thereof.

Embodiment 102. The mobile member of embodiment 101, wherein the foamed polymer is chosen from latex foam rubber, polyurethane foam, styrene-butadiene foam, or a combination thereof.

Embodiment 103. The mobile member of any one of embodiments 98-102, wherein the first frame engagement device comprises a first rod having a first port for receiving a first retention key, the first rod being adapted to enter a first accessory receiving port of the first member of the frame.

Embodiment 104. The mobile member of any one of embodiments 98-103, wherein the second frame engagement device comprises a second rod optionally having a second port for receiving a second retention key, the second rod being adapted to enter a second accessory receiving port of the second member of the frame.

Embodiment 105. The mobile member of embodiment 104, wherein the first rod is longer than the second rod.

Embodiment 106. The mobile member of embodiment 104, wherein the second rod is longer than the first rod.

Embodiment 107. A foot stretching device for an apparatus for exercising against a resistance, the foot stretching device comprising: a brace for removably and adjustably attaching to a frame of the apparatus; an elongate sole portion attached to the brace by a brace hinge; and a heel portion attached to the sole portion by a heel hinge.

Embodiment 108. The foot stretching device of embodiment 107, wherein the brace comprises a spring-loaded pin for engaging the frame of the apparatus.

Embodiment 109. The foot stretching device of any one of embodiments 107-108, wherein the heel portion comprises a non-stick surface.

Embodiment 110. The foot stretching device of any one of embodiments 107-109, comprising steel, aluminum, or a combination thereof.

Embodiment 111. The foot stretching device of any one of embodiments 107-110, wherein the apparatus is the apparatus of any one of embodiments 1-34 and 56-67.

Embodiment 112. A foot exercise attachment for an apparatus for exercising against a resistance, the attachment comprising:

a scaffold for receiving a foot of an athlete;

one or more straps for securing the scaffold to the foot; and one or more exercise attachment point receivers for engaging a resistance to the scaffold.

Embodiment 113. The foot exercise attachment of embodiment 112, wherein the scaffold comprises steel, aluminum, or a combination thereof.

Embodiment 114. The foot exercise attachment of any one of embodiments 112-113, wherein the one or more straps comprise hook-and-loop fabric, snaps, buttons, buckles, or a combination thereof.

Embodiment 115. The foot exercise attachment of any one of embodiments 112-114, wherein the scaffold comprises a toe portion for engaging the top of the toes of the foot.

Embodiment 116. The foot exercise attachment of any one of embodiments 112-115, wherein the apparatus is the apparatus of any one of embodiments 1-34 and 56-57.

Embodiment 117. A leg press accessory for an apparatus for exercising against a resistance, the leg press accessory comprising:

an angular guide having an angular guide brace for removably and adjustably attaching to a horizontal member of a frame of the apparatus;

an extension member receiver anchored to the angular guide so that the extension member receiver can move in an arcuate manner within the angular guide;

the extension member receiver being adapted to receive an extension member having a foot pad held in place on the extension member with a foot pad brace comprising a spring-loaded pin for engaging the extension member.

Embodiment 118. The leg press accessory of embodiment 117, wherein the extension member comprises a plurality of extension receiving ports for providing one or more extension exercise attachment points.

Embodiment 119. The leg press accessory of any one of embodiments 117-118, wherein the horizontal member of the frame is adapted to receive a bench having one or more bench braces for engaging the horizontal member, the one or more bench braces comprising one or more spring-loaded pins for engaging the horizontal member.

Embodiment 120. The leg press accessory of any one of embodiments 117-118, wherein the apparatus is the apparatus of any one of embodiments 1-34 and 56-57.

Embodiment 121. An adjustable arcuate base for an apparatus for exercising against a resistance, the adjustable arcuate base comprising:

a stage comprising one or more retractable pins for engaging one or more accessory receiving ports on one or more vertical members of a frame of the apparatus;

an angular guide affixed to the stage;

an extension member receiver anchored to the angular guide so that the extension member receiver can move in an arcuate manner within the angular guide; the extension member receiver further comprising a spring-loaded pin; the extension member receiver being adapted to receive an extension member and secure the extension member with the spring-loaded pin.

Embodiment 122. The adjustable arcuate base of embodiment 121, wherein the one or more retractable pins comprises two spring-loaded pins.

Embodiment 123. The adjustable arcuate base of any one of embodiments 121-122, wherein the extension member comprises a plurality of extension receiving ports for providing one or more exercise engagement devices and/or one or more exercise attachment point receivers.

Embodiment 124. The adjustable arcuate base of any one of embodiments 121-123, wherein the apparatus is the apparatus of any one of embodiments 1-34 and 56-57.

Embodiment 125. An angular telescopic extension device for an apparatus for exercising against a resistance, the angular telescopic extension device comprising:

an angular selection brace for selectively attaching the angular telescopic extension device to a frame of the apparatus, the angular selection brace comprising a retractable pin for engaging an accessory receiving port in the frame of the apparatus;

an angle selector comprising a plurality of angle selection ports attached to the angular selection brace;

an angular selection bracket connected to the angular selection brace by a hinge, the hinge defining an axis of rotation, and comprising an angle selecting retractable pin for engaging an angle selection port in the plurality of angle selection ports on the angle selector for establishing a telescopic extension angle;

a telescopic extension arm extending from the angular selection bracket and comprising two or more nested extension members each adapted to be secured at a chosen length with a spring-loaded pin, the two or more nested extension members comprising a plurality of extension receiving ports for providing one or more extension exercise attachment points;

wherein the telescopic angle is determined by a first imaginary line between the axis of rotation and a first angle selection port in the plurality of angle selection ports, on one hand, and a second imaginary line between the axis of rotation and a chosen angle selection port in the plurality of angle selection ports.

Embodiment 126. The angular telescopic extension device of embodiment 125, adapted to fit onto a vertical member of the frame of the apparatus.

Embodiment 127. The angular telescopic extension device of any one of embodiments 125-126, wherein the angle selecting retractable pin comprises a spring-loaded pin.

Embodiment 128. The angular telescopic extension device of any one of embodiments 125-127, wherein the telescopic extension arm comprises two nested extension members.

Embodiment 129. The angular telescopic extension device of any one of embodiments 125-128, wherein the telescopic extension arm comprises three nested extension members.

Embodiment 130. The angular telescopic extension device of any one of embodiments 125-129, wherein the apparatus is the apparatus of any one of embodiments 1-34 and 56-57.

Embodiment 131. A portable weight stack assembly for an apparatus for exercising against a resistance, the portable weight stack assembly comprising:

a portable frame comprising one or more portable vertical members mutually supporting one or more portable horizontal members;

a portable weight stack contained by the portable frame;

one or more portable cables routed about the portable frame via a plurality of portable pulleys selectively connecting the portable weight stack to a slidably adjustable portable exercise attachment point; and at least one footer for stabilizing the frame.

Embodiment 132. The portable weight stack assembly of embodiment 131, wherein the portable weight stack assembly weighs no more than about 200 lbs, no more than about 150 lbs., no more than about 100 lbs., no more than about 75 lbs., or no more than about 50 lbs.

Embodiment 133. The portable weight stack assembly of any one of embodiments 131-132, wherein the portable weight stack assembly weighs at least about 50 lbs., at least about 75 lbs., at least about 100 lbs., at least about 150 lbs., or at least about 200 lbs.

Embodiment 134. The portable weight stack assembly of any one of embodiments 131-133, wherein at least one of the one or more portable vertical members comprises first portable vertical accessory receiving ports having an axis in a first portable direction, and second portable vertical accessory receiving ports having an axis in a second portable direction.

Embodiment 135. The portable weight stack assembly of any one of embodiments 131-134, wherein at least one of the one or more portable horizontal members comprises first portable horizontal accessory receiving ports having an axis in the first portable direction, and second portable horizontal accessory receiving ports having an axis in a third portable direction.

Embodiment 136. The portable weight stack assembly of any one of embodiments 131-135, wherein the apparatus is the apparatus of any one of embodiments 1-34 and 56-57.

Embodiment 137. A frame for an apparatus for exercising against a resistance, comprising:

a plurality of vertical members mutually supporting a plurality of horizontal members, wherein the plurality of vertical members and the plurality of horizontal members define a rectangular footprint having an aspect ratio of about 1:4, about 2:9, about 1:5, about 3:10, about 1:3, or about 3:10.

Embodiment 138. The frame of embodiment 137, wherein the aspect ratio is at least about 1:4, at least about 2:9, at least about 1:5, at least about 3:10, at least about 1:3, or at least about 3:10.

Embodiment 139. The frame of any one of embodiments 137-138, wherein the aspect ratio is no more than about 1:4, no more than about 2:9, no more than about 1:5, no more than about 3:10, no more than about 1:3, or no more than about 3:10.

Embodiment 140. The frame of any one of embodiments 137-139, wherein at least some of the vertical members of the plurality of vertical members have first vertical accessory receiving ports having axes in a first direction, and second vertical accessory receiving ports having axes in a second direction.

Embodiment 141. The frame of any one of embodiments 137-140, wherein at least some of the horizontal members of the plurality of horizontal members have first horizontal accessory receiving ports having axes in the first direction, and second horizontal accessory receiving ports having axes in a third direction.

Embodiment 142. The frame of any one of embodiments 137-141, wherein the frame comprises square tubing, circular tubing, hexagonal tubing, or a combination thereof.

Embodiment 143. The frame of any one of embodiments 137-142, wherein the frame has a depth of at least about 1 foot, at least about 2 feet, at least about 3 feet, at least about 4 feet, at least about 5 feet, or at least about 6 feet.

Embodiment 144. The frame of any one of embodiments 137-143, wherein the frame has a depth of no more than about 1 foot, no more than about 2 feet, no more than about 3 feet, no more than about 4 feet, no more than about 5 feet, or no more than about 6 feet.

Embodiment 145. The frame of any one of embodiments 137-144, wherein the frame has a width at least about 3 feet, at least about 4 feet, at least about 5 feet, at least about 6 feet, at least about 7 feet, at least about 8 feet, at least about 9 feet, at least about 10 feet, at least about 11 feet, at least about 12 feet, at least about 13 feet, at least about 14 feet, or at least about 15 feet.

Embodiment 146. The frame of any one of embodiments 137-145, wherein the frame has a width of no more than about 3 feet, no more than about 4 feet, no more than about 5 feet, at least about 6 feet, no more than about 7 feet, no more than about 8 feet, no more than about 9 feet, no more than about 10 feet, no more than about 11 feet, no more than about 12 feet, no more than about 13 feet, no more than about 14 feet, or no more than about 15 feet.

Embodiment 147. The frame of any one of embodiments 137-146, wherein the frame has a height of at least about 4 feet, at least about 5 feet, at least about 6 feet, at least about 7 feet, at least about 8 feet, at least about 9 feet, at least about 10 feet, at least about 11 feet, or at least about 12 feet.

Embodiment 148. The frame of any one of embodiments 137-147, wherein the frame has a height of at least about 4 feet, at least about 5 feet, at least about 6 feet, at least about 7 feet, at least about 8 feet, at least about 9 feet, at least about 10 feet, at least about 11 feet, or at least about 12 feet.

Embodiment 149. The frame of any one of embodiments 137-148, wherein the apparatus is the apparatus of any one of embodiments 1-34 and 56-57.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A multivector extension device for an apparatus for exercising against a resistance, the multivector extension device comprising:

a brace for removably and adjustably attaching to a frame of the apparatus;

a multivector extension arm comprising a plurality of accessory receiving ports;

a ball joint joining the multivector extension arm to the brace while allowing the multivector extension arm freedom of movement relative to the brace;

at least one exercise engagement device removably attached to the multivector extension arm via a first accessory receiving port in the plurality of accessory receiving ports; and at least one exercise attachment point receiver removably attached to the multivector extension arm via a second accessory receiving port in the plurality of accessory receiving ports;

wherein the brace further comprises a support cone positioned about the ball joint to protect the frame from contact by the multivector extension arm.

2. The multivector extension device of claim 1, wherein the brace comprises a spring-loaded pin manipulated by a knob for engaging the frame of the apparatus.

3. The multivector extension device of claim 1, wherein the multivector extension arm comprises square tubing.

4. The multivector extension device of claim 1, wherein the at least one exercise engagement device comprises a single hand grip.

5. The multivector extension device of claim 1, wherein the at least one exercise engagement device comprises a two-handed bar.

6. The multivector extension device of claim 1, wherein the at least one exercise attachment point receiver comprises a J-hook for receiving an elastic band.

7. The multivector extension device of claim 1, wherein the at least one exercise attachment point receiver comprises an eye bolt.

8. The multivector extension device of claim 1, wherein the at least one exercise attachment point receiver comprises a spring-loaded pin for securing the exercise attachment point receiver in an accessory receiving port in the plurality of accessory receiving ports.

9. The multivector extension device of claim 1, wherein the at least one exercise engagement device comprises a spring-loaded pin for securing the exercise engagement device in an accessory receiving port in the plurality of accessory receiving ports.

10. The multivector extension device of claim 1, wherein the multivector extension arm comprises at least two telescoping members, and the plurality of accessory receiving ports comprises a plurality of telescoping member accessory receiving ports.

11. The multivector extension device of claim 10, wherein the at least two telescoping members comprise a first telescoping member and a second telescoping member, and the second telescoping member of the at least two telescoping members is selectively secured to the first telescoping member with at least one spring-loaded pin.

12. The multivector extension device of claim 10, wherein the at least one exercise engagement device is removably attached to the multivector extension arm via a third accessory receiving port in the plurality of telescoping member accessory receiving ports.

13. The multivector extension device of claim 10, wherein the at least one exercise attachment point receiver is removably attached to the multivector extension arm via a fourth accessory receiving port in the plurality of telescoping member accessory receiving ports.

14. The multivector extension device of claim 1, wherein the support cone comprises natural rubber, synthetic rubber, polyurethane, silicone, or a combination thereof.

15. The multivector extension device of claim 1, wherein the apparatus for exercising against a resistance further comprises a dip bar, a multi-use exerciser, a sit up board, a television, a sound system, a media player, or any combination thereof.

16. The multivector extension device of claim 1, wherein the apparatus for exercising against a resistance further comprises a multiuse exerciser that comprises an angle selector supporting a longitudinal member, the longitudinal member anchoring opposing ankle braces proximal to the angle selector, and supporting a multi-use pad distal from the angle selector.

17. A method of exercising against a plurality of resistances having multiple vectors, comprising:

obtaining a multivector extension device comprising:

a brace for removably and adjustably attaching to a frame of an apparatus;

a multivector extension arm comprising a first accessory receiving port, a second accessory receiving port, and a third accessory receiving port;

a ball joint joining the multivector extension arm to the brace while allowing the multivector extension arm freedom of movement relative to the brace;

the brace further comprising a support cone positioned about the ball joint to protect the frame from contact by the multivector extension arm;

a first exercise attachment point receiver removably attached to the multivector extension arm via the first accessory receiving port;

a second exercise attachment point receiver removably attached to the multivector extension arm via the second accessory receiving port;

an exercise engagement device removably attached to the multivector extension arm via the third accessory receiving port; and attaching a first resistance to the first exercise attachment point receiver;

attaching a second resistance to the second exercise attachment point receiver, wherein the first resistance has a first vector and the second resistance has a second vector, wherein the first vector differs from the second vector, and wherein the first vector and the second vector thereby form the plurality of resistances having multiple vectors; and moving the exercise engagement device against the plurality of resistances having multiple vectors, thereby exercising against the plurality of resistances having multiple vectors.

* * * * *